US011425793B2

(12) United States Patent
Fujimori et al.

(10) Patent No.: US 11,425,793 B2
(45) Date of Patent: Aug. 23, 2022

(54) PRINTING APPARATUS

(71) Applicant: Seiko Epson Corporation, Tokyo (JP)

(72) Inventors: Masaaki Fujimori, Minamiminowa (JP); Hironori Endo, Okaya (JP); Toshiyuki Suzuki, Matsumoto (JP); Toru Matsuyama, Matsumoto (JP); Ryo Hirabayashi, Matsumoto (JP); Nobuaki Ito, Shiojiri (JP)

(73) Assignee: Seiko Epson Corporation

( * ) Notice: Subject to any disclaimer, the term of this patent is extended or adjusted under 35 U.S.C. 154(b) by 271 days.

(21) Appl. No.: 16/879,822

(22) Filed: May 21, 2020

(65) Prior Publication Data

US 2020/0374983 A1 Nov. 26, 2020

(30) Foreign Application Priority Data

May 22, 2019 (JP) ..... JP2019-095676

(51) Int. Cl.
*H05B 1/02* (2006.01)
*B41J 11/00* (2006.01)

(52) U.S. Cl.
CPC ..... *H05B 1/0241* (2013.01); *B41J 11/002* (2013.01); *B41J 11/00216* (2021.01)

(58) Field of Classification Search
CPC . H05B 1/0241; B41J 11/002; B41J 11/00216; B41J 15/04; B41J 2/01
See application file for complete search history.

(56) References Cited

U.S. PATENT DOCUMENTS

2007/0279649 A1* 12/2007 Nakamaki ..... B41J 2/235 358/1.8
2017/0217211 A1 8/2017 Nakano

FOREIGN PATENT DOCUMENTS

JP 2017-132174 A 8/2017

* cited by examiner

*Primary Examiner* — Bradley W Thies
(74) *Attorney, Agent, or Firm* — Harness, Dickey & Pierce, P.L.C.

(57) ABSTRACT

There is provide a printing apparatus including: a transport section that transports a medium in a first direction; a discharge section that discharges a liquid to the medium transported by the transport section; a signal generation section that outputs a first pulse signal; and a heating section that is provided downstream of the discharge section in the first direction, includes a first heater that generates heat in accordance with a first pulse included in the first pulse signal, and heats the medium, in which the signal generation section adjusts the first pulse in accordance with a heating amount for heating the medium by the heating section.

8 Claims, 44 Drawing Sheets

| Sd[m] | TYPE OF D[m] TO BE DESIGNATED | SL[m] | | SL[m] | |
|---|---|---|---|---|---|
| | | TP1 | TP2 | TP1 | TP2 |
| (1, 1) | DP1 (LARGE DOT) | H | H | L | L |
| (1, 0) | DP2 (MEDIUM DOT) | H | L | L | L |
| (0, 1) | DP3 (SMALL DOT) | L | H | L | L |
| (0, 0) | DP0 (NON-FORMING) | L | L | L | L |

FIG. 11

TBL11

| DISCHARGE SECTION | REGION |
|---|---|
| D[1] | R[1] |
| D[2] | R[1] |
| ⋮ | ⋮ |
| D[M] | R[4] (R[J]) |

FIG. 12

TBL12

| PRINT MODE | MEDIUM TYPE | HEATING INTENSITY COEFFICIENT Sk1 |
|---|---|---|
| SPEED PRIORITY PRINT MODE | PLAIN PAPER | 3 |
| | CARDBOARD | 4 |
| | VINYL CHLORIDE | 5 |
| NORMAL PRINT MODE | PLAIN PAPER | 2 |
| | CARDBOARD | 3 |
| | VINYL CHLORIDE | 4 |
| IMAGE QUALITY PRIORITY PRINT MODE | PLAIN PAPER | 1 |
| | CARDBOARD | 2 |
| | VINYL CHLORIDE | 3 |

TBL13

| REGION DISCHARGE AMOUNT INFORMATION TR[j] | HEATING INTENSITY COEFFICIENT Sk2[j] |
|---|---|
| 0% | 0 |
| 1% TO 20% | 1 |
| 21% TO 40% | 2 |
| 41% TO 60% | 3 |
| 61% TO 80% | 4 |
| 81% TO 100% | 5 |

FIG. 15

TBL14A

| HEATER | HEATER CORRESPONDING REGION HEATING INTENSITY INFORMATION |
|---|---|
| H[1] | KR[1] |
| H[2] | KR[2] |
| H[3] | KR[3] |
| H[4] (H[K]) | KR[4] (KR[J]) |

FIG. 17

TBL15

| HEATER HEATING INTENSITY INFORMATION B[k] | INITIAL HEATING TIME Tini[k] | MAINTENANCE PULSE INTERVAL TIME Tkp[k] |
|---|---|---|
| 0 | 0 | ∞ |
| 1 | 800 | 2000 |
| 2 | 840 | 1800 |
| ⋮ | ⋮ | ⋮ |
| 25 | 1500 | 600 |

TBL14B

| HEATER | HEATER CORRESPONDING REGION HEATING INTENSITY INFORMATION | | |
|---|---|---|---|
| H[1] | KR[1] | KR[2] | Null |
| H[2] | KR[2] | KR[3] | KR[4] |
| H[3] | KR[4] | KR[5] | KR[6] |
| H[4] (H[K]) | KR[6] | KR[7] (KR[J]) | Null |

FIG. 34

TBL14C

| HEATER | HEATER CORRESPONDING REGION HEATING INTENSITY INFORMATION | |
|---|---|---|
| H[1] | KR[1] | α[2] * KR[2] |
| H[2] | α[2] * KR[2] | α[3] * KR[3] |
| H[3] | α[3] * KR[3] | α[4] * KR[4] |
| H[4] | α[4] * KR[4] | α[5] * KR[5] |
| H[5] (H[K]) | α[5] * KR[5] | KR[7] (KR[J]) |

FIG. 36

TBL14C

| HEATER | HEATER CORRESPONDING REGION HEATING INTENSITY INFORMATION | | |
|---|---|---|---|
| H[1] | KR[1] | α[2]*KR[2] | α[3]*KR[3] |
| H[2] | α[2]*KR[2] | α[3]*KR[3] | α[4]*KR[4] |
| H[3] | α[3]*KR[3] | α[4]*KR[4] | α[5]*KR[5] |
| H[4] | α[4]*KR[4] | α[5]*KR[5] | α[6]*KR[6] |
| H[5] | α[5]*KR[5] | α[6]*KR[6] | α[7]*KR[7] |
| H[6] | α[6]*KR[6] | α[7]*KR[7] | α[8]*KR[8] |
| H[7] | α[7]*KR[7] | α[8]*KR[8] | α[9]*KR[9] |
| H[8] | α[8]*KR[8] | α[9]*KR[9] | α[10]*KR[10] |
| H[9] (H[K]) | α[9]*KR[9] | α[10]*R[10] | KR[11] (KR[J]) |

FIG. 41

TBL14D

| HEATER | HEATER CORRESPONDING REGION HEATING INTENSITY INFORMATION | |
|---|---|---|
| | PP1 | PP2 |
| H[1] (H1[1]) | α[1]*KR[1] | 0 |
| H[2] (H1[2]) | α[2]*KR[2] | 0 |
| H[3] (H1[3]) | α[3]*KR[3] | 0 |
| H[4] (H2[1]) | α[1]*KR[1] | KR[1] |
| H[5] (H2[2]) | α[2]*KR[2] | KR[2] |
| H[6] (H2[3]) | α[3]*KR[3] | KR[3] |
| H[7] (H3[1]) | 0 | KR[4] |
| H[8] (H[K]) (H3[2]) | 0 | KR[5] |

FIG. 47

TBL14E

| HEATER | HEATER CORRESPONDING REGION HEATING INTENSITY INFORMATION | | |
|---|---|---|---|
| | PP1 | | PP2 |
| | CP IS ODD NUMBER | CP IS EVEN NUMBER | |
| H[1] | KR[1] | 0 | KR[1] |
| H[2] (H[K]) | 0 | KR[1] | KR[2] |

PRINTING APPARATUS

The present application is based on, and claims priority from JP Application Serial Number 2019-095676, filed May 22, 2019, the disclosure of which is hereby incorporated by reference herein in its entirety.

BACKGROUND

1. Technical Field

The present disclosure relates to a printing apparatus.

2. Related Art

In the related art, in a printing apparatus that forms an image by discharging a liquid to a medium, a technique of heating a medium to which the liquid discharged by the printing apparatus adheres and evaporating the water content of the liquid that has adhered to the medium is known. For example, JP-A-2017-132174 describes a technique of heating a medium to which a liquid has adhered using a heater.

In the technique of the related art, it becomes necessary to continue heating the medium by the heater during a printing period in which the printing apparatus continues the print processing of forming an image by discharging a liquid onto the medium. Therefore, in the technique of the related art, when the printing period prolongs, there is a case where the electric power required for heating the medium by the heater increases.

SUMMARY

According to an aspect of the disclosure, there is provided a printing apparatus including: a transport section that transports a medium in a first direction; a discharge section that discharges a liquid to the medium transported by the transport section; a signal generation section that outputs a first pulse signal; and a heating section that is provided downstream of the discharge section in the first direction, includes a first heater that generates heat in accordance with a first pulse included in the first pulse signal, and heats the medium, and in which the signal generation section adjusts the first pulse in accordance with a heating amount for heating the medium by the heating section.

BRIEF DESCRIPTION OF THE DRAWINGS

FIG. 11 is an explanatory diagram illustrating an example of a data structure of a belonging region information table.

FIG. 12 is an explanatory diagram illustrating an example of a data structure of a print mode information table.

FIG. 15 is an explanatory diagram illustrating an example of a data structure of a heater heating intensity information table.

FIG. 17 is an explanatory diagram illustrating an example of a data structure of a pulse waveform definition table.

FIG. 34 is an explanatory diagram illustrating an example of a data structure of a heater heating intensity information table.

FIG. 36 is an explanatory diagram illustrating an example of a data structure of a heater heating intensity information table according to Modification Example 3.1.

FIG. 41 is an explanatory diagram illustrating an example of a data structure of a heater heating intensity information table.

FIG. 47 is an explanatory diagram illustrating an example of a data structure of a heater heating intensity information table.

DESCRIPTION OF EXEMPLARY EMBODIMENTS

Hereinafter, embodiments for carrying out the disclosure will be described with reference to the drawings. However, in each drawing, the size and scale of each section are appropriately changed from the actual size and scale. Further, the embodiments described below are preferred specific examples of the disclosure, and therefore, various technically preferable limitations are given, but the scope of the disclosure is not limited to the following description, and is not limited to the embodiments unless otherwise stated.

1. First Embodiment

In the embodiment, a printing apparatus will be described using an ink jet printer that forms an image on a recording medium PP by discharging ink as an example. In the embodiment, the ink is an example of a "liquid", and the recording medium PP is an example of a "medium".

1.1. Overview of Ink Jet Printer

Hereinafter, an overview of an ink jet printer 1A according to the embodiment will be described with reference to FIG. 1.

Figure 1:
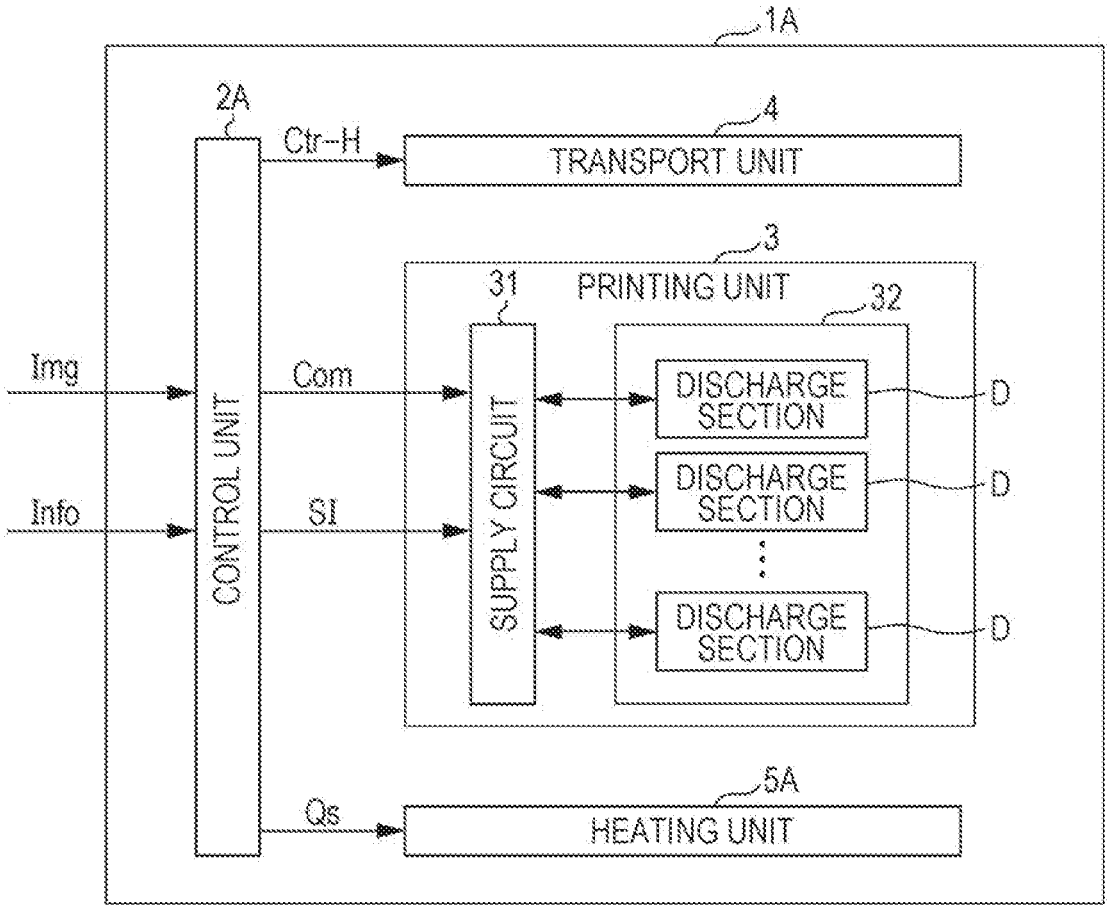
FIG. 1 is a block diagram illustrating an example of a configuration of an ink jet printer according to a first embodiment of the disclosure.

FIG. 1 is a functional block diagram illustrating an example of a configuration of the ink jet printer 1A.

As illustrated in FIG. 1, print data Img indicating an image to be formed by the ink jet printer 1A is supplied to the ink jet printer 1A from a host computer such as a personal computer or a digital camera. The ink jet printer 1A executes print processing of forming an image indicated by the print data Img supplied from the host computer on the recording medium PP.

Further, as illustrated in FIG. 1, print setting information Info is supplied from the host computer to the ink jet printer 1A. In the embodiment, as an example, a case is assumed in which the print setting information Info includes: print mode information Mod that designates a print mode, which is an aspect of an operation of the ink jet printer 1A when the ink jet printer 1A executes the print processing; copy number information BJ indicating the number of images to be formed by the ink jet printer 1A; and medium type information BT indicating the type of the recording medium PP on which the ink jet printer 1A forms an image. In the following, there is a case where a series of processing in which the ink jet printer 1A executes the print processing and forms the image indicated by the print data Img as many as the number of copies indicated by the copy number information BJ included in the print setting information Info after receiving the print data Img and the print setting information Info, is called a print job.

In the embodiment, as an example, a case is assumed in which the ink jet printer 1A can execute the print processing in three types of print modes: a normal print mode, a speed priority print mode, and an image quality priority print mode. Here, the speed priority print mode is a print mode in which the print processing is executed such that the image quality of an image formed in the print processing is lower but the speed of the print processing is higher than those in the normal print mode. The image quality priority print mode is a print mode in which the print processing is executed such that the speed of the print processing is lower but the image quality of an image formed in the print processing is higher than those in the normal print mode.

Further, in the embodiment, as an example, a case is assumed in which three types of recording media PP such as plain paper, cardboard, and vinyl chloride sheet exist as recording media PP that can be used in the print processing by the ink jet printer 1A. Here, the plain paper is a medium formed of paper. In addition, the cardboard is a medium formed of paper thicker than plain paper. The vinyl chloride sheet is a medium formed of vinyl chloride.

As illustrated in FIG. 1, the ink jet printer 1A includes a control unit 2A that controls each section of the ink jet printer 1A; a printing unit 3 provided with a discharge section D that discharges ink to the recording medium PP; a transport unit 4 for changing a relative position of the recording medium PP with respect to the printing unit 3; and a heating unit 5A for heating the recording medium PP to which the ink discharged from the discharge section D adheres to evaporate the water content of the ink on the recording medium PP.

The control unit 2A is configured to include one or a plurality of CPUs and a digital-analog conversion circuit. However, the control unit 2A may include various circuits such as an FPGA instead of the CPU or in addition to the CPU. Here, the CPU is an abbreviation for central processing unit, and the FPGA is an abbreviation for field-programmable gate array.

As illustrated in FIG. 1, the control unit 2A generates a drive signal Com for driving the discharge section D, and supplies the generated drive signal Com to the printing unit 3.

Further, the control unit 2A generates the print signal SI for designating the type of operation of the discharge section D based on the print data Img and the print setting information Info, and supplies the generated print signal SI to the printing unit 3. Here, the print signal SI is a signal that designates the type of operation of the discharge section D by designating whether to supply the drive signal Com to the discharge section D. The control unit 2A can form an image indicated by the print data Img on the recording medium PP by discharging ink from the discharge section D in accordance with the print signal SI generated based on the print data Img.

Further, the control unit 2A generates a transport control signal Ctr-H for controlling the transport unit 4 based on the print setting information Info, and supplies the generated transport control signal Ctr-H to the transport unit 4.

Further, the control unit 2A generates a heating control signal Qs for controlling the heating unit 5A based on the print signal SI and the print setting information Info, and supplies the generated heating control signal Qs to the heating unit 5A.

As illustrated in FIG. 1, the printing unit 3 includes a supply circuit 31 and a print head 32.

The print head 32 includes M discharge sections D. Here, the value M is a natural number that satisfies "M≥2". Hereinafter, there is a case where, among the M discharge sections D provided in the print head 32, the m-th discharge section D is referred to as a discharge section D[m]. Here, the variable m is a natural number that satisfies "1≤m≤M". In the following, when a configuration element, a signal, or the like of the ink jet printer 1A corresponds to the discharge section D[m] of the M discharge sections D, there is a case where a subscript [m] is added to the reference numeral for representing the configuration element, the signal, or the like.

The supply circuit 31 switches whether to supply the drive signal Com to the discharge section D[m] based on the print signal SI. In the following, there is a case where, among the drive signals Com, the drive signal Com supplied to the discharge section D[m] is referred to as a supply drive signal Vin[m].

1.2. Configuration of Ink Jet Printer

Next, a configuration of the ink jet printer 1A according to the embodiment will be described with reference to FIGS. 2 to 5.

Figure 2:
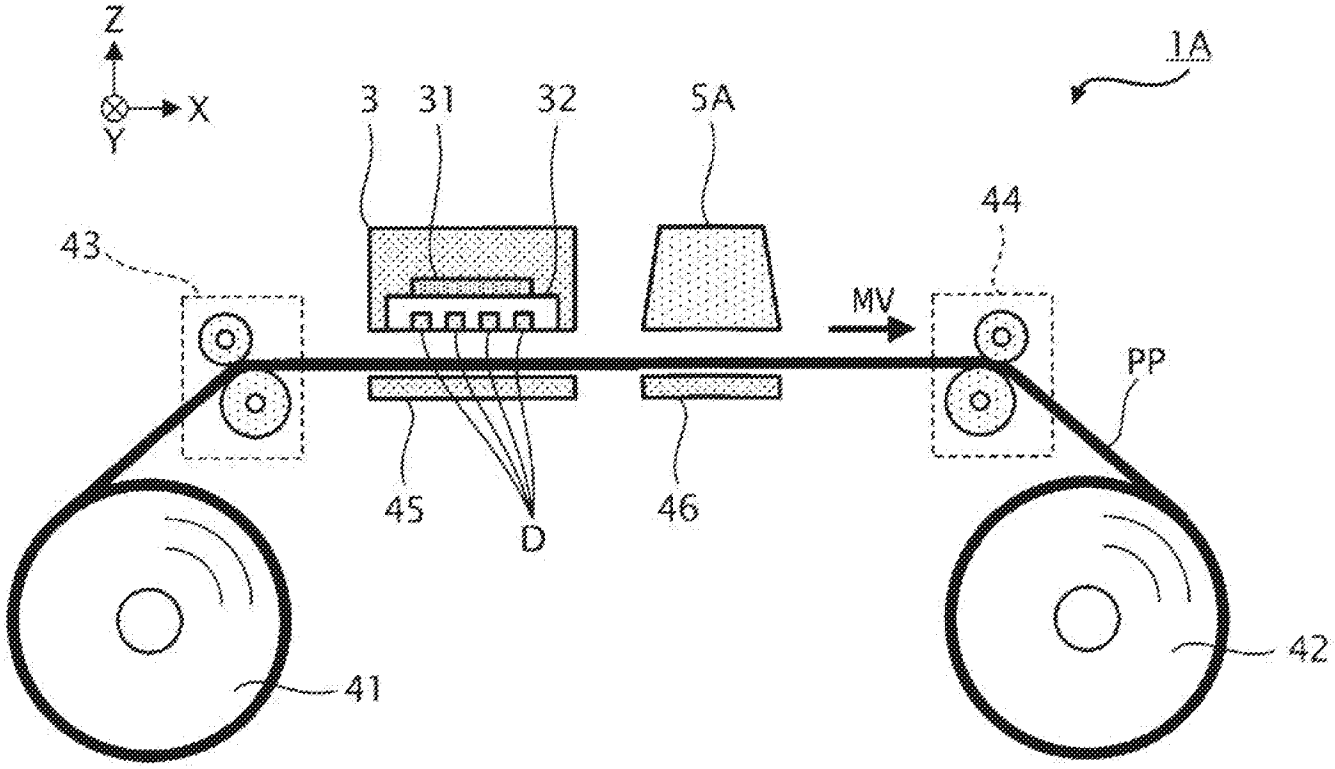
FIG. 2 is a sectional view illustrating an example of a schematic internal structure of the ink jet printer.

FIG. 2 is a view illustrating an example of a schematic sectional configuration of the ink jet printer 1A when the ink jet printer 1A is viewed from the −Y direction. In the embodiment, as an example, a case is assumed in which the ink jet printer 1A is a line printer. In the embodiment, as an example, a case is assumed in which the recording medium PP is an elongated rollable sheet.

In the following, there is a case where the −Y direction and the +Y direction, which is a direction opposite to the −Y direction, are collectively referred to as the Y axis direction. Hereinafter, there is a case where the +X direction, which is a direction orthogonal to the +Y direction, and the −X direction, which is a direction opposite to the +X direction, are collectively referred to as the X axis direction. Further, hereinafter, there is a case where the +Z direction, which is a direction orthogonal to the +X direction and the +Y direction, and the −Z direction, which is a direction opposite to the +Z direction, are collectively referred to as the Z axis direction. The −Z direction may be, for example, a vertically downward direction.

As illustrated in FIG. 2, the transport unit 4 includes: an accommodating device 41 that accommodates the recording medium PP therein before the image is formed; a receiving device 42 that receives the recording medium PP on which the image is formed; and a transport roller 43 that transports the recording medium PP in the +X direction in accordance with the transport control signal Ctr-H; a transport roller 44 that transports the recording medium PP in the +X direction in accordance with the transport control signal Ctr-H; a support 45 that supports the recording medium PP on the −Z side of the printing unit 3; and a support 46 that supports the recording medium PP on the −Z side of the heating unit 5A. Then, when the print job is executed, the transport unit 4 transports the recording medium PP along a medium transport path defined by the transport roller 43, the support 45, the support 46, and the transport rollers 44 at a speed MV defined by the transport control signal Ctr-H from the −X side to the +X side.

As illustrated in FIG. 2, the heating unit 5A is provided on the +X side of the printing unit 3. The heating unit 5A dries the ink discharged from the discharge section D provided in the printing unit 3 to the recording medium PP.

Although not illustrated, the ink jet printer 1A includes four ink cartridges provided in one-to-one correspondence with four color inks of black, cyan, magenta, and yellow. Each ink cartridge retains ink of a color that corresponds to the ink cartridge.

Figure 3:
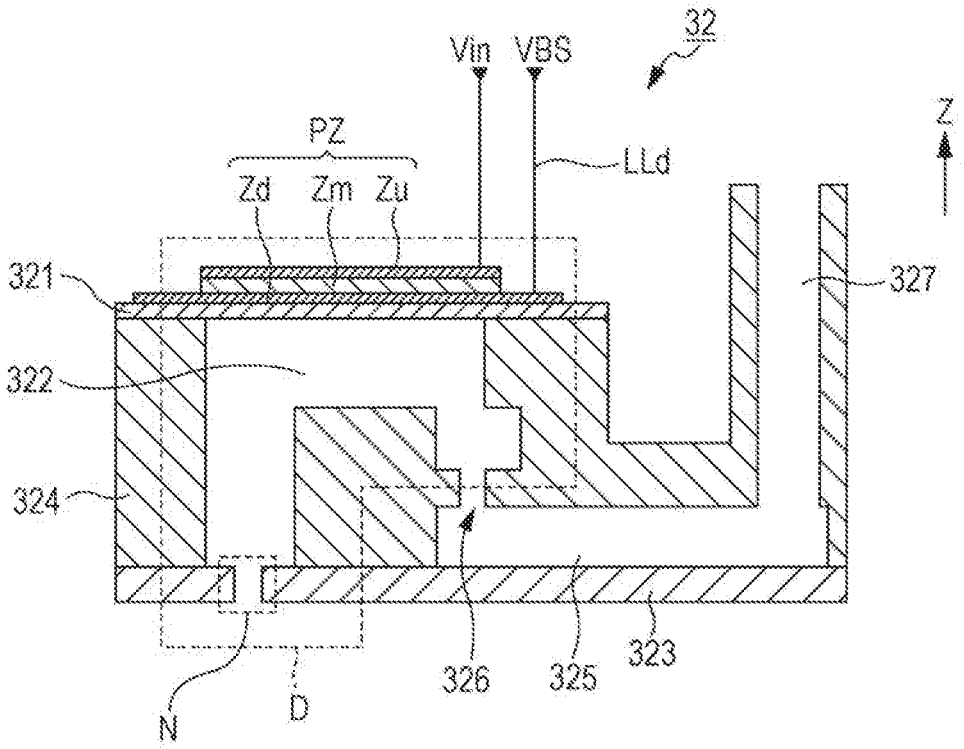
FIG. 3 is an explanatory view for describing an example of a structure of a discharge section.

FIG. 3 is a schematic partial sectional view of the print head 32 obtained by cutting the print head 32 so as to include the discharge section D.

As illustrated in FIG. 3, the discharge section D includes a piezoelectric element PZ, a cavity 322 filled with ink, a nozzle N that communicates with the cavity 322, and a diaphragm 321. The discharge section D discharges the ink in the cavity 322 from the nozzle N by driving the piezoelectric element PZ by the supply drive signal Vin. The cavity 322 is a space defined by the cavity plate 324, the nozzle plate 323 in which the nozzles N are formed, and the diaphragm 321. The cavity 322 communicates with a reservoir 325 via an ink supply port 326. The reservoir 325 communicates with the ink cartridge that corresponds to the discharge section D among the four ink cartridges via an ink intake port 327. The piezoelectric element PZ has an upper electrode Zu, a lower electrode Zd, and a piezoelectric body Zm provided between the upper electrode Zu and the lower electrode Zd. The lower electrode Zd is electrically coupled to a power supply line LLd set to a potential VBS. When the supply drive signal Vin is supplied to the upper electrode Zu and a voltage is applied between the upper electrode Zu and the lower electrode Zd, the piezoelectric element PZ is displaced in the +Z direction or the −Z direction in accordance with the applied voltage, and as a result, the piezoelectric element PZ vibrates. The lower electrode Zd is joined to the diaphragm 321. Therefore, when the piezoelectric element PZ is driven by the supply drive signal Vin and vibrates, the diaphragm 321 also vibrates. The vibration of the diaphragm 321 changes the volume of the cavity 322 and the pressure in the cavity 322, and the ink that fills the cavity 322 is discharged from the nozzle N. When the ink in the cavity 322 is discharged and the amount of the ink in the cavity 322 decreases, the discharge section D receives supply of ink from the ink cartridge that corresponds to the discharge section D.

Figure 4:
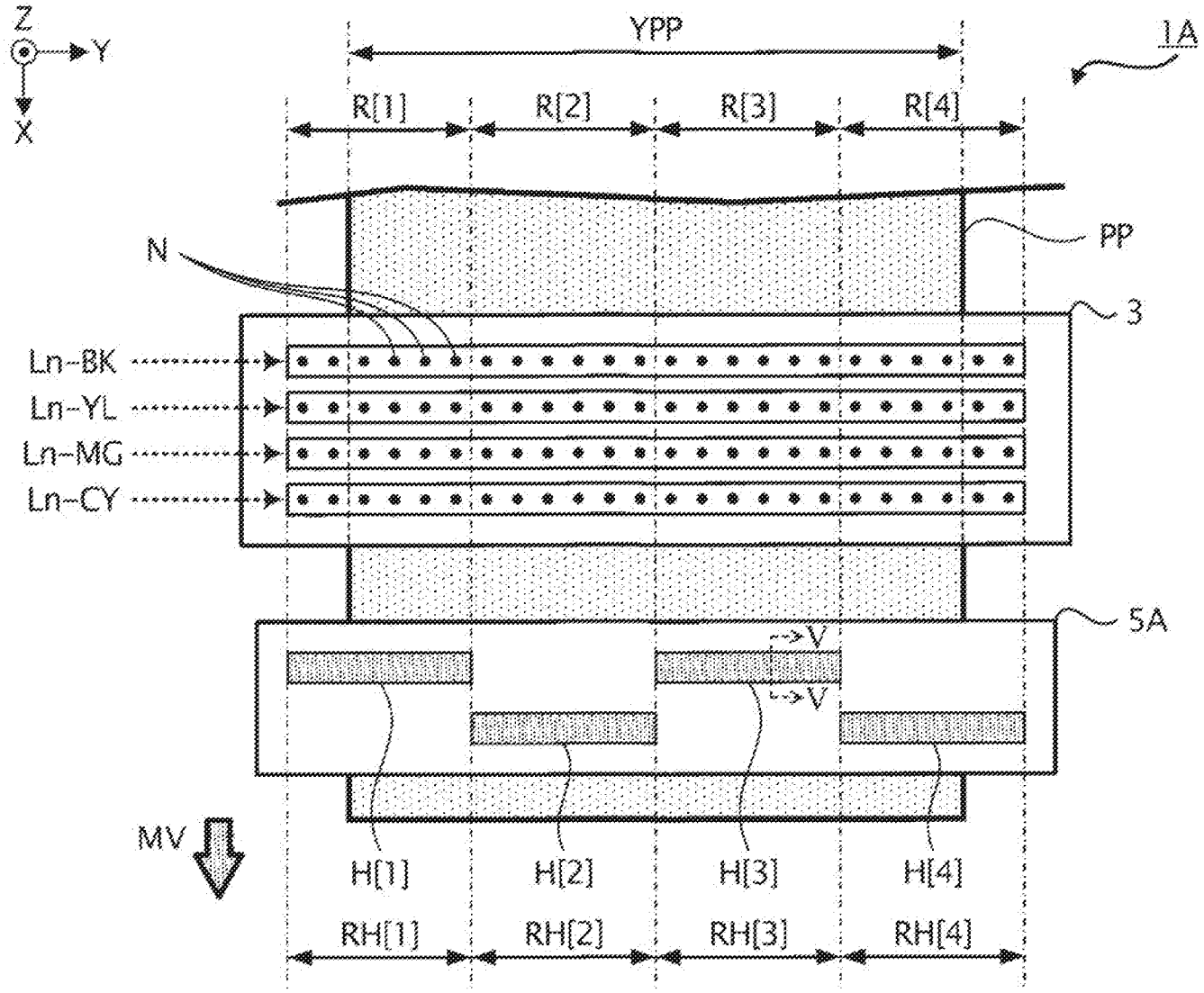
FIG. 4 is a plan view illustrating an example of a configuration of a printing unit and a heating unit.

FIG. 4 is a schematic view illustrating an example of a planar configuration of the ink jet printer 1A when the ink jet printer 1A is viewed from the +Z direction.

As illustrated in FIG. 4, the printing unit 3 includes four nozzle rows Ln, such as a nozzle row Ln-BK which is a plurality of nozzles N that extend in the Y axis direction; a nozzle row Ln-CY which is a plurality of nozzles N that extend in the Y axis direction; a nozzle row Ln-MG that is a plurality of nozzles N that extend in the Y axis direction; and a nozzle row Ln-YL that is a plurality of nozzles N that extend in the Y axis direction. Here, each of the plurality of nozzles N that belong to the nozzle row Ln-BK is a nozzle N provided in the discharge section D that discharges black ink, each of the plurality of nozzles N that belong to the nozzle row Ln-CY is a nozzle N provided in the discharge section D that discharges cyan ink, each of the plurality of nozzles N that belong to the nozzle row Ln-MG is a nozzle N provided in the discharge section D that discharges magenta ink, and each of the plurality of nozzles N that belong to the nozzle row Ln-YL is a nozzle N provided in a discharge section D that discharges yellow ink. A range in which each nozzle row Ln extends in the Y axis direction is equal to or larger than a range YPP in the Y axis direction of the recording medium PP transported by the transport unit 4.

As illustrated in FIG. 4, the heating unit 5A is provided with K heaters H[1] to H[K]. Here, the value K is a natural number that satisfies "K≥2". In the embodiment, a case where the value K is "4" will be described as an example. Hereinafter, the k-th heater among the K heaters H[1] to H[K] is referred to as a heater H[k]. Here, the variable k is a natural number that satisfies "1≤k≤K".

In the embodiment, the heater H[k] has a rectangular shape having a long side that extends in the Y axis direction and a short side that extends in the X axis direction when viewed from the Z axis direction. In other words, in the embodiment, the heater H[k] is provided so as to extend in the Y axis direction.

In the following, a region where the heater H[k] exists in the Y axis direction is referred to as a region RH[k].

As illustrated in FIG. 4, the regions RH[1] to RH[K] are set such that the range where the regions RH[1] to RH[K] exist in the Y axis direction includes the range YPP. In the embodiment, as illustrated in FIG. 4, as an example, a case is assumed in which the region RH[k1] and the region RH[k2] are in contact with each other in the Y axis direction and the region RH[k1] and the region RH[k2] are set so as not to overlap each other in the X axis direction. In the embodiment, the variable k1 is a natural number that satisfies "1≤k1<K", and the variable k2 is a natural number that satisfies "1<k2≤K" and "k2=1+k1".

In the following, the regions R[1] to R[J] are set such that the M discharge sections D belong to any one region R[j] among the regions R[1] to R[J]. Specifically, the regions R[1] to R[J] are set such that the range where the regions R[1] to R[J] exist in the Y axis direction includes the range where the M discharge sections D extend in the Y axis direction. Here, the value J is a natural number that satisfies "J≥2". The variable j is a natural number that satisfies "1≤j≤J".

In the regions R[1] to R[J], the regions RH[j1] and RH[j2] are in contact with each other in the Y axis direction, and the regions RH[j1] and RH[j2] are set so as not to overlap each other in the X axis direction. In the embodiment, the variable j1 is a natural number that satisfies "1≤j1<J", and the variable j2 is a natural number that satisfies "1<j1≤J" and "j2=1+j1".

In the embodiment, a case where "J" is "4" will be described as an example. Furthermore, in the embodiment, when "k=j" is established, as an example, a case is assumed in which the regions R[1] to R[J] are provided such that the range where the region RH[k] exist in the Y axis direction and the range where the region R[j] exist in the Y axis direction match each other. In other words, in the embodiment, as an example, a case is assumed in which the regions R[1] to R[J] are provided such that the range where the region RH[k] exist in the Y axis direction and the range where the region R[k] exist in the Y axis direction match each other.

Figure 5:
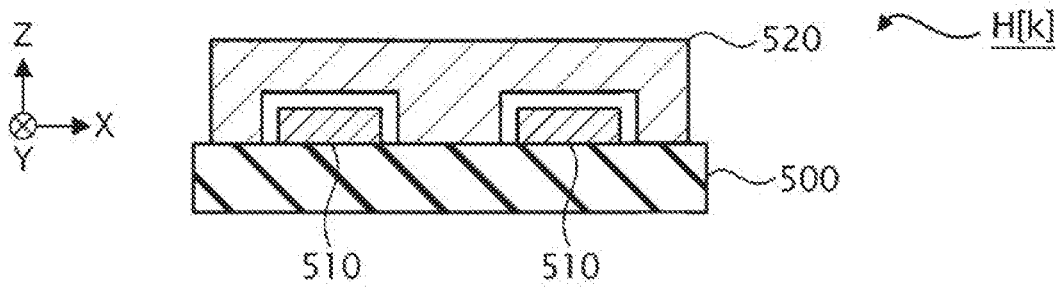
FIG. 5 is a sectional view illustrating an example of a configuration of a heater.

FIG. 5 is a schematic partial sectional view of the heater H[k] cut along a line V-V illustrated in FIG. 4.

As illustrated in FIG. 5, the heater H[k] includes: a ceramic substrate 500, a heat generating resistor 510 provided on the +Z side of the ceramic substrate 500; and a protection section 520 provided to seal the heat generating resistor 510 on the +Z side of the heat generating resistor 510.

In the embodiment, the ceramic substrate 500 is formed including a ceramic material such as aluminum oxide, silicon nitride, or aluminum nitride. Aluminum oxide, silicon nitride, aluminum nitride, or the like has a higher thermal conductivity than that of glass, for example, quartz glass. Therefore, the heater H[k] can increase a temperature increasing speed and a temperature decreasing speed to be higher than, for example, those of a quartz glass heater using a quartz glass substrate instead of the ceramic substrate 500.

In general, in a ceramic heater using the ceramic substrate, when the area of the ceramic heater is large, there is a high possibility that the temperature of each part of the ceramic heater varies. Therefore, when the recording medium PP is heated using a single ceramic heater having a large area, there is a high possibility that it becomes difficult to accurately heat the entire recording medium PP at a desired temperature.

On the other hand, the heating unit 5A according to the embodiment heats the recording medium PP using the K heaters H[1] to H[K]. In other words, in the embodiment, it becomes possible to reduce the size of each heater H[k] compared to an aspect in which the recording medium PP is heated using a single ceramic heater. Therefore, in the embodiment, for example, compared to an aspect in which the recording medium PP is heated using a single ceramic heater, it is possible to increase the possibility that the entire recording medium PP can be accurately heated at a desired temperature.

In the embodiment, the heat generating resistor 510 is, for example, a non-metallic resistor that generates heat when energized. Specifically, a so-called "carbon wire" including carbon fibers can be adopted as the heat generating resistor 510. In this manner, in the embodiment, since the non-metallic resistor is adopted as the heat generating resistor 510, it becomes possible to suppress corrosion of the heat generating resistor 510 due to the ink, for example, compared to a case where a metal resistor is adopted as the heat generating resistor 510.

In the embodiment, the protection section 520 is formed of, for example, glass. In the embodiment, since the protection section 520 is formed of glass, it becomes possible to suppress corrosion of the protection section 520 due to the ink, for example, compared to a case where the protection section 520 is formed of an organic material.

In the embodiment, any one of an aqueous ink, an oil-based ink, and a reactive ink may be adopted as the ink used in the print processing by the ink jet printer 1A.

Here, the reactive ink is, for example, a solvent ink in which a coloring material such as a pigment or a dye is dispersed in various solvents such as an oily solvent or an aqueous solvent, a photoreactive ink of which characteristics change due to light irradiation, a textile printing ink appropriate for performing textile printing on a fabric, or a pretreatment ink that is jetted beforehand onto a fabric as pretreatment at the time of textile printing. An example of the photoreactive ink is an ultraviolet hardening ink that is hardened by irradiation with ultraviolet light. The solvent ink is disclosed in, for example, JP-A-2014-080539. The photoreactive ink is disclosed in, for example, JP-A-2015-174077. The textile printing ink is disclosed, for example, in JP-A-2017-222943. The pretreatment ink is disclosed, for example, in JP-A-2004-143621. The reactive ink tends to be more reactive or corrosive to organic or metallic materials than the aqueous ink.

As described above, the heater H[k] according to the embodiment includes the non-metallic heat generating resistor 510 and the protection section 520 formed of glass. Therefore, for example, compared to an aspect in which the heater includes a metallic heat generating resistor and a protection section formed of an organic material, even when the reactive ink is adopted as the ink used by the ink jet printer 1A, it becomes possible to reduce the damage to the heater H[k] due to the reactive ink.

1.3. Overview of Printing Unit 3

Next, an overview of the printing unit 3 according to the embodiment will be described with reference to FIGS. 6 to 8.

Figure 6:
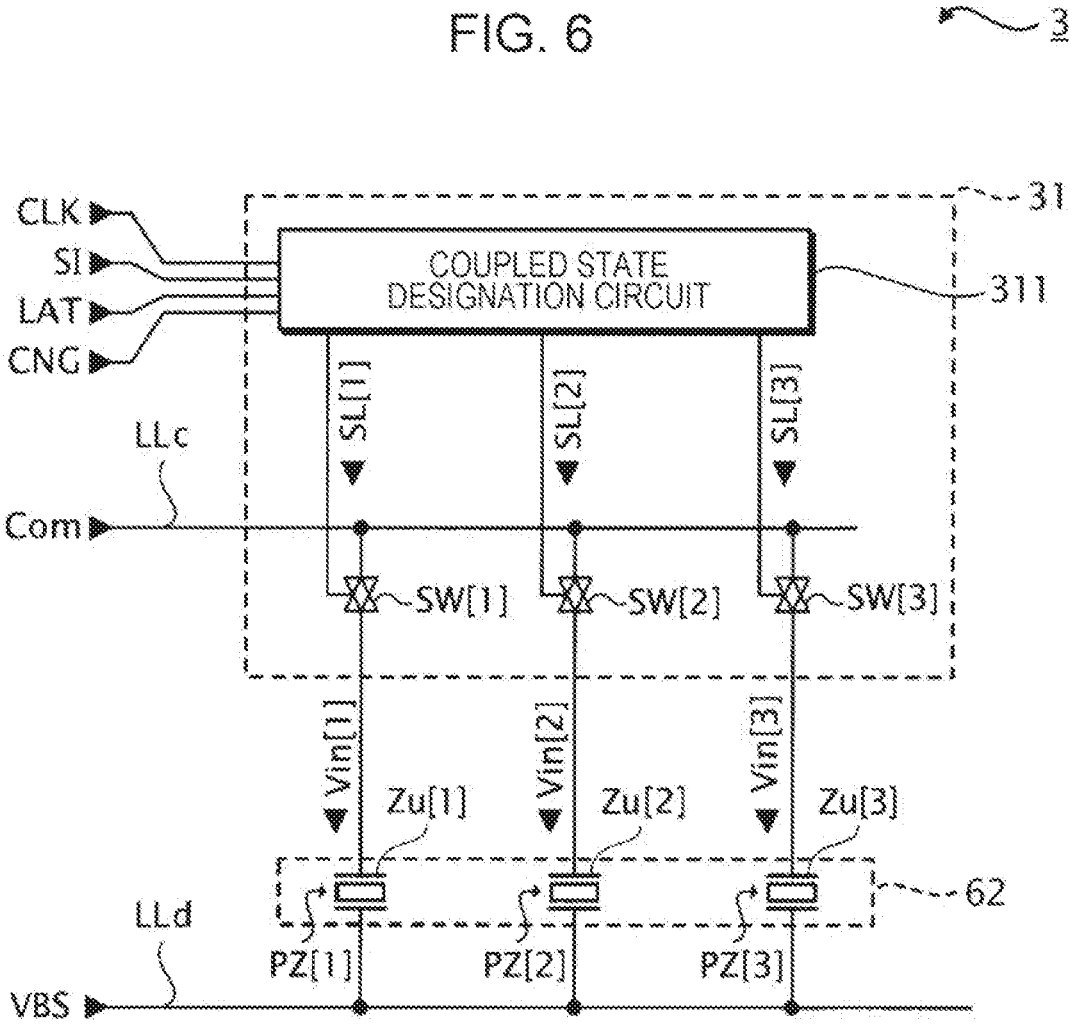
FIG. 6 is a block diagram illustrating an example of a configuration of the printing unit.

FIG. 6 is a block diagram illustrating an example of a configuration of the printing unit 3. As described above, the printing unit 3 includes the supply circuit 31 and the print head 32. Further, the printing unit 3 includes a wiring LLc to which the drive signal Com is supplied from the control unit 2A, and a power supply line LLd to which the potential VBS is supplied.

As illustrated in FIG. 6, the supply circuit 31 includes M switches SW[1] to SW[M] and a coupled state designation circuit 311 for designating the coupled state of each switch SW[m]. The coupled state designation circuit 311 generates a coupled state designation signal SL[m] for designating on and off of the switch SW[m] based on at least a part of the print signal SI, a latch signal LAT, and a change signal CNG which are supplied from the control unit 2A. The switch SW[m] switches conduction and non-conduction between the wiring LLc and the upper electrode Zu[m] of the piezoelectric element PZ[m] provided in the discharge section D[m] based on the coupled state designation signal SL[m]. In the embodiment, the switch SW[m] is turned on when the coupled state designation signal SL[m] is at a high level, and is turned off when the coupled state designation signal SL[m] is at a low level.

Figures 7, 8:
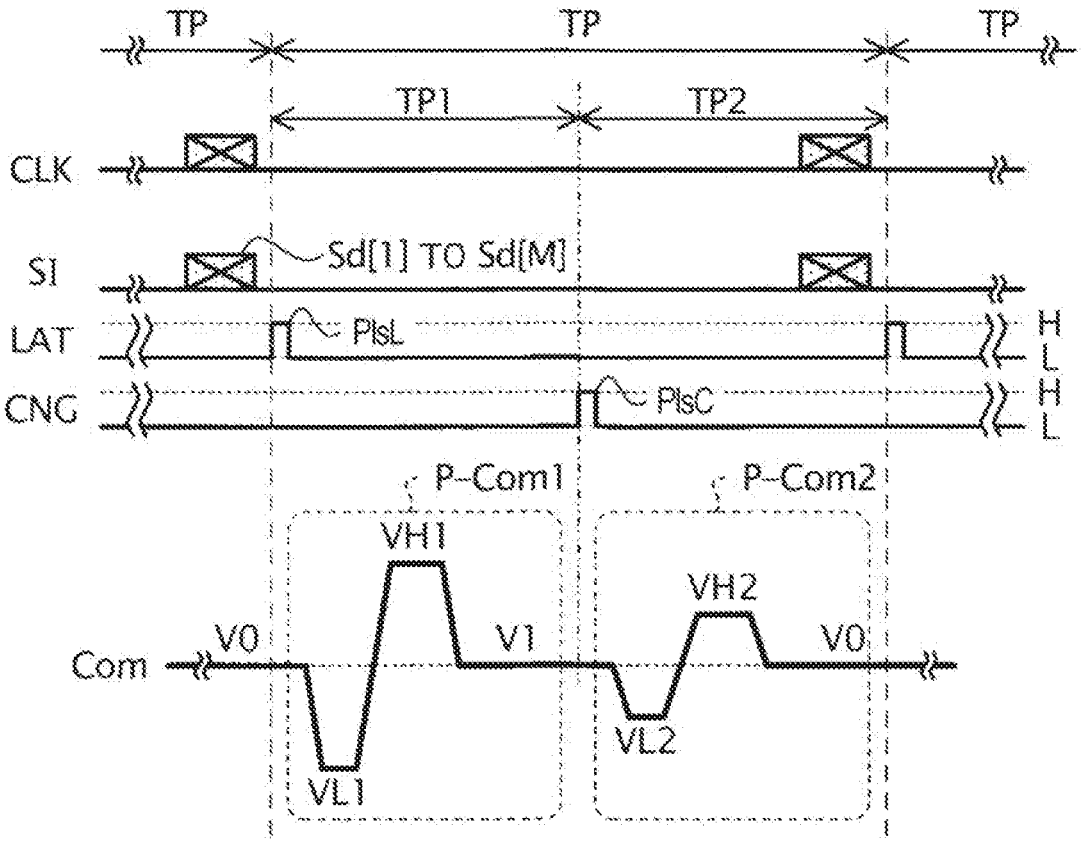
FIG. 7 is a timing chart for describing an example of a signal supplied to the printing unit.
FIG. 8 is an explanatory diagram for describing an example of an operation of a coupled state designation circuit.

FIG. 7 is a timing chart illustrating various signals supplied to the printing unit 3 during a unit printing period TP.

In the embodiment, when the ink jet printer 1A executes the print processing, one or a plurality of unit printing periods TP are set as operation periods of the ink jet printer 1A. The ink jet printer 1A according to the embodiment can drive each discharge section D for the print processing in each unit printing period TP.

As illustrated in FIG. 7, the control unit 2A outputs the latch signal LAT having a pulse PlsL. Accordingly, the control unit 2A defines the unit printing period TP as a period from the rising of the pulse PlsL to the rising of the next pulse PlsL. The control unit 2A outputs the change signal CNG having a pulse PlsC during the unit printing period TP. Then, the control unit 2A classifies the unit printing period TP into a control period TP1 from the rising of the pulse PlsL to the rising of the pulse PlsC and a control period TP2 from the rising of the pulse PlsC to the rising of the pulse PlsL.

In the embodiment, the print signal SI includes M individual designation signals Sd[1] to Sd[M] that has a one-to-one correspondence with the M discharge sections D[1] to D[M]. The individual designation signal Sd[m] designates an aspect of driving of the discharge section D[m] in each unit printing period TP when the ink jet printer 1A executes the print processing.

As illustrated in FIG. 7, the control unit 2A synchronizes the print signal SI including the individual designation signals Sd [1] to Sd[M] with a clock signal CLK before the unit printing period TP in which the print processing is executed, and then supplies the print signal to the coupled state designation circuit 311. Then, the coupled state designation circuit 311 generates the coupled state designation signal SL[m] based on the individual designation signal Sd[m] in the unit printing period TP.

In the embodiment, a case is assumed in which the discharge section D[m] can form a large dot, a medium dot smaller than the large dot, and a small dot smaller than the medium dot by the ink discharged from the discharge section D[m]. In the embodiment, in the unit printing period TP, a case is assumed in which the individual designation signal Sd[m] can take any one of four values such as a value (1, 1) that designates the discharge section D[m] as a large dot forming discharge section DP1 for discharging the ink having an amount corresponding to a large dot, a value (1, 0) that designates the discharge section D[m] as a medium dot forming discharge section DP2 for discharging the ink having an amount corresponding to a medium dot, a value (0, 1) that designates the discharge section D[m] as a small dot forming discharge section DP3 that discharges the ink having an amount corresponding to a small dot, and a value (0, 0) that designates the discharge section D[m] as a dot non-forming discharge section DP0 that does not discharge ink.

As illustrated in FIG. 7, in the embodiment, the drive signal Com has a waveform P-Com1 provided in the control period TP1 and a waveform P-Com2 provided in the control period TP2. In the embodiment, the waveform P-Com1 and the waveform P-Com2 are determined such that the potential difference between the highest potential VH1 and the lowest potential VL1 of the waveform P-Com1 is larger than the potential difference between the highest potential VH2 and the lowest potential VL2 of the waveform P-Com2. Specifically, when the drive signal Com having the waveform P-Com1 is supplied to the discharge section D[m] as the supply drive signal Vin[m], the waveform P-Com1 is determined such that the discharge section D[m] is driven in an aspect in which the ink having an amount corresponding to the medium dot is discharged. In addition, when the drive signal Com having the waveform P-Com2 is supplied to the discharge section D[m] as the supply drive signal Vin[m], the waveform P-Com2 is determined such that the discharge section D[m] is driven in an aspect in which the ink having an amount corresponding to the small dot is discharged. In the embodiment, the potentials at the start and end of the unit printing period TP are set to a reference potential V0 in the waveforms P-Com1 and P-Com2.

FIG. 8 is an explanatory diagram for describing the relationship between the individual designation signal Sd[m] and the coupled state designation signal SL[m] in the unit printing period TP.

As illustrated in FIG. 8, when the individual designation signal Sd[m] indicates a value (1, 1) that designates the discharge section D[m] as the large dot forming discharge section DP1 in the unit printing period TP, the coupled state designation circuit 311 sets the coupled state designation signal SL[m] to a high level over the unit printing period TP. In this case, the switch SW[m] is turned on over the unit printing period TP. Therefore, the discharge section D[m] is driven by the supply drive signal Vin[m] having the waveforms P-Com1 and P-Com2 in the unit printing period TP, and discharges the ink having an amount corresponding to a large dot.

As illustrated in FIG. 8, when the individual designation signal Sd[m] indicates a value (1, 0) that designates the discharge section D[m] as the medium dot forming discharge section DP2 in the unit printing period TP, the coupled state designation circuit 311 sets the coupled state designation signal SL[m] to a high level over the control period TP1. In this case, the switch SW[m] is turned on only during the control period TP1. Therefore, the discharge section D[m] is driven by the supply drive signal Vin[m] having the waveform P-Com1 in the unit printing period TP, and discharges the ink having an amount corresponding to a medium dot.

As illustrated in FIG. 8, when the individual designation signal Sd[m] indicates a value (0, 1) that designates the discharge section D[m] as the small dot forming discharge section DP3 in the unit printing period TP, the coupled state designation circuit 311 sets the coupled state designation signal SL[m] to a high level over the control period TP2. In this case, the switch SW[m] is turned on only during the control period TP2. Therefore, the discharge section D[m] is driven by the supply drive signal Vin[m] having the waveform P-Com2 in the unit printing period TP, and discharges the ink having an amount corresponding to a small dot.

As illustrated in FIG. 8, when the individual designation signal Sd[m] indicates a value (0, 0) that designates the discharge section D[m] as the dot non-forming discharge section DP0 in the unit printing period TP, the coupled state designation circuit 311 sets the coupled state designation signal SL[m] to a low level over the unit printing period TP. In this case, the switch SW[m] is turned off over the unit printing period TP. Therefore, the discharge section D[m] is not driven by the drive signal Com in the unit printing period TP, and does not discharge ink.

The large dot forming discharge section DP1, the medium dot forming discharge section DP2, and the small dot forming discharge section DP3 correspond to "specific discharge section".

Further, in the embodiment, the small dot forming discharge section DP3 corresponds to the "first specific discharge section", the amount that corresponds to the small dot corresponds to a "first reference amount", and the medium dot forming discharge section DP2 and the large dot forming discharge section DP1 correspond to a "second specific discharge section", and the amount that corresponds to the medium dot and the amount that corresponds to the large dot correspond to a "second reference amount". However, the small dot forming discharge section DP3 and the medium dot forming discharge section DP2 may correspond to the "first specific discharge section", the amount that corresponds to the small dot and the amount that corresponds to the medium dot may correspond to the "first reference amount", the large dot forming discharge section DP1 may correspond to the "second specific discharge section", and the amount that corresponds to the large dot may correspond to the "second reference amount".

1.4. Overview of Control Unit 2A

Next, an overview of the control unit 2A according to the embodiment will be described with reference to FIGS. 9 to 17.

Figure 9:
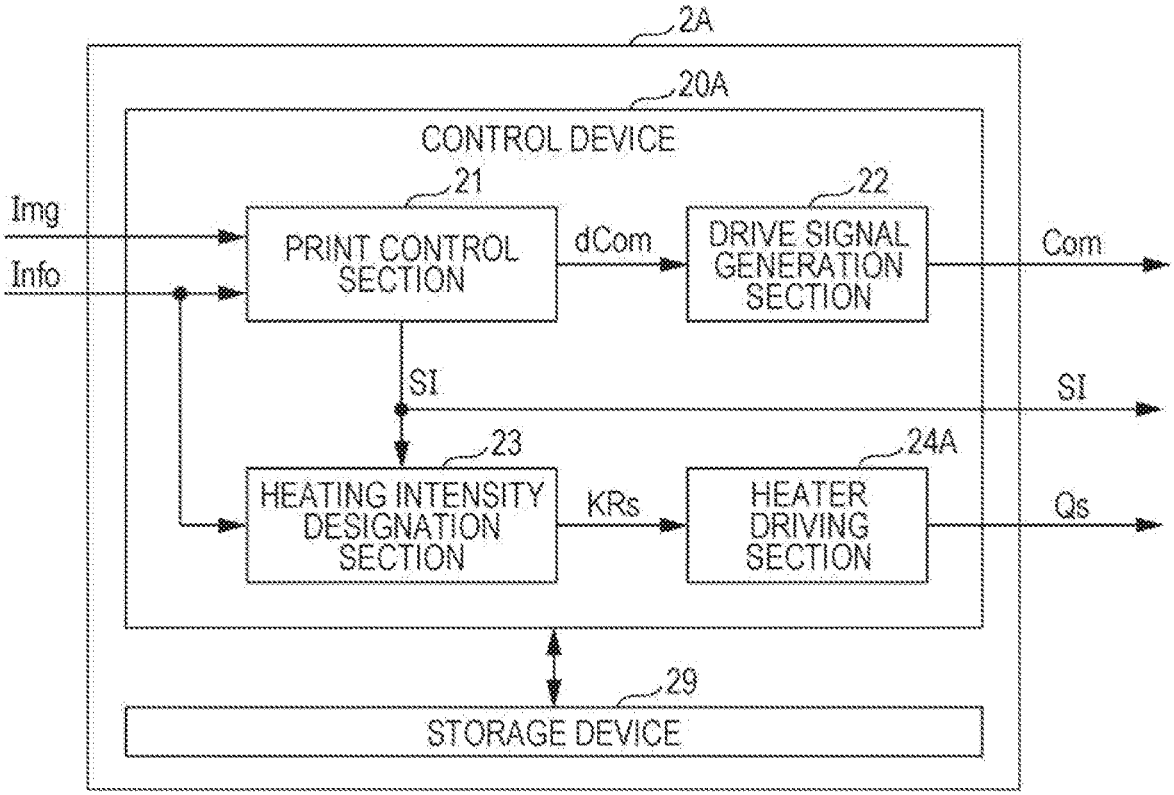
FIG. 9 is a block diagram illustrating an example of a configuration of a control unit.

FIG. 9 is a functional block diagram illustrating an example of a configuration of the control unit 2A.

As illustrated in FIG. 9, the control unit 2A includes a control device 20A that controls each section of the ink jet printer 1A, and a storage device 29 that stores various pieces of information.

The control device 20A includes a print control section 21, a drive signal generation section 22, a heating intensity designation section 23, and a heater driving section 24A. In addition, the storage device 29 stores therein a belonging region information table TBL11, a print mode information table TBL12, a discharge amount information table TBL13, a heater heating intensity information table TBL14A, a pulse waveform definition table TBL15, and a control program of the ink jet printer 1A.

As illustrated in FIG. 9, the print control section 21 generates a waveform defining signal dCom which is a digital signal that defines the waveform of the drive signal Com. In the embodiment, the print control section 21 is a functional block that functions when the CPU provided in the control unit 2A operates according to the control program stored in the storage device 29. However, the print control section 21 may be an electric circuit separated from the CPU provided in the control unit 2A.

Further, the print control section 21 generates the print signal SI based on the print data Img. Although not illustrated, the print control section 21 generates the transport control signal Ctr-H based on the print setting information Info.

As illustrated in FIG. 9, the drive signal generation section 22 generates the drive signal Com, which is an analog signal having a waveform defined by the waveform defining signal dCom, based on the waveform defining signal dCom. The drive signal generation section 22 is configured to include, for example, a DA conversion circuit.

As illustrated in FIG. 9, the heating intensity designation section 23 generates heating intensity information KRs that indicates the heating intensity required for drying the ink discharged to the regions R[1] to R[J] based on the print signal SI and the print setting information Info.

Figure 10:
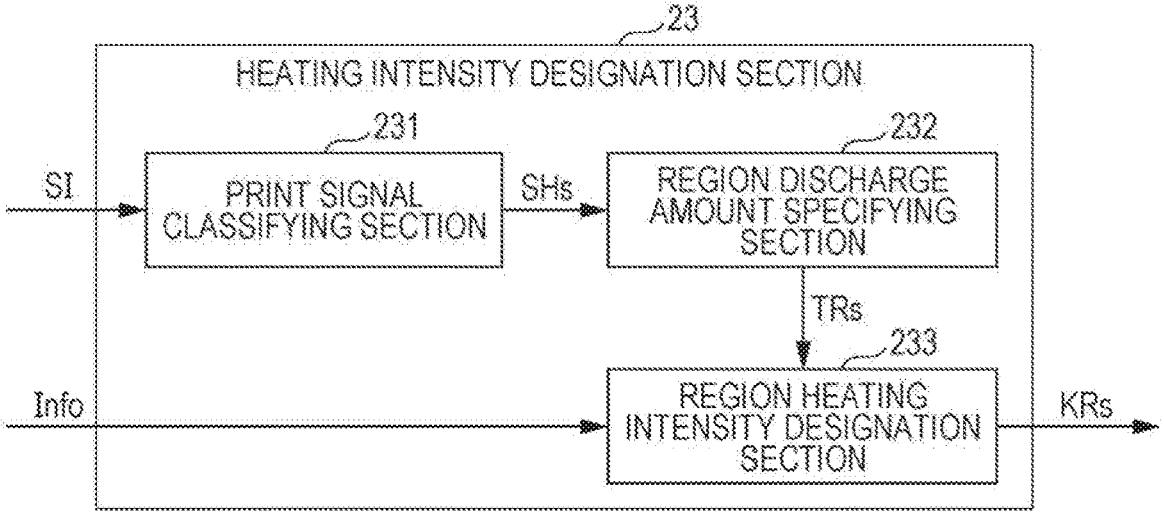
FIG. 10 is a block diagram illustrating an example of a configuration of a heating intensity designation section.

FIG. 10 is a functional block diagram illustrating an example of a configuration of the heating intensity designation section 23. In the embodiment, the heating intensity designation section 23 is a functional block that functions when the CPU provided in the control unit 2A operates according to the control program stored in the storage device 29. However, the heating intensity designation section 23 may be an electric circuit separated from the CPU provided in the control unit 2A.

As illustrated in FIG. 10, the heating intensity designation section 23 includes a print signal classifying section 231, a region discharge amount specifying section 232, and a region heating intensity designation section 233.

Among the sections, the print signal classifying section 231 generates classified print information SHs based on the print signal SI with reference to the belonging region information table TBL11. Here, the classified print information SHs includes J pieces of region print information SH[1] to SH[J] that has a one-to-one correspondence with the regions R[1] to R[J]. Among the sections, the region print information SH[j] includes one or a plurality of individual designation signals Sd[m] that correspond to one or a plurality of discharge sections D[m] positioned in the region R[j].

FIG. 11 is an explanatory diagram for describing an example of a data configuration of the belonging region information table TBL11.

As illustrated in FIG. 11, the belonging region information table TBL11 has M records that have a one-to-one correspondence with the M discharge sections D[1] to D[M]. Each record of the belonging region information table TBL11 stores therein information for identifying the discharge section D[m] and information for identifying the region R[j] where the discharge section D[m] is positioned, in association with each other.

The print signal classifying section 231 generates the classified print information SHs including region print information SH[1] to SH[J] by classifying each of the individual designation signals Sd[1] to Sd[M] included in the print signal SI into any of the region print information SH[1] to SH[J] with reference to the belonging region information table TBL11.

As illustrated in FIG. 10, the region discharge amount specifying section 232 generates discharge amount information TRs based on the classified print information SHs. Here, the discharge amount information TRs includes J pieces of region discharge amount information TR[1] to TR[J] that has a one-to-one correspondence with the regions R[1] to R[J]. Among the information, the region discharge amount information TR[j] indicates a value based on the discharge amount of ink discharged from one or the plurality of discharge sections D[m] positioned in the region R[j]. In the embodiment, as an example, a case is assumed in which the region discharge amount information TR[j] indicates a ratio of the amount of ink actually discharged from the one or the plurality of discharge sections D[m] with respect to the amount of ink discharged from the one or the plurality of discharge sections D[m] when one or all of the plurality of discharge sections D[m] positioned in the region R[j] operate as the large dot forming discharge section DP1.

As illustrated in FIG. 10, the region heating intensity designation section 233 generates the heating intensity information KRs based on the discharge amount information TRs with reference to the print mode information table TBL12 and the discharge amount information table TBL13. Here, the heating intensity information KRs includes J pieces of region heating intensity information KR[1] to KR[J] that has a one-to-one correspondence with the regions R[1] to R[J]. Among the information, the region heating intensity information KR[j] indicates the heating intensity required for drying the ink discharged to the region R[j].

FIG. 12 is an explanatory diagram for describing an example of a data configuration of the print mode information table TBL12.

As illustrated in FIG. 12, the print mode information table TBL12 includes a plurality of records that have one-to-one correspondence with a combination of a plurality of types of print modes that can be executed by the ink jet printer 1A and a plurality of types of recording media PP that can be used by the ink jet printer 1A. In the embodiment, as described above, as an example, a case is assumed in which there are three types of print modes that can be executed by the ink jet printer 1A and three types of recording media PP that can be used by the ink jet printer 1A, and thus, the print mode information table TBL12 has nine ("3×3") records.

As illustrated in FIG. 12, each record of the print mode information table TBL12 stores therein the type of the print mode that can be executed by the ink jet printer 1A, the type of the recording medium PP that can be used by the ink jet printer 1A, and a heating intensity coefficient Sk1 for indicating a value that corresponds to the heating intensity required for drying the recording medium PP to which the ink is discharged when the print processing is executed using the recording medium PP by the print mode, in association with each other.

In addition, in the embodiment, the heating intensity coefficient Sk1 is determined such that the heating intensity coefficient Sk1 becomes a larger value in the speed priority print mode than that in the normal print mode, and the heating intensity coefficient Sk1 becomes a larger value in the normal print mode than that in the image quality priority print mode. Therefore, in the embodiment, when the speed of the print processing is low and the transport speed MV of the recording medium PP is high, the ink discharged to the recording medium PP is heated more than that when the speeds are low. In other words, in the embodiment, even when the transport speed MV of the recording medium PP increases and the time for heating the ink discharged to the recording medium PP by the heating unit 5A is shortened, it becomes possible to quickly dry the ink discharged to the recording medium PP.

Further, in the embodiment, when the type of the recording medium PP is a vinyl chloride sheet, the heating intensity coefficient Sk1 becomes a larger value than that of the cardboard, and when the type of the recording medium PP is the cardboard, the heating intensity coefficient Sk1 is determined such that the heating intensity coefficient Sk1 becomes a larger value than that of the plain paper. Therefore, in the embodiment, even when the print processing is executed using the vinyl chloride sheet that does not absorb ink compared to the cardboard, it becomes possible to dry the ink discharged to the vinyl chloride sheet. Further, in the embodiment, even when the print processing is executed using the plain paper that is more likely to be damaged by the heat than the cardboard, it becomes possible to dry the ink discharged to the plain paper while reducing the damage to the plain paper due to the heat.

In the embodiment, as an example, a case is assumed in which the heating intensity coefficient Sk1 is set to any one of six values from "0" to "5" as illustrated in FIG. 12.

Figures 13, 14:
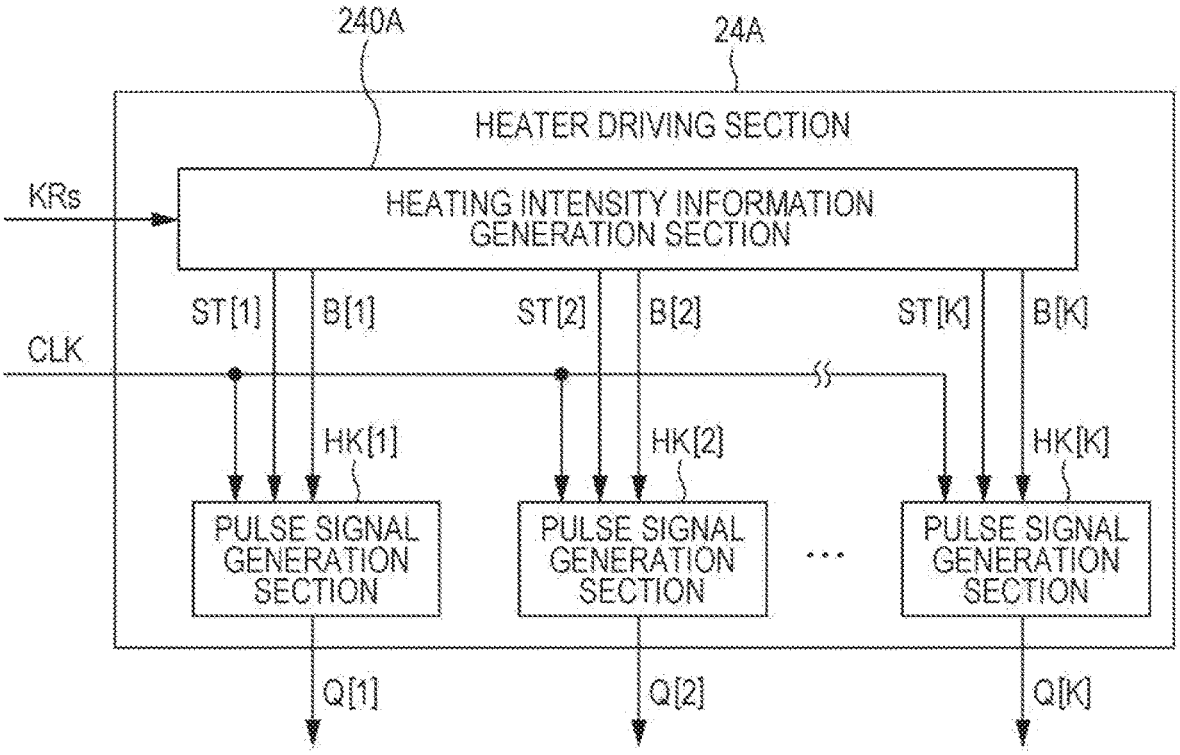
FIG. 13 is an explanatory diagram illustrating an example of a data structure of a discharge amount information table.
FIG. 14 is a block diagram illustrating an example of a configuration of a heater driving section.

FIG. 13 is an explanatory diagram for describing an example of a data configuration of the discharge amount information table TBL13.

As illustrated in FIG. 13, the discharge amount information table TBL13 stores therein a value indicated by the region discharge amount information TR[j] and the heating intensity coefficient Sk2 for indicating a value that corresponds to the heating intensity required for drying the recording medium PP to which the ink is discharged, in association with each other.

In the embodiment, the heating intensity coefficient Sk2 is determined such that the heating intensity coefficient Sk2 becomes a larger value when the value indicated by the region discharge amount information TR[j] is large compared to a case where the value is small. In other words, in the embodiment, when the discharge amount of ink with respect to the region R[j] of the recording medium PP is large, the region R[j] is heated more strongly than when the discharge amount is small. Therefore, in the embodiment, even when the discharge amount of ink with respect to the region R[j] is large, it becomes possible to reliably dry the ink discharged to the region R[j].

In the embodiment, as an example, a case is assumed in which the heating intensity coefficient Sk2 is set to any one of six values from "0" to "5" as illustrated in FIG. 13.

In the embodiment, the region heating intensity designation section 233 specifies the record in which the print mode indicated by the print mode information Mod included in the print setting information Info is recorded, that is, the record in which the type of the recording medium PP indicated by the medium type information BT included in the print setting information Info is recorded, with reference to the print mode information table TBL12, and acquires the heating intensity coefficient Sk1 stored in the specified record. In addition, the region heating intensity designation section 233 acquires the heating intensity coefficient Sk2 that corresponds to the region discharge amount information TR[j] output from the region discharge amount specifying section 232 with reference to the discharge amount information table TBL13.

Next, the region heating intensity designation section 233 generates the region heating intensity information KR[j] based on the heating intensity coefficient Sk1 acquired from the print mode information table TBL12 and the heating intensity coefficient Sk2 acquired from the discharge amount information table TBL13. Specifically, the region heating intensity designation section 233 generates the region heating intensity information KR[j] such that the region heating intensity information KR[j] becomes a larger value when the heating intensity coefficient Sk1 is a large value compared to a case where the coefficient is a small value, and the region heating intensity information KR[j] becomes a larger value when the heating intensity coefficient Sk2 is a larger value compared to a case where the coefficient is a small value. In the embodiment, as an example, a case is assumed in which the region heating intensity designation section 233 generates the region heating intensity information KR[j] by multiplying the heating intensity coefficient Sk1 by the heating intensity coefficient Sk2. In other words, in the embodiment, as an example, a case is assumed in which the region heating intensity information KR[j] is set to any one of 26 values from "0" to "25". Then, the region heating intensity designation section 233 outputs the heating intensity information KRs including the generated region heating intensity information KR[1] to KR[J].

As illustrated in FIG. 9, the heater driving section 24A generates a heating control signal Qs for controlling the heating of the recording medium PP by the heaters H[1] to H[K] based on the heating intensity information KRs.

FIG. 14 is a functional block diagram illustrating an example of a configuration of the heater driving section 24A. In the embodiment, the heater driving section 24A is a functional block that functions when the CPU provided in the control unit 2A operates according to the control program stored in the storage device 29. However, the heater driving section 24A may be an electric circuit separated from the CPU provided in the control unit 2A.

As illustrated in FIG. 14, the heater driving section 24A includes a heating intensity information generation section 240A and K pulse signal generation sections HK[1] to HK[K] that have a one-to-one correspondence with the K heaters H[1] to H[K].

Among the sections, the heating intensity information generation section 240A generates the heating intensity information Bs based on the heating intensity information KRs with reference to the heater heating intensity information table TBL14A. Here, the heating intensity information Bs includes K pieces of heater heating intensity information B[1] to B[K] that have a one-to-one correspondence with K heaters H[1] to H[K]. Among the information, the heater heating intensity information B[k] indicates the heating intensity by the heater H[k].

FIG. 15 is an explanatory diagram for describing an example of a data configuration of the heater heating intensity information table TBL14A.

As illustrated in FIG. 15, the heater heating intensity information table TBL14A has K records that have a one-to-one correspondence with the K heaters H[1] to H[K]. Each record of the heater heating intensity information table TBL14A includes information for identifying the heater H[k] and heater corresponding region heating intensity information. Here, the heater corresponding region heating intensity information is information indicating one or a plurality of pieces of region heating intensity information KR[j] which is referred to when generating the heater heating intensity information B[k].

The heating intensity information generation section 240A acquires one or a plurality of pieces of region heating intensity information KR[j] indicating the heater corresponding region heating intensity information that corresponds to the heater H[k] with reference to the heater heating intensity information table TBL14A, and generates the heater heating intensity information B[k] that corresponds to the heater H[k] based on the acquired one or the plurality of pieces of region heating intensity information KR[j].

In the embodiment, as an example, a case is assumed in which the heater corresponding region heating intensity information that corresponds to the heater H[k] indicates the region heating intensity information KR[k]. Then, in the embodiment, the heating intensity information generation section 240A generates the heater heating intensity information B[k] having a value which is the same as that of the region heating intensity information KR[k] with reference to the heater heating intensity information table TBL14A. Therefore, in the embodiment, the heating intensity information generation section 240A may generate the heater heating intensity information B[k] based on the region heating intensity information KR[k] without referring to the heater heating intensity information table TBL14A. In this case, the storage device 29 may not store the heater heating intensity information table TBL14A therein.

As illustrated in FIG. 14, the heating intensity information generation section 240A generates a heating period signal STs, for example, based on the heating intensity information KRs. Here, the heating period signal STs includes K pieces of heater heating period signals ST[1] to ST[K] that have a one-to-one correspondence with K heaters H[1] to H[K]. Among the signals, the heater heating period signal ST[k] is a signal that indicates a heating start time tst[k] at which the heater H[k] starts heating the recording medium PP, and a heating end time ted[k] at which the heater H[k] ends heating the recording medium PP.

As illustrated in FIG. 14, the pulse signal generation section HK[k] generates a pulse signal Q[k] based on the heater heating intensity information B[k], the heater heating period signal ST[k], and the clock signal CLK supplied from the print control section 21 with reference to the pulse waveform definition table TBL15. In addition, the above-described heating control signal Qs is a signal including K pulse signals Q[1] to Q[K] that have a one-to-one correspondence with the K heaters H[1] to H[K].

Figure 16:
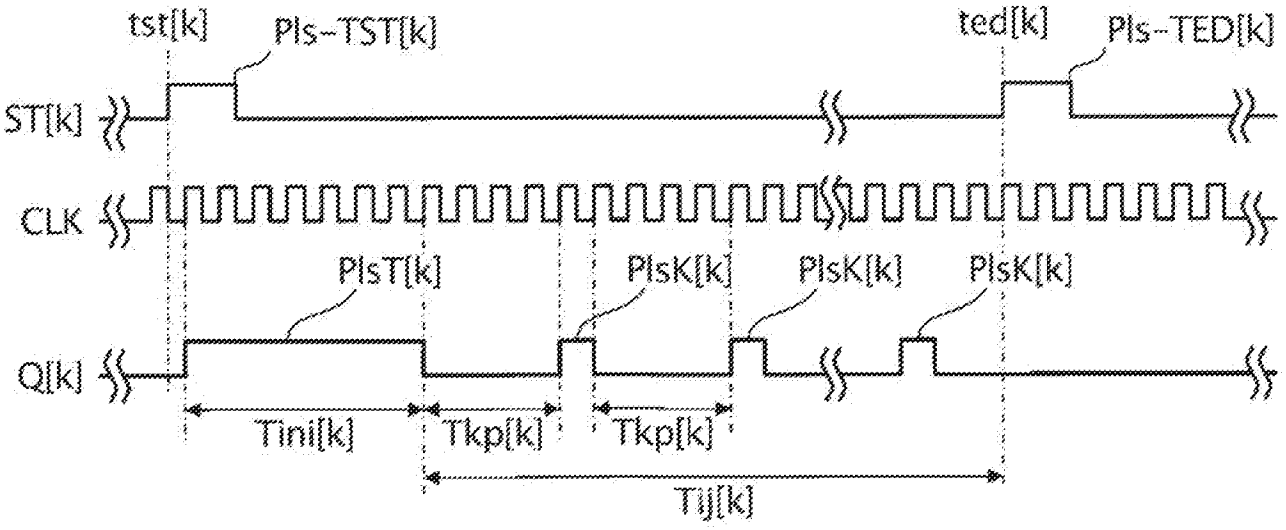
FIG. 16 is a timing chart for describing an example of a pulse signal.

FIG. 16 is a timing chart for describing an example of the pulse signal Q[k] and the heater heating period signal ST[k].

As illustrated in FIG. 16, the heater heating period signal ST[k] has a pulse PIs-TST[k] that rises from the low level to the high level at the heating start time tst[k] and falls from the high level to the low level after a certain period of time from the heating start time tst[k], and a pulse PIs-TED[k] that rises from the low level to the high level at the heating end time ted[k] and falls from the high level to the low level after a certain period of time from the heating end time ted[k].

As illustrated in FIG. 16, the pulse signal Q[k] includes an initial pulse PlsT[k]. Here, the initial pulse PlsT[k] is a waveform that rises from the low level to the high level at the time when the clock signal CLK initially rises during the period after the heating start time tst[k] at which the pulse PIs-TST[k] of the heater heating period signal ST[k] rises, and then falls from the high level to the low level at the time only after an initial heating time Tini[k] from the time at which the initial pulse PIsT[k] rises.

Although the details will be described later, the initial heating time Tini[k] is a time determined in accordance with the heater heating intensity information B[k]. More specifically, the length of the initial heating time Tini[k] is set such that the initial heating time Tini[k] is longer when the heater heating intensity information B[k] indicates a large value compared to that in a case where the information indicates a small value.

As illustrated in FIG. 16, the pulse signal Q[k] includes a plurality of maintenance pulses PlsK[k] in a temperature maintenance period Tij[k] from the end of the initial pulse PlsT[k] to the heating end time ted[k]. Here, the maintenance pulse PlsK[k] is a waveform that rises from the low level to the high level and then falls from the high level to the low level after a predetermined period of time.

In addition, in the pulse signal Q[k], a time length from the fall of the initial pulse PlsT[k] to the rise of the initial maintenance pulse PIsK[k] after the fall of the initial pulse PIsT[k] and a time length from the fall of the maintenance pulse PIsK[k] to the rise of the next maintenance pulse PIsK[k] of the maintenance pulse PIsK[k] are set to a maintenance pulse interval time Tkp[k].

Although the details will be described later, the maintenance pulse interval time Tkp[k] is a time determined in accordance with the heater heating intensity information B[k]. More specifically, the length of the maintenance pulse interval time Tkp[k] is set such that the maintenance pulse interval time Tkp[k] is shorter when the heater heating intensity information B[k] indicates a large value compared to a case where the information indicates a small value.

FIG. 17 is an explanatory diagram for describing an example of a data configuration of the pulse waveform definition table TBL15.

As illustrated in FIG. 17, the pulse waveform definition table TBL15 has a plurality of records that have a one-to-one correspondence with the plurality of values that can be taken by the heater heating intensity information B[k]. Each record of the pulse waveform definition table TBL15 stores therein the value that can be taken by the heater heating intensity information B[k], the initial heating time Tini[k], and the maintenance pulse interval time Tkp[k] in association with each other. In the embodiment, as an example, a case is assumed in which, in each record of the pulse waveform definition table TBL15, the initial heating time Tini[k] and the maintenance pulse interval time Tkp[k] are expressed by the number of cycles of the clock signal CLK.

In addition, as described above, the length of the initial heating time Tini[k] is set such that the initial heating time Tini[k] is longer when the heater heating intensity information B[k] indicates a large value compared to a case where the information indicates a small value. In the embodiment, when the heater heating intensity information B[k] indicates "0", the initial heating time Tini[k] is also set to "0". In addition, the heating intensity information generation section 240A may not output the heater heating period signal ST[k] when the heater heating intensity information B[k] indicates "0".

Further, as described above, the length of the maintenance pulse interval time Tkp[k] is set such that the maintenance pulse interval time Tkp[k] is shorter when the heater heating intensity information B[k] indicates a large value compared to a case where the information indicates a small value. In the embodiment, when the heater heating intensity information B[k] indicates "0", the maintenance pulse interval time Tkp[k] is set to be longer than a time from the heating start time tst[k] to the heating end time ted[k].

The pulse signal generation section HK[k] specifies the initial heating time Tini[k] and the maintenance pulse interval time Tkp[k] which correspond to the heater heating intensity information B[k] supplied from the heating intensity information generation section 240A with reference to the pulse waveform definition table TBL15. In addition, the pulse signal generation section HK[k] sets the time length of the initial pulse PlsT[k] to the specified initial heating time Tini[k], and the waveform of the pulse signal Q[k] in which the interval of the plurality of maintenance pulses PlsK[k] becomes the specified initial heating time Tini[k] is determined. Then, the pulse signal generation section HK[k] starts the output of the pulse signal Q[k] at a time that corresponds to the rise of the pulse Pls-TST[k] of the heater heating period signal ST[k], and ends the output of the pulse signal Q[k] at a time that corresponds to the rise of the pulse Pls-ted[k] of the heater heating period signal ST[k].

1.5. Operation of Heater H[k]

Next, the operation of the heater H[k] according to the embodiment will be described with reference to FIGS. 18 and 19.

Figure 18:
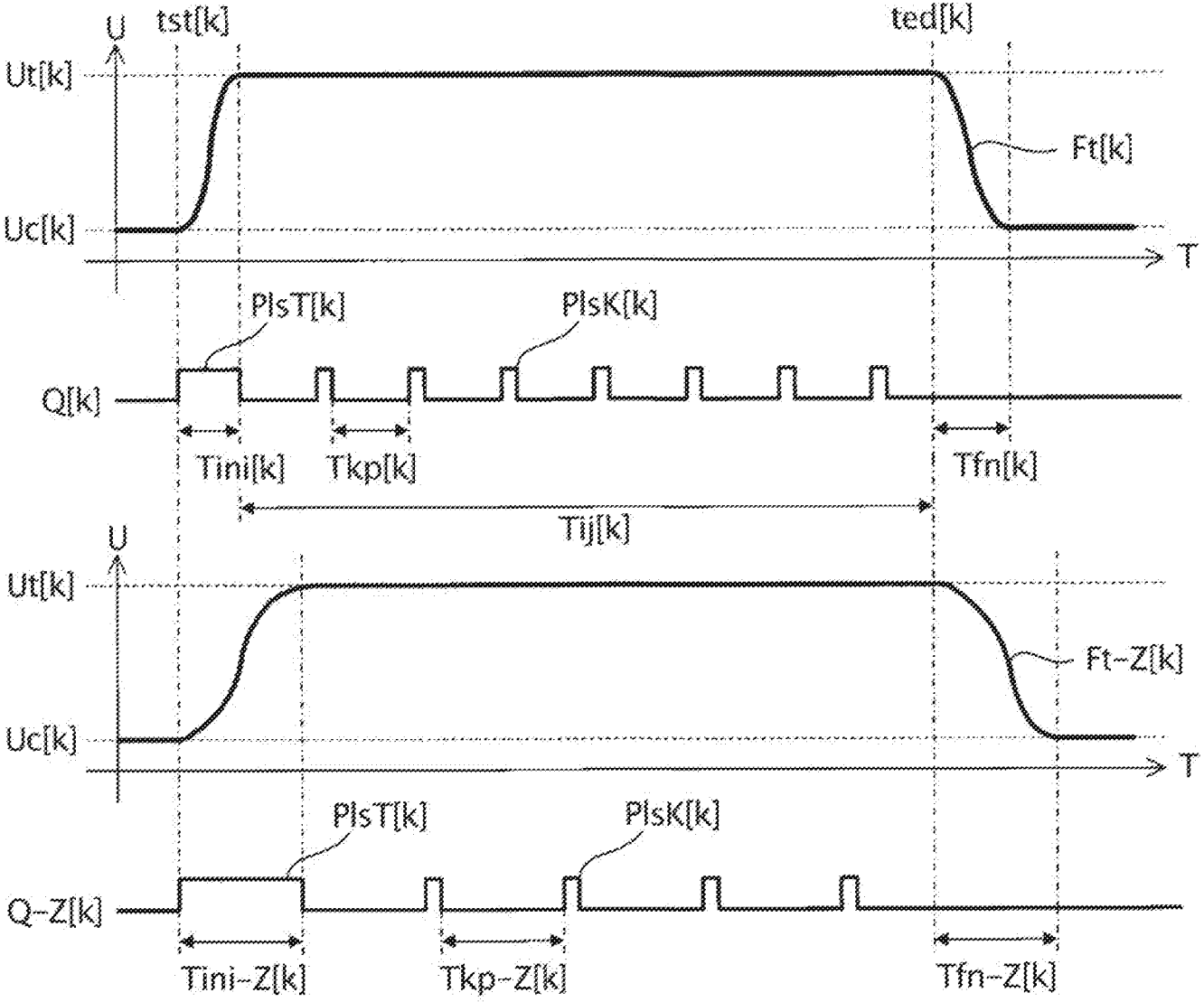
FIG. 18 is an explanatory diagram illustrating an example of an operation of the heater.

FIG. 18 is a view illustrating a change in temperature Ft[k] of the heater H[k] when the pulse signal Q[k] is supplied to the heater H[k]. In FIG. 18, for reference, a change in temperature Ft-Z[k] of a far infrared quartz glass heater when a pulse signal Q-Z[k] is supplied to a far infrared quartz glass heater of the related art will also be written.

The heater H[k] generates heat in accordance with the signal level of the pulse signal Q[k]. Specifically, when the pulse signal Q[k] is at a high level, the heater H[k] is supplied with electric power from a power supply circuit (not illustrated), a current flows through the heat generating resistor 510, and the heat generating resistor 510 generates heat. Therefore, the heater H[k] generates heat in the initial heating time Tini[k] in which the initial pulse PlsT[k] is set for the pulse signal Q[k], and raises the temperature from a steady temperature Uc[k] to a heating temperature Ut[k]. Then, the heater H[k] maintains the heating temperature Ut[k] in the temperature maintenance period Tij[k] after the initial heating time Tini[k]. As described above, the initial heating time Tini[k] is determined as the time length that corresponds to the heating intensity indicated by the heater heating intensity information B[k]. In other words, the heating temperature Ut[k] is a temperature that corresponds to the heating intensity indicated by the heater heating intensity information B[k].

In the embodiment, as described above, the heater H[k] includes the ceramic substrate 500. Accordingly, in the embodiment, when the supply of the pulse signal Q[k] to the heater H[k] is started, the initial heating time Tini[k] required for raising the temperature of the heater H[k] from the steady temperature Uc[k] to the heating temperature Ut[k] can become shorter than an initial heating time Tini- Z[k] required for raising the temperature of the far infrared quartz glass heater from the steady temperature Uc[k] to the heating temperature Ut[k].

Therefore, in the embodiment, the print processing can be started more quickly than in the far infrared quartz glass heater of the related art. Accordingly, in the embodiment, even when the printing is executed at a high speed as in the speed priority print mode, it becomes possible to prevent the delay of the start of the print processing due to the delay in the temperature rise of the heater H[k].

In the embodiment, when the supply of the pulse signal Q[k] to the heater H[k] is stopped, a temperature drop time Tfn[k] required for dropping the temperature of the heater H[k] from the heating temperature Ut[k] to the steady temperature Uc[k] can become shorter than a temperature drop time Tfn-Z[k] required for dropping the temperature of the far infrared quartz glass heater from the heating temperature Ut[k] to the steady temperature Uc[k].

Therefore, in the embodiment, compared to the far infrared quartz glass heater of the related art, it is possible to suppress the application of extra heat to the recording medium PP which has become unnecessary due to the end of the print processing or the like. Accordingly, in the embodiment, it becomes possible to reduce the damage to the recording medium PP due to the heating of the recording medium PP in the print processing.

Figure 19:
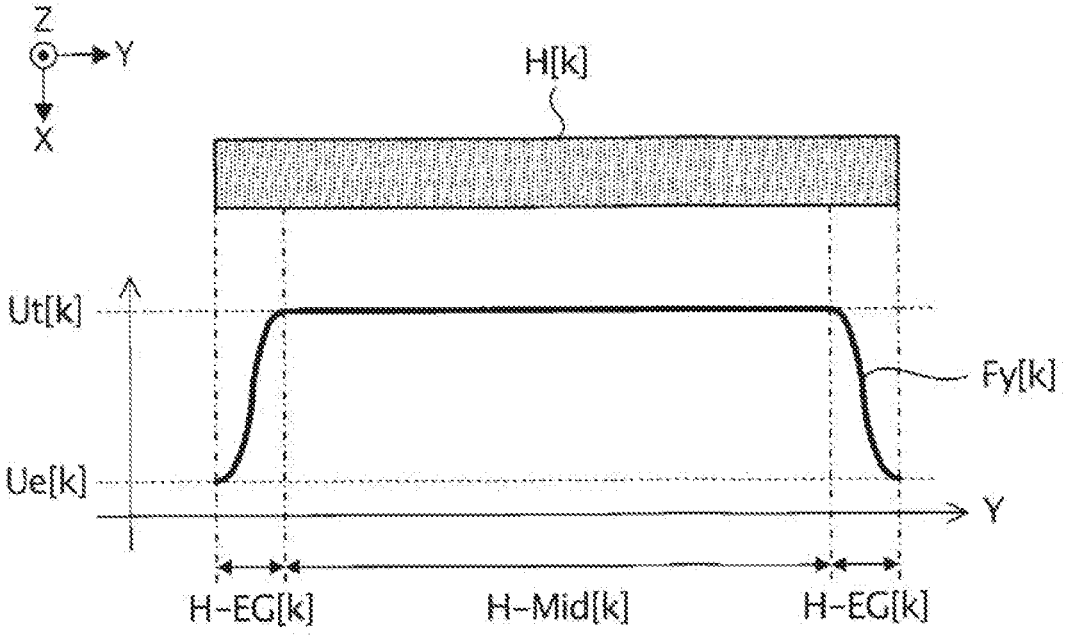
FIG. 19 is an explanatory diagram illustrating an example of a temperature distribution in the heater.

FIG. 19 is a view illustrating a temperature distribution Fy[k] at each place of the heaters H[k] in the Y axis direction in which the heater H[k] extends at the timing when the energization to the heater H[k] in the initial heating time Tini[k] is completed and the temperature of the heater H[k] rises.

As illustrated in FIG. 19, in the temperature maintenance period Tij[k], the temperature of a center portion H-Mid[k] in the extending direction of the heater H[k] rises to the heating temperature Ut[k], but the temperature of the end portion H-EG[k] in the extending direction of the heater H[k] remains at an end portion temperature Ue[k] lower than the heating temperature Ut[k].

However, in the embodiment, for convenience of description, a case is assumed in which the end portion H-EG[k] is sufficiently narrow to be negligible. In other words, in the embodiment, in the temperature maintenance period Tij[k], it is considered that the heater H[k] can heat the recording medium PP at the heating temperature Ut[k] over the region RH[k] which is the range where the heater H[k] extend in the Y axis direction.

In the embodiment, when the value of the heater heating intensity information B[k] is equal to or larger than "1" and the recording medium PP is heated by the heater H[k], the heating temperature Ut[k] of the heater H[k] is determined so as to become a temperature range of 100 degrees or higher and 250 degrees or lower. In the embodiment, by setting the heating temperature Ut[k] to 100 degrees or higher, it becomes possible to evaporate the water content of the ink discharged to the recording medium PP. Further, in the embodiment, by setting the heating temperature Ut[k] to 250 degrees or lower, even when the recording medium PP such as plain paper that is weak to the damage due to heat is used as the recording medium PP, it becomes possible to prevent the recording medium PP from being damaged by heat.

1.6. Summary of First Embodiment

As described above, the ink jet printer 1A according to the embodiment includes: the transport unit 4 that transports the recording medium PP in the +X direction; the discharge section D that discharges ink to the recording medium PP transported by the transport unit 4; and the heater H[k] that is provided on the +X side of the discharge section D and heats the recording medium PP, and the heater H[k] includes the ceramic substrate 500, the heat generating resistor 510 provided on the ceramic substrate 500, and the protection section 520 that protects the heat generating resistor 510. In other words, the ink jet printer 1A according to the embodiment includes the heater H[k] including the ceramic substrate 500.

Therefore, according to the embodiment, for example, the heating speed of the heater H[k] and the cooling speed of the heater H[k] can become higher than those in a case of the quartz glass heater using a quartz glass substrate instead of the ceramic substrate 500.

Further, in the ink jet printer 1A according to the embodiment, the heat generating resistor 510 is formed of a non-metal.

Therefore, in the embodiment, it becomes possible to suppress corrosion of the heat generating resistor 510 due to the ink, for example, compared to a case where a metal resistor is adopted as the heat generating resistor 510.

Further, in the ink jet printer 1A according to the embodiment, a carbon wire is adopted as the heat generating resistor 510.

Therefore, in the embodiment, it becomes possible to suppress corrosion of the heat generating resistor 510 due to the ink, for example, compared to a case where a metal resistor is adopted as the heat generating resistor 510.

Further, in the ink jet printer 1A according to the embodiment, the protection section 520 is formed of glass.

Therefore, according to the embodiment, it becomes possible to suppress corrosion of the protection section 520 due to the ink, for example, compared to a case where the protection section 520 is formed of an organic material.

Further, in the ink jet printer 1A according to the embodiment, as the ink discharged from the discharge section D, a reactive ink having higher reactivity with respect to metal than that of the aqueous ink may be adopted. In this case, in the ink jet printer 1A, it is preferable that the heat generating resistor 510 is formed of a non-metal and the protection section 520 be formed of glass.

In the embodiment, when the heat generating resistor 510 is formed of a non-metal and the protection section 520 is formed of glass, it becomes possible to suppress corrosion of the heat generating resistor 510 and the protection section 520 due to ink compared to an aspect in which the heat generating resistor 510 is formed of a metal and an aspect in which the protection section 520 is formed of an organic material.

Further, in the ink jet printer 1A according to the embodiment, the heater H[k] heats the recording medium PP at a temperature of 100 degrees or higher and 250 degrees or lower.

In this manner, according to the embodiment, since the recording medium PP is heated by the heater H[k] at 100 degrees or higher, it becomes possible to evaporate the water content of the ink discharged to the recording medium PP. Further, in the embodiment, since the recording medium PP is heated by the heater H[k] at 250 degrees or lower, it becomes possible to prevent the recording medium PP from being damaged by heat.

Further, in the ink jet printer 1A according to the embodiment, the heater H[k] heats the recording medium PP at the temperature that corresponds to the type of the recording medium PP.

Therefore, according to the embodiment, it becomes possible to finely perform control in accordance with the type of the recording medium PP to reliably dry the ink discharged to the recording medium PP and to reduce the damage by the heat with respect to the recording medium PP when drying the ink discharged to the recording medium PP.

In the embodiment, the control unit 2A adjusts the length of the initial heating time Tini[k] based on the heater heating intensity information B[k]. Furthermore, in the embodiment, the control unit 2A adjusts the interval of the maintenance pulse PlsK[k] provided in the temperature maintenance period Tij[k] based on the heater heating intensity information B[k] In other words, the ink jet printer 1A according to the embodiment includes: the transport unit 4 that transports the recording medium PP in the +X direction; the discharge section D that discharges ink to the recording medium PP transported by the transport unit 4; the control unit 2A that outputs the pulse signal Q[k] having the pulse waveform; and the heating unit 5A that includes the heater H[k] provided on the +X side of the discharge section D for generating heat in accordance with the signal level of the pulse signal Q[k], and heats the recording medium PP, and the control unit 2A adjusts a pulse width of the pulse waveform of the pulse signal Q[k] or a pulse density of the pulse waveform of the pulse signal Q[k] when the pulse signal Q[k] is supplied to the heater H[k]. In other words, the control unit 2A adjusts the temperature of the heater H[k] by performing control of a pulse width modulation method for adjusting the pulse width of the pulse signal Q[k] or control of a pulse density modulation method for adjusting the pulse density of the pulse signal Q[k].

In this manner, according to the embodiment, in order to drive the heater H[k] in accordance with the signal level of the pulse signal Q[k] having the pulse waveform, the electric power is supplied to the heater H[k] only during a part of the period in the period in which the heater H[k] heats the recording medium PP. Therefore, according to the embodiment, for example, compared to an aspect in which the electric power is supplied to the heater H[k] over the period in which the heater H[k] heats the recording medium PP, it becomes possible to reduce the power consumption.

Further, according to the embodiment, by adjusting the initial heating time Tini[k] and the maintenance pulse interval time Tkp[k] for defining the waveform of the pulse signal Q[k], the temperature of the heater H[k] is maintained at the heating temperature Ut[k]. Therefore, according to the embodiment, for example, it becomes possible to simplify the control of the heater H[k] compared to an aspect in which the magnitude of the electric power supplied to the heater H[k] is adjusted in real time such that the temperature of the heater H[k] is maintained at the heating temperature Ut[k].

Further, in the embodiment, in the ink jet printer 1A according to the modification example, the heaters H[1] to H[K] are disposed such that the range where the heaters H[1] to H[K] exist in the Y axis direction include the range YPP.

Therefore, the heating unit 5A according to the embodiment can dry the ink discharged to any place on the recording medium PP.

In the embodiment, the control unit 2A controls the K heaters H[1] to H[K] independently from each other by the K pulse signals Q[1] to Q[K]. In other words, in the embodiment, the control unit 2A individually controls one heater H and another heater H among the K heaters H[1] to H[K] by different pulse signals Q.

Therefore, in the embodiment, it becomes possible to heat the recording medium PP at the individual heating intensity for each of the regions RH[1] to RH[K]. Accordingly, according to the embodiment, it becomes possible both to reliably dry the ink discharged to the recording medium PP and to reduce the damage to the recording medium PP due to the heat when drying the ink discharged to the recording medium PP.

Further, in the embodiment, the control unit 2A controls the heaters H[1] to H[K] by using pulse signals Q[1] to Q[K] generated based on the print signal SI.

Therefore, in the embodiment, in the print processing, the recording medium PP can be dried in accordance with the image formed on the recording medium PP.

In the embodiment, the transport unit 4 is an example of a "transport section", the +X direction is an example of a "first direction", the +X side is an example of "downstream in the first direction", the control unit 2A is an example of a "signal generation section", the pulse signal Q[k] is an example of a "first pulse signal", the initial pulse PlsT[k] and the maintenance pulse PlsK[k] included in the pulse signal Q[k] are examples of a "first pulse", the heater H[k] is an example of a "first heater", and the heating unit 5A is an example of a "heating section".

1.7. Modification Example of First Embodiment

The embodiment can be modified in various manners. Specific modifications will be described below. Two or more aspects selected in any manner from the following examples can be appropriately combined with each other within a range not inconsistent with each other. In addition, in the modification examples illustrated below, elements having the same effects and functions as those of the embodiment will be given the reference numerals used in the description above, and the detailed description thereof will be appropriately omitted.

Modification Example 1.1

In the above-described embodiment, the pulse signal generation sections HK[1] to HK[K] generate the pulse signals Q[1] to Q[K] based on the single clock signal CLK, but the disclosure is not limited to such an aspect. Among the pulse signal generation sections HK[1] to HK[K], one pulse signal generation section HK and another pulse signal generation section HK may generate the pulse signals Q based on the clock signals CLK different from each other.

Figure 20:
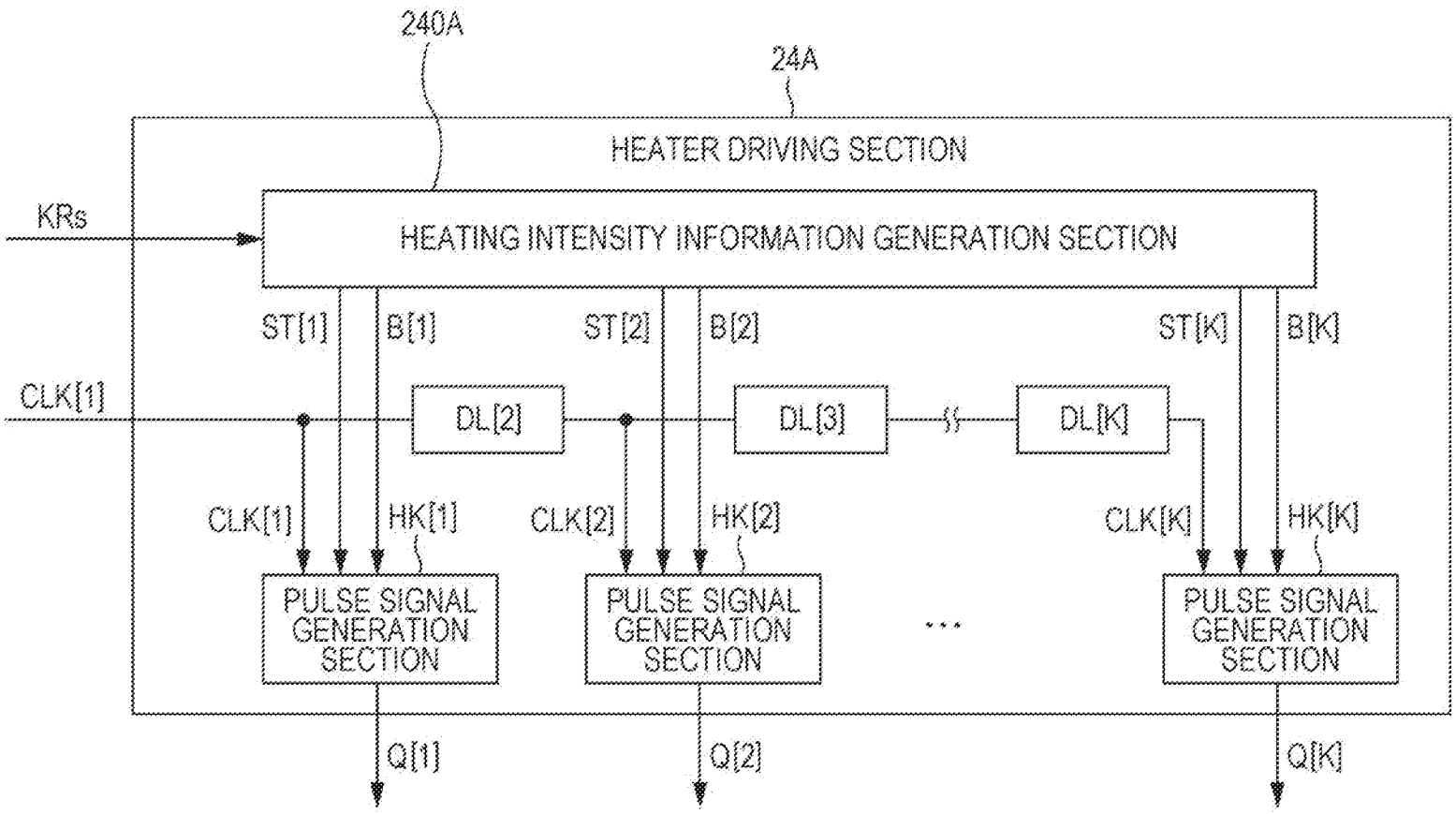
FIG. 20 is a block diagram illustrating an example of a configuration of a heater driving section according to Modification Example 1.1.

FIG. 20 is a functional block diagram illustrating an example of a configuration of the heater driving section 24A according to the modification example.

As illustrated in FIG. 20, in the modification example, a clock signal CLK[1] is supplied to the heater driving section 24A. The heater driving section 24A includes (K−1) delay sections DL[2] to DL[k] which have one-to-one correspondence with the (K−1) pulse signal generation sections HK[2] to HK[K]. The delay section DL[k] generates the clock signal CLK[k] by delaying the phase of the clock signal CLK[k−1]. The pulse signal generation section HK[k] generates the pulse signal Q[k] based on the heater heating intensity information B[k], the heater heating period signal ST[k], and the clock signal CLK[k].

Figure 21:
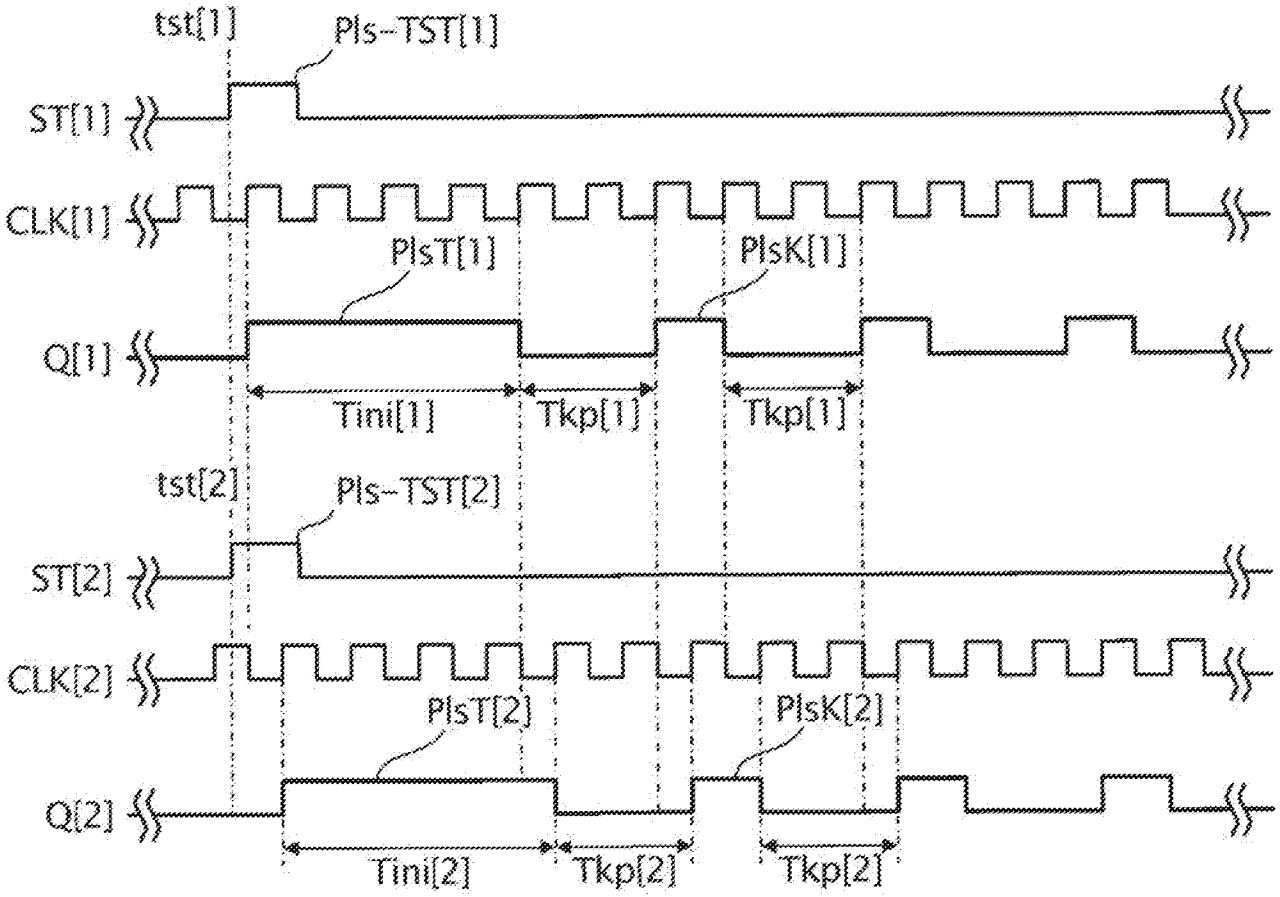
FIG. 21 is a timing chart for describing an example of a pulse signal according to Modification Example 1.1.

FIG. 21 is a timing chart for describing an example of the clock signal CLK[k], the heater heating period signal ST[k], and the pulse signal Q[k] according to the modification example. FIG. 21 illustrates the pulse signal Q[1] and the pulse signal Q[2] among the pulse signals Q[1] to Q[K]. In FIG. 21, as an example, a case is assumed in which the heating start time tst[1] and the heating start time tst[2] are the same time.

As illustrated in FIG. 21, the initial pulse PlsT[1] of the pulse signal Q[1] rises from the low level to the high level at the time at which the clock signal CLK[1] initially rises during the period after the heating start time tst[1] at which the pulse PIs-TST[1] of the heater heating period signal ST[1] rises. On the other hand, the initial pulse PlsT[2] of the pulse signal Q[2] rises from the low level to the high level at the time at which the clock signal CLK[2] initially rises during the period after the heating start time tst[2] at which the pulse PIs-TST[2] of the heater heating period signal ST[2] rises. In the modification example, the timing of the rising of the clock signal CLK[1] is different from the timing of the rising of the clock signal CLK[2]. Therefore, in the modification example, even when the heating start time tst[1] and the heating start time tst[2] are the same time, the rising of the initial pulse PlsT[1] and the rising of the initial pulse PlsT[2] can be different times.

In general, when the heat generating resistor 510 included in the heater H[k] changes from a non-energized state to an energized state, a case is considered in which a large current flows through the heat generating resistor 510 as an inrush current. Therefore, among the heaters H[1] to H[K], it is preferable that the timing at which the heat generating resistor 510 included in one heater H is changed from the non-energized state to the energized state, and the timing at which heat generating resistor 510 included in another heater H is changed from the non-energized state to the energized state are different from each other. On the other hand, in the modification example, as illustrated in FIG. 21, the phase of one clock signal CLK supplied to one pulse signal generation section HK and the phase of another clock signal CLK supplied to another pulse signal generation section HK are different from each other. Therefore, in the modification example, it is possible to prevent a situation in which a large current needs to be supplied to the heating unit 5A due to the plurality of heaters H starting heating at the same time. Accordingly, in the modification example, the scale of the power supply circuit that supplies electric power to the heating unit 5A can be reduced.

In the modification example, the initial pulses PlsT[1] to PlsT[K] are prevented from starting at the same timing by preventing the clock signals CLK[1] to CLK[K] from having the same phase, but the disclosure is not limited to such an aspect. For example, by preventing the output timings of the heater heating period signals ST[1] to ST[K] from becoming the same timing, the initial pulses PlsT[1] to PlsT[K] may be prevented from being started at the same timing. Specifically, the heating intensity information generation section 240A may generate the heater heating period signal ST[k+1] by delaying the heater heating period signal ST[k], for example. In this case, since the initial pulse PlsT[k+1] is started at a timing later than the timing at which the initial pulse PlsT[k] is started, the plurality of heaters H can be prevented from starting heating at the same time.

As described above, the control unit 2A according to the modification example outputs the pulse signal Q[1] having a pulse waveform and the pulse signal Q[2] having a pulse waveform different from that of the pulse signal Q[1]. Further, the heating unit 5A according to the modification example includes the heater H[1] that generates heat in accordance with the signal level of the pulse signal Q[1] and the heater H[2] that generates heat in accordance with the signal level of the pulse signal Q[2].

Therefore, according to the modification example, it becomes possible to prevent the plurality of heaters H from starting heating at the same time, and to suppress the scale of the power supply circuit that supplies electric power to the heating unit 5A to be small.

Further, the control unit 2A according to the modification example generates the pulse signal Q[1] based on the clock signal CLK[1], and generates the pulse signal Q[2] based on the clock signal CLK[2].

Therefore, according to the modification example, it becomes possible to prevent the plurality of heaters H from starting heating at the same time.

Further, the control unit 2A according to the modification example includes the delay section DL[k] that generates the clock signal CLK[k] by delaying the phase of the clock signal CLK[k−1].

Therefore, according to the modification example, it becomes possible to prevent the plurality of heaters H from starting heating at the same time.

Further, in the control unit 2A according to the modification example, the timing of the rising of the waveform of the clock signal CLK[1] is different from the timing of the rising of the waveform of the clock signal CLK[2].

Therefore, according to the modification example, it becomes possible to prevent the plurality of heaters H from starting heating at the same time.

In the modification example, the transport unit 4 is an example of a "transport section", the +X direction is an example of a "first direction", the +X side is an example of "downstream in the first direction", the control unit 2A is an example of a "signal generation section", the heating unit 5A is an example of a "heating section", the heater H[1] is an example of a "first heater", the heater H[2] is an example of a "second heater", the pulse signal Q[1] is an example of a "first pulse signal", the pulse signal Q[2] is an example of a "second pulse signal", the initial pulse PIsT[1] and the maintenance pulse PIsK[1] included in the pulse signal Q[1] are examples of a "first pulse", the initial pulse PIsT[2] and the maintenance pulse PIsK[2] included in the pulse signal Q[2] are examples of a "second pulse", the clock signal CLK[1] is an example of a "first clock signal", and the clock signal CLK[2] is an example of a "second clock signal".

Modification Example 1.2

In the above-described embodiment and the modification example, the pulse signal generation section HK[k] maintains the signal level of the pulse signal Q[k] at the high level in the initial heating time Tini[k], but the disclosure is not limited to such an aspect. The pulse signal generation section HK[k] may generate the pulse signal Q[k] by adjusting the pulse density of the pulse signal Q[k] in accordance with the heater heating intensity information B[k].

Figure 22:
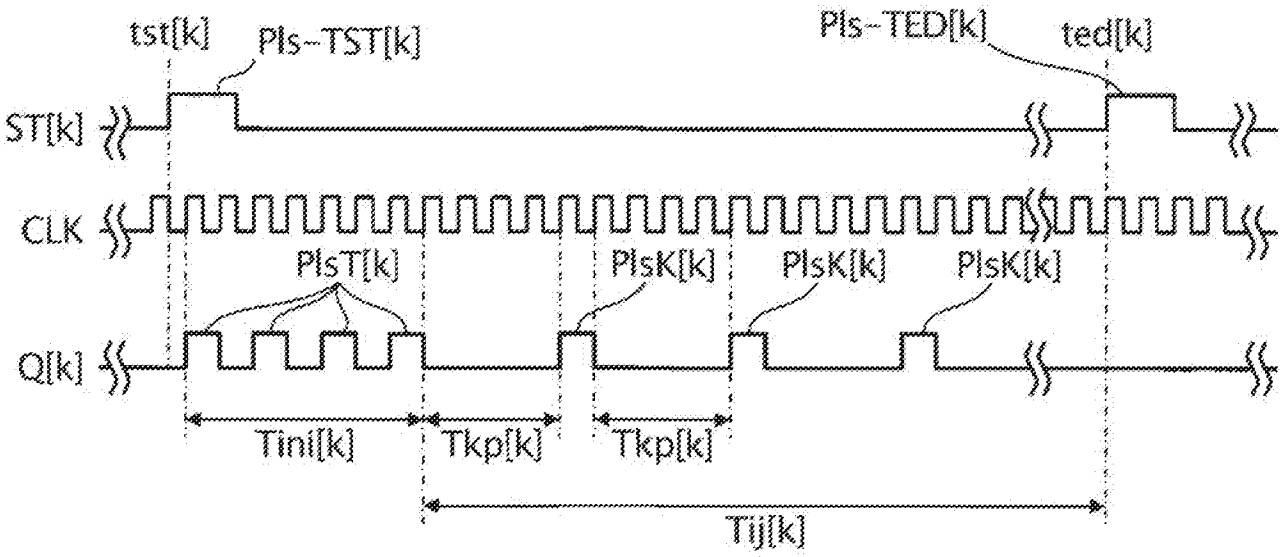
FIG. 22 is a timing chart for describing an example of a pulse signal according to Modification Example 1.2.

FIG. 22 is a timing chart for describing an example of the pulse signal Q[k] according to the modification example.

As illustrated in FIG. 22, the pulse signal Q[k] according to the modification example is provided with the plurality of initial pulses PlsT[k] in the initial heating time Tini[k]. In the modification example, the initial pulse PlsT[k] is a waveform that rises from the low level to the high level and then falls from the high level to the low level after a predetermined period of time.

In the modification example, the pulse signal generation section HK[k] determines at least one of the time length of the initial heating time Tini[k] and the density of the plurality of initial pulses PIsT[k] provided in the initial heating time Tini[k], based on the heater heating intensity information B[k]. For example, the pulse signal generation section HK[k] may determine the waveform of the pulse signal Q[k] such that the initial heating time Tini[k] becomes longer when the heater heating intensity information B[k] indicates a large value compared to a case where the information indicates a small value. In addition, the pulse signal generation section HK[k] may determine the waveform of the pulse signal Q[k] such that the density of the plurality of initial pulses PIsT[k] provided in the initial heating time Tini[k] becomes higher when the heater heating intensity information B[k] indicates a large value compared to a case where the information indicates a small value.

In the modification example, since at least one of the time length of the initial heating time Tini[k] and the density of the plurality of initial pulses PIsT[k] provided in the initial heating time Tini[k] is adjusted based on the heater heating intensity information B[k], it becomes possible to set the heating temperature Ut[k] of the heater H[k] to a temperature that corresponds to the heater heating intensity information B[k].

As described above, the ink jet printer 1A according to the modification example includes: the transport unit 4 that transports the recording medium PP in the +X direction; the discharge section D that discharges ink to the recording medium PP transported by the transport unit 4; the control unit 2A that outputs the pulse signal Q[k] having the pulse waveform; and the heating unit 5A that includes the heater H[k] provided on the +X side of the discharge section D for generating heat in accordance with the signal level of the pulse signal Q[k], and heats the recording medium PP, and the control unit 2A adjusts a pulse density of the pulse waveform of the pulse signal Q[k] when the pulse signal Q[k] is supplied to the heater H[k].

In this manner, according to the modification example, in order to drive the heater H[k] in accordance with the signal level of the pulse signal Q[k] having the pulse waveform, the electric power is supplied to the heater H[k] only during a part of the period in the period in which the heater H[k] heats the recording medium PP. Therefore, according to the modification example, for example, compared to an aspect in which the electric power is supplied to the heater H[k] over the period in which the heater H[k] heats the recording medium PP, it becomes possible to reduce the power consumption.

Modification Example 1.3

In the above-described embodiments and modification examples, the region discharge amount specifying section 232 generates the region discharge amount information TR[j] based on the amount of ink discharged from one or the plurality of discharge sections D positioned in the region R[j], but the disclosure is not limited to such an aspect.

For example, the region discharge amount specifying section 232 may generate the region discharge amount information TR[j] based on the degree of the number of specific discharge sections in one or the plurality of discharge sections D positioned in the region R[j]. Specifically, the region discharge amount specifying section 232 may generate the region discharge amount information TR[j] based on the ratio occupied by the specific discharge sections in one or the plurality of discharge sections D positioned in the region R[j].

In this case, the region discharge amount specifying section 232 may set the region discharge amount information TR[j] to "0" when the specific discharge section does not exist in one or the plurality of discharge sections D positioned in the region R[j]. In the modification example, when the region discharge amount information TR[j] is "0", the region heating intensity information KR[j] and the heater heating intensity information B[j] are both "0", and thus, the recording medium PP is not heated by the heater H[j].

In other words, in the modification example, the control unit 2A designates one or the plurality of specific discharge sections that discharge the liquid from the discharge sections D[1] to D[M], heats the recording medium PP by the heater H[k] that overlaps the specific discharge section in the +X direction among the heaters H[1] to H[K], and restricts the heating of the recording medium PP by the heater H[k] that does not overlap the specific discharge section in the +X direction among the heaters H[1] to H[K].

In this manner, according to the modification example, in order to heat the recording medium PP by the heater H[k] positioned at a place that corresponds to the specific discharge section among the heaters H[1] to H[K], compared to an aspect in which the recording medium PP is heated using all of the heaters H[1] to H[K], it becomes possible to reduce the power consumption of the heating unit 5A, and to reduce the damage to the recording medium PP.

In addition, for example, the region discharge amount specifying section 232 may generate the region discharge amount information TR[j] based on the degree of the number of second specific discharge sections in one or the plurality of discharge sections D positioned in the region R[j]. Specifically, the region discharge amount specifying section 232 may generate the region discharge amount information TR[j] based on the ratio occupied by the second specific discharge sections in one or the plurality of discharge sections D positioned in the region R[j]. In this case, the region discharge amount specifying section 232 may set the region discharge amount information TR[j] to "0" when the second specific discharge section does not exist in one or the plurality of discharge sections D positioned in the region R[j].

In other words, in the modification example, the control unit 2A designates one or the plurality of second specific discharge sections that discharge the liquid from the discharge sections D[1] to D[M], heats the recording medium PP by the heater H[k] that overlaps the second specific discharge section in the +X direction among the heaters H[1] to H[K], and restricts the heating of the recording medium PP by the heater H[k] that does not overlap the second specific discharge section in the +X direction among the heaters H[1] to H[K].

In this manner, according to the modification example, in order to heat the recording medium PP by the heater H[k] positioned at a place that corresponds to the second specific discharge section among the heaters H[1] to H[K], compared to an aspect in which the recording medium PP is heated using all of the heaters H[1] to H[K], it becomes possible to reduce the power consumption of the heating unit 5A, and to reduce the damage to the recording medium PP.

Modification Example 1.4

In the above-described embodiments and the modification examples, the heating intensity designation section 23 may generate the region heating intensity information KR[j] in accordance with the color of the ink discharged to the region R[j].

In other words, in the ink jet printer 1A according to the modification example, the heater H[k] may heat the recording medium PP at the temperature that corresponds to the type of the liquid discharged to the recording medium PP.

For example, the heating intensity designation section 23 may generate the region heating intensity information KR[j] such that the value indicated by the region heating intensity information KR[j] becomes larger when the ratio occupied by cyan or magenta ink among the inks discharged to the region R[j] is large compared to a case where the ratio is small.

In general, cyan and magenta inks have a higher degree of image quality deterioration due to color mixing than that of black and yellow inks. On the other hand, in the modification example, since the cyan and magenta inks can be mainly dried, it becomes possible to suppress the deterioration of the image quality due to color mixing of the cyan and magenta inks.

Modification Example 1.5

In the above-described embodiment and the modification example, a case is assumed in which the end portion H-EG[k] of the heater H[k] is sufficiently narrow to be negligible, but the disclosure is not limited to such an aspect.

For example, when the end portion H-EG[k] of the heater H[k] has a size that is non-negligible, the heater H[k] may be disposed so as to heat the region R[j] of the recording medium PP from the center portion H-Mid[k] in heater H[k]. In other words, when the end portion H-EG[k] of the heater H[k] has a size that is non-negligible, the heater H[k] may be disposed such that the region RH[k] where the heater H[k] exists in the Y axis direction becomes wider than the region R[j] of the recording medium PP to be heated by the heater H[k].

2. Second Embodiment

Hereinafter, an ink jet printer 1B according to the embodiment will be described with reference to FIGS. 23 to 27. The ink jet printer 1B according to the embodiment heats the same place of the recording medium PP using the end portion H-EG of one heater H and the end portion H-EG of the other heater H from the two heaters H adjacent to each other.

2.1. Ink Jet Printer According to Second Embodiment

Figure 23:
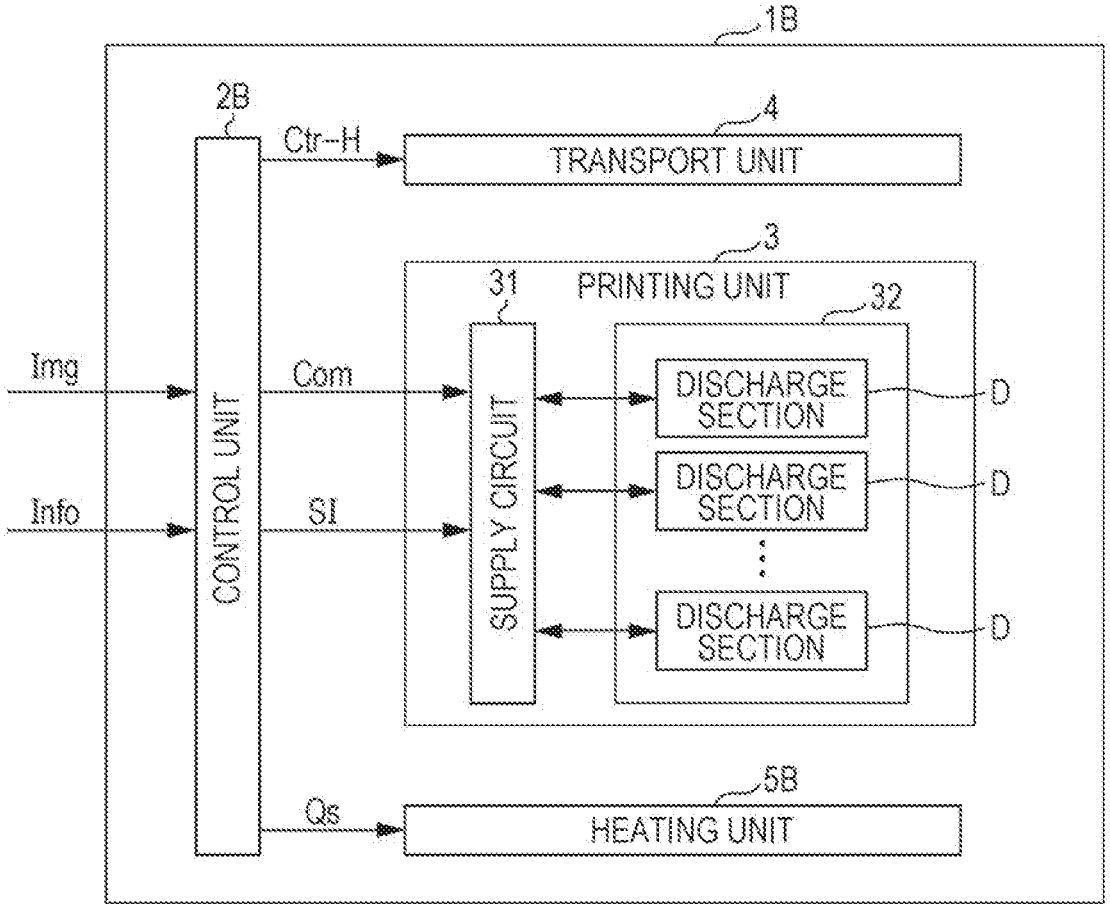
FIG. 23 is a block diagram illustrating an example of a configuration of an ink jet printer according to a second embodiment of the disclosure.

FIG. 23 is a functional block diagram illustrating an example of a configuration of the ink jet printer 1B.

As illustrated in FIG. 23, the ink jet printer 1B has the same configuration as that of the ink jet printer 1A except that a control unit 2B is provided instead of the control unit 2A and a heating unit 5B is provided instead of the heating unit 5A.

Figure 24:
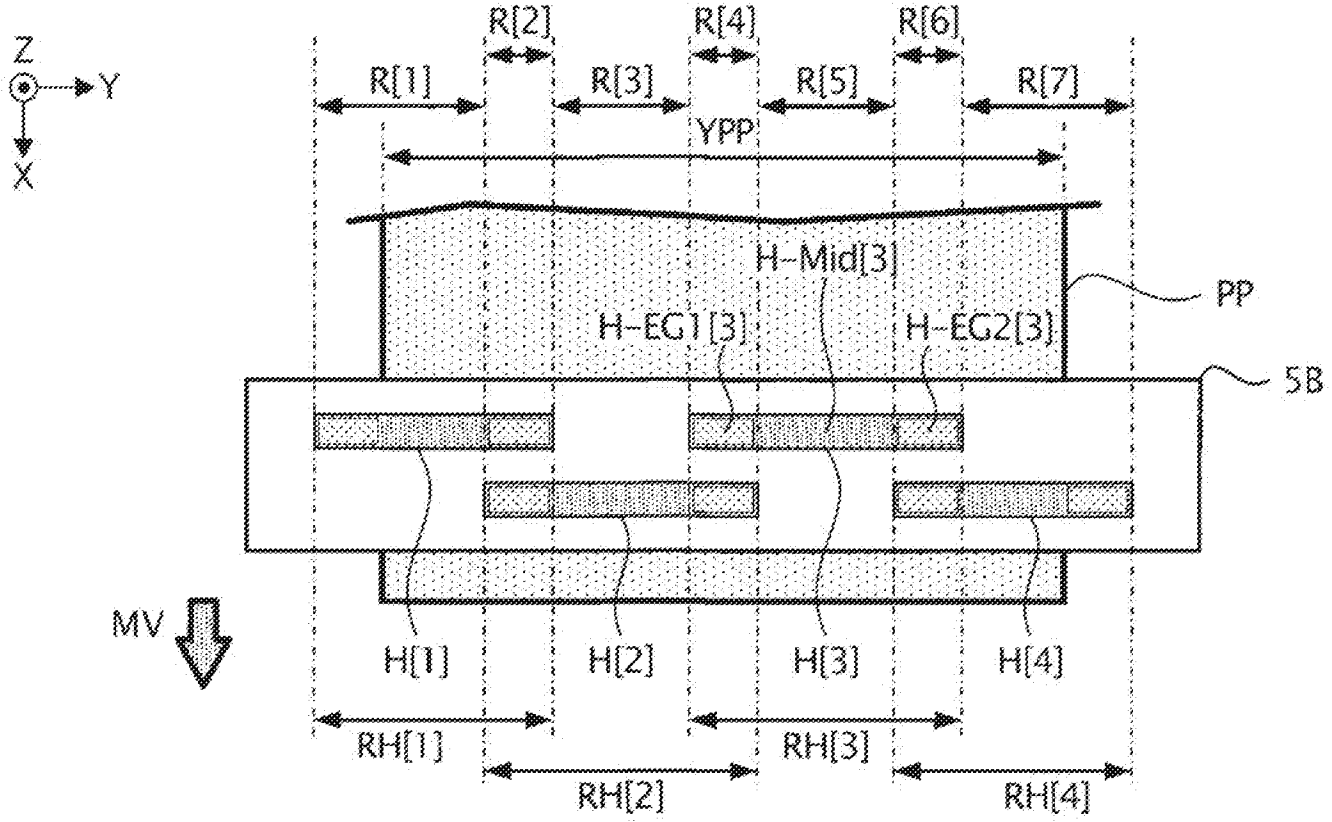
FIG. 24 is a plan view illustrating an example of a configuration of a heating unit.

FIG. 24 is a schematic view illustrating an example of a planar configuration of the ink jet printer 1B when the heating unit 5B is viewed from the +Z direction in the ink jet printer 1B.

As illustrated in FIG. 24, the heating unit 5B is provided with K heaters H[1] to H[K]. In the embodiment, the value K is also a natural number that satisfies "K≥2", but hereinafter, a case where the value K is "4" will be described as an example.

In the embodiment, the heater H[k] also has a rectangular shape having a long side that extends in the Y axis direction and a short side that extends in the X axis direction when viewed from the Z axis direction. In other words, in the embodiment, the heater H[k] is provided so as to extend in the Y axis direction. Further, in the embodiment, the heaters H[1] to H[K] are also disposed such that the range where the heaters H[1] to H[K] exist in the Y axis direction include the range YPP.

In the following, from the two end portions H-EG[k] of the heater H[k], the end portion H-EG[k] on the −Y side of the center portion H-Mid[k] is referred to as the end portion H-EG1[k], and the end portion H-EG[k] on the +Y side of the center portion H-Mid[k] is referred to as the end portion H-EG2[k].

As illustrated in FIG. 24, in the embodiment, the regions RH[1] to RH[K] are provided such that the range where the end portion H-EG2[k1] of the heater H[k1] exists in the region RH[k1] where the heater H[k1] exists in the Y axis direction, and the range where the end portion H-EG1[k2] of the heater H[k2] exists in the region RH[k2] where the heater H[k2] exists in the Y axis direction overlap each other in the X axis direction. In the embodiment, the variable k1 is also a natural number that satisfies "1≤k1<K", and the variable k2 is also a natural number that satisfies "1<k2≤K" and "k2=1+k1". In the embodiment, the regions RH[1] to RH[K] are provided such that the range where the regions RH[1] to RH[K] exist in the Y axis direction includes the range YPP.

Further, as illustrated in FIG. 24, in the embodiment, the range where the M discharge sections D exist in the Y axis direction is also classified into J regions R[1] to R[J]. In the embodiment, the value J is a natural number that satisfies "2K+1". In other words, when the value K is "4", the value J is "7".

More specifically, in the embodiment, in the Y axis direction, the region R[1] is set in the range where the end portion H-EG1[1] and the center portion H-Mid[1] exist in the region RH[1], and the region R[7] is set in the range where the center portion H-Mid[4] and the end portion H-EG2[4] exist in the region RH[4]. In the embodiment, a region R[2*k1−1] is set in the range where the center portion H-Mid[k1] exists in the region RH[k1] excluding the region RH[1]. Further, in the embodiment, in the Y axis direction, the region R[2*k1] is set in the range where the end portion H-EG2[k1] exists in the region RH[k1]. In other words, in the Y axis direction, a region R[2*k2−2] is set in the range where the end portion H-EG1[k2] exists in the region RH[k2]. In other words, in the embodiment, when viewed from the +X direction, the heater H[k1] and the heater H[k2] are disposed such that the end portion H-EG2[k1] of the heater H[k1] and the end portion H-EG1[k2] of the heater H[k2] in the region R[2*k1] overlap each other.

Figure 25:
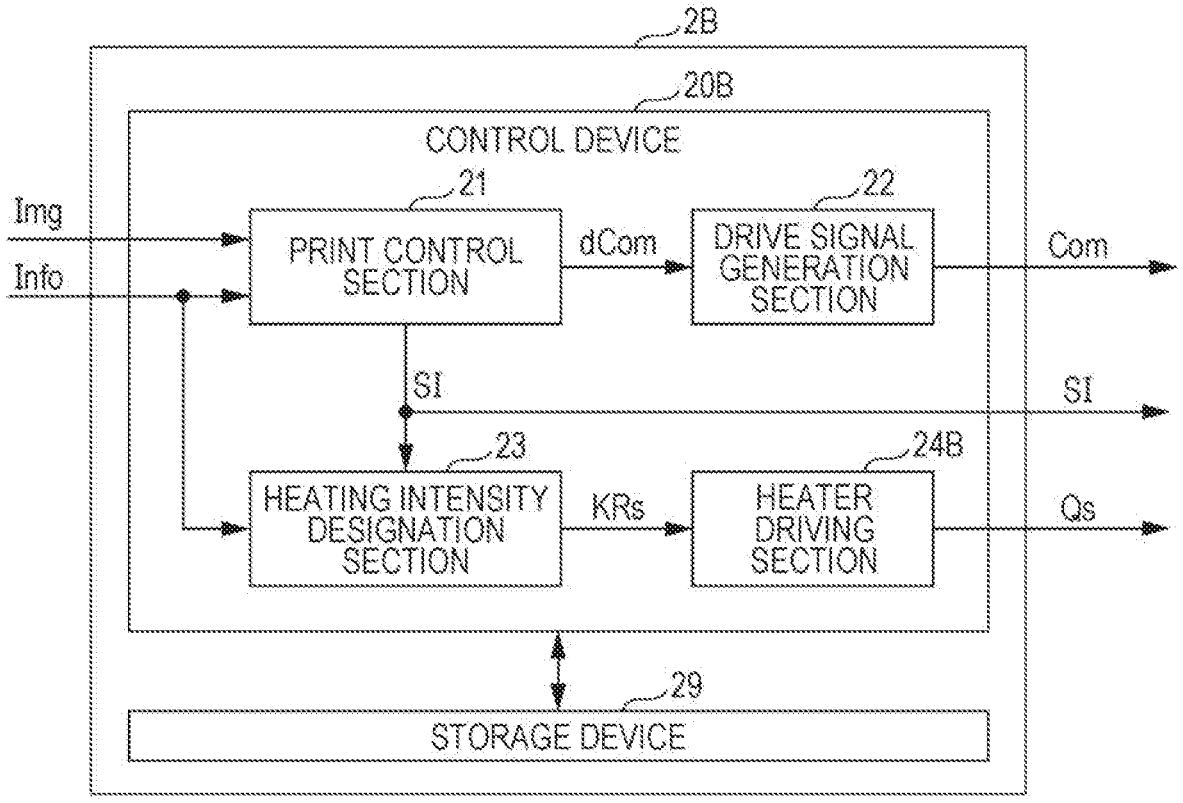
FIG. 25 is a block diagram illustrating an example of a configuration of a control unit.

FIG. 25 is a functional block diagram illustrating an example of a configuration of the control unit 2B.

As illustrated in FIG. 25, the control unit 2B is configured similarly to the control unit 2A except that a control device 20B is provided instead of the control device 20A. The control device 20B is configured similarly to the control device 20A except that a heater driving section 24B is provided instead of the heater driving section 24A. Although not illustrated, the storage device 29 according to the embodiment stores therein a heater heating intensity information table TBL14B instead of the heater heating intensity information table TBL14A.

Figures 26, 27:
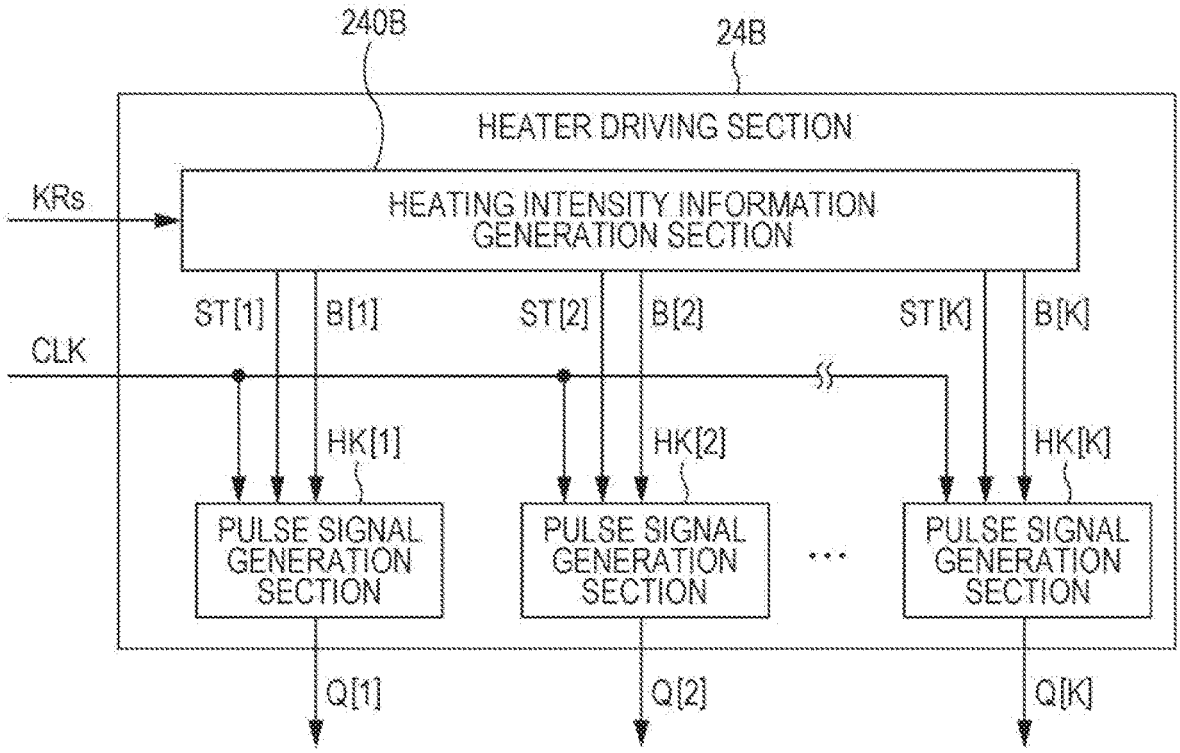
FIG. 26 is a block diagram illustrating an example of a configuration of a heater driving section.
FIG. 27 is an explanatory diagram illustrating an example of a data structure of a heater heating intensity information table.

FIG. 26 is a functional block diagram illustrating an example of a configuration of the heater driving section 24B.

As illustrated in FIG. 26, the heater driving section 24B is configured similarly to the heater driving section 24A except that a heating intensity information generation section 240B is provided instead of the heating intensity information generation section 240A.

In the embodiment, the heating intensity information generation section 240B generates the heating intensity information Bs based on the heating intensity information KRs with reference to the heater heating intensity information table TBL14B.

FIG. 27 is an explanatory diagram for describing an example of a data configuration of the heater heating intensity information table TBL14B.

As illustrated in FIG. 27, the heater heating intensity information table TBL14B has K records that have a one-to-one correspondence with the K heaters H[1] to H[K]. Each record of the heater heating intensity information table TBL14B includes information for identifying the heater H[k] and the heater corresponding region heating intensity information which is information that is referred to when generating the heater heating intensity information B[k] and indicates one or a plurality of pieces of region heating intensity information KR[j]. In the embodiment, the heater corresponding region heating intensity information that corresponds to the heater H[1] is the region heating intensity information KR[1] and KR[2], the heater corresponding region heating intensity information that corresponds to the heater H[K] is the region heating intensity information KR[K−1] and KR[K], the heater corresponding region heating intensity information that corresponds to the heater H[k1] excluding the heater H[1] is the region heating intensity information KR[−1+k1], KR[k1], and KR[1+k1].

The heating intensity information generation section 240B acquires one or a plurality of pieces of region heating intensity information KR[j] indicating the heater corresponding region heating intensity information that corresponds to the heater H[k] with reference to the heater heating intensity information table TBL14B, and generates the heater heating intensity information B[k] that corresponds to the heater H[k] based on the acquired one or the plurality of pieces of region heating intensity information KR[j]. Specifically, in the embodiment, for example, the heating intensity information generation section 240B specifies the region heating intensity information KR[j] that indicates the maximum value among one or the plurality of pieces of region heating intensity information KR[j] indicated by the heater corresponding region heating intensity information that corresponds to the heater H[k], and generates the heater heating intensity information B[k] having the same value as that of the specified region heating intensity information KR[j].

In this manner, in the embodiment, the heater driving section 24B heats the heater H[k] by the heating intensity that corresponds to the region R[j] where the region heating intensity information KR[j] becomes the maximum among the plurality of regions R[j] included in the region RH[k] where the heater H[k] exists. Therefore, in the embodiment, it is possible to reliably dry the ink discharged to the recording medium PP.

In the embodiment, by disposing the heater H[k1] and the heater H[k2] such that the end portion H-EG2[k1] of the heater H[k1] and the end portion H-EG1[k2] of the heater H[k2] overlap each other in the region R[2*k1] when viewed from the +X direction, the region R[2*k1] is heated by the end portion H-EG2[k1] of the heater H[k1] and the end portion H-EG1[k2] of the heater H[k2] cooperating with each other. Therefore, in the embodiment, it becomes possible to heat the recording medium PP by effectively utilizing the end portion H-EG[k] of the heater H[k].

In addition, in the embodiment, the heating intensity information generation section 240B may specify the region heating intensity information KR[j] that indicates the minimum value among one or the plurality of pieces of region heating intensity information KR[j] indicated by the heater corresponding region heating intensity information that corresponds to the heater H[k], and generate the heater heating intensity information B[k] having the same value as that of the specified region heating intensity information KR[j]. In this case, the damage to the recording medium PP due to the heating by the heater H[k] can be minimized.

2.2. Modification Example of Second Embodiment

Specific modifications according to the embodiment will be described below. Two or more aspects selected in any manner from the plurality of aspects described in the specification can be appropriately combined with each other within a range not inconsistent with each other.

Modification Example 2.1

In the above-described first and second embodiments and each of the modification examples, the heater H[k] is provided such that the Y axis direction is the longitudinal direction, but the disclosure is not limited to such an aspect. The heater H[k] may be disposed such that the direction intersecting the X axis direction and the Y axis direction is the longitudinal direction.

Figure 28:
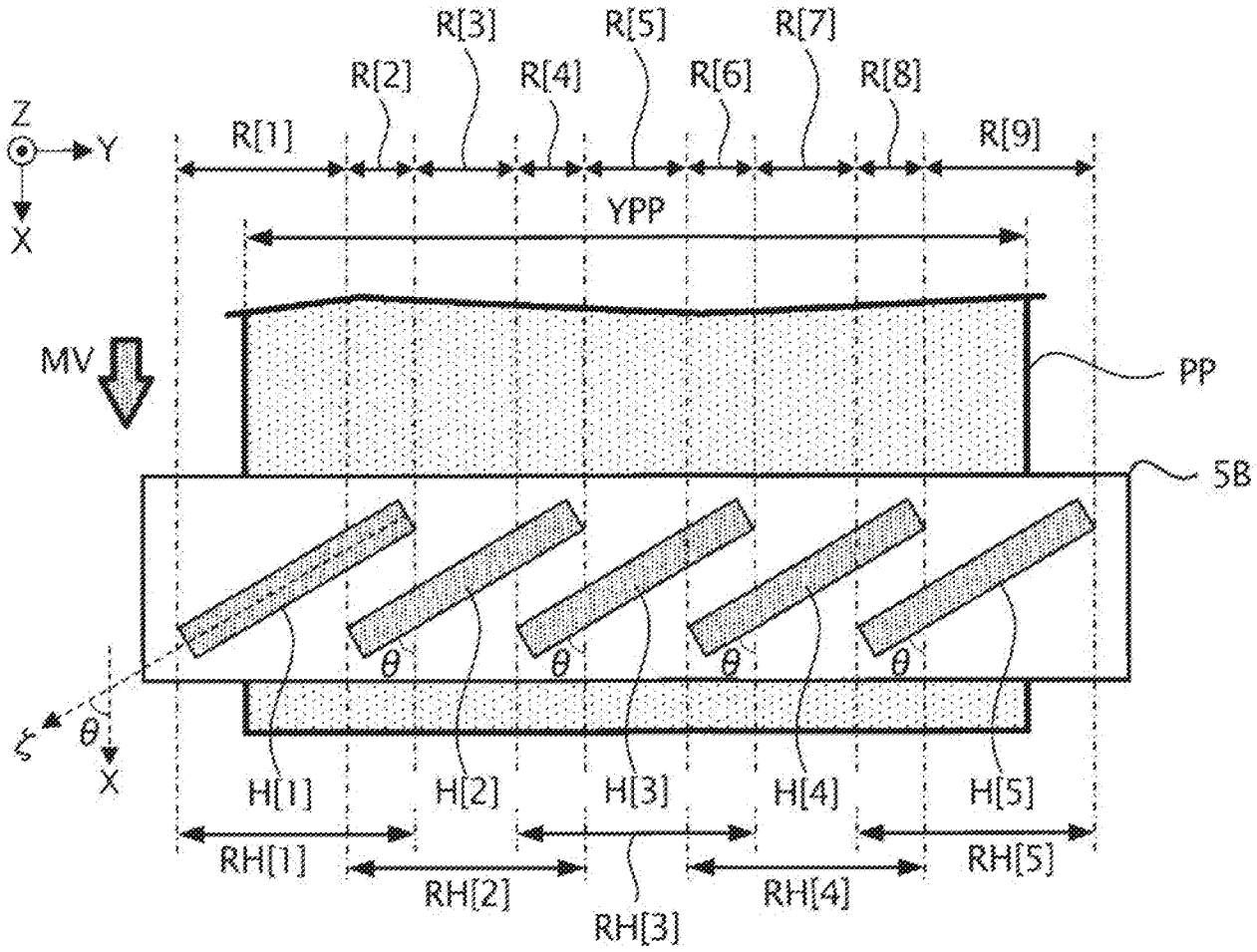
FIG. 28 is a plan view illustrating an example of a configuration of a heating unit according to Modification Example 2.1.

FIG. 28 is a schematic view illustrating an example of a planar configuration of the heating unit 5B when the heating unit 5B according to the modification example is viewed from the +Z direction.

As illustrated in FIG. 28, the heating unit 5B according to the modification example is provided with K heaters H[1] to H[K]. In addition, in the modification example, the value K is also a natural number that satisfies "K≥2", but in the modification example, a case where the value K is "5" will be described as an example.

Further, in the modification example, the heater H[k] is disposed such that the direction intersecting the +X direction at an angle θ is the longitudinal direction when viewed from the +Z direction. Here, the angle θ is an angle larger than 0 degrees and smaller than 90 degrees.

Figure 29:
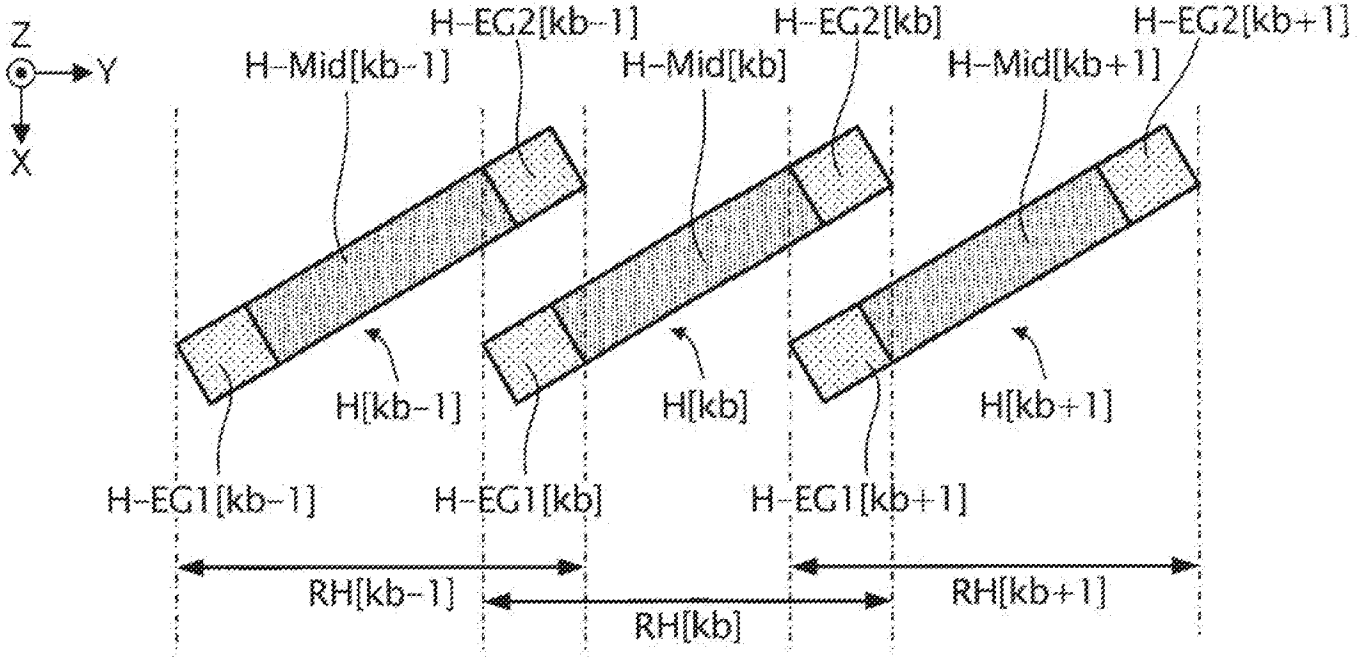
FIG. 29 is a plan view illustrating an example of arrangement of heaters according to Modification Example 2.1.

In addition, as illustrated in FIG. 29, in the modification example, similarly to the second embodiment, the heaters H[1] to H[K] are disposed such that the end portion H-EG2[kb−1] of the heater H[kb−1] and the end portion H-EG1[kb] of the heater H[kb] overlap each other and the end portion H-EG2[kb] of the heater H[kb] and the end portion H-EG1[kb+1] of the heater H[kb+1] overlap each other when the heating unit 5B is viewed from the +X direction. Here, the variable kb is a natural number that satisfies "2≤kb≤K−1".

In the modification example, the heaters H[1] to H[K] are disposed such that the end portion H-EG2[kb−1] of the heater H[kb−1] is positioned on the −X side of the end portion H-EG1[kb] of the heater H[kb] and the end portion H-EG1[kb+1] of the heater H[kb+1] is positioned on the +X side of the end portion H-EG2[kb] of the heater H[kb].

As is clear from FIG. 29, the center portion H-Mid[kb] of the heater H[kb] includes a part that does not overlap the heater H[kb−1] and the heater H[kb+1] when viewed from the +X direction, and is positioned between the end portion H-EG1[kb] and the end portion H-EG2[kb].

2.3. Summary of Second Embodiment

As described above, the ink jet printer 1B according to the modification example includes: the transport unit 4 that transports the recording medium PP in the +X direction; the printing unit 3 that discharges ink to the recording medium PP transported by the transport unit 4; and the heating unit 5B provided on the +X side of the printing unit 3, the heating unit 5B has the heater H[kb] that extends in the ζ direction and heats the recording medium PP, the heater H[kb−1] that extends in the ζ direction and heats the recording medium PP, and the heater H[kb+1] that extends in the direction and heats the recording medium PP, the heater H[kb] has the end portion H-EG1[kb] that overlaps the heater H[kb−1] in the +X direction, the end portion H-EG2[kb] that overlaps the heater H[kb+1] in the +X direction, and the center portion H-Mid[kb] between the end portion H-EG1[kb] and the end portion H-EG2[kb] without overlapping the heater H[kb−1] and the heater H[kb+1] in the +X direction, and the angle θ made by the +X direction and the ζ direction is larger than 0 degrees and smaller than 90 degrees. In other words, the ink jet printer 1B according to the modification example includes the heater H[k] that extends in the direction.

Therefore, according to the modification example, for example, compared to an aspect in which the heater H[k] extends in the Y axis direction, the time during which the recording medium PP transported by the transport unit 4 overlaps the −Z side of the heater H[k] when viewed from the +Z direction can be made longer. In other words, according to the modification example, the heating time of the recording medium PP by the heater H[k] can be made longer than that in an aspect in which the heater H[k] extends in the Y axis direction. Therefore, according to the modification example, compared to an aspect in which the heater H[k] extends in the Y axis direction, similarly to the speed priority print mode, even when the transport speed of the recording medium PP by the transport unit 4 is accelerated, it becomes possible to more reliably dry the ink discharged to the recording medium PP.

In the ink jet printer 1B according to modification example, the end portion H-EG2[kb−1] of the heater H[kb−1] is positioned on the −X side of the end portion H-EG1[kb] of the heater H[kb], and the end portion H-EG1[kb+1] of the heater H[kb+1] is positioned on the +X side of the end portion H-EG2[kb] of the heater H[kb].

Therefore, in the modification example, the heating unit 5B can be made smaller compared to an aspect in which the end portion H-EG2[kb−1] of the heater H[kb−1] is positioned on the +X side of the end portion H-EG1[kb] of the heater H[kb] and the end portion H-EG1[kb+1] of the heater H[kb+1] is positioned on the −X side of the end portion H-EG2[kb] of the heater H[kb].

Further, in the ink jet printer 1B according to the modification example, the temperature of the center portion H-Mid[kb] in the temperature maintenance period Tij[kb] is higher than the temperature of the end portion H-EG1[kb] in the temperature maintenance period Tij[kb] and the temperature of the end portion H-EG2[kb] in the temperature maintenance period Tij[kb].

In other words, according to the modification example, for example, the heater H[kb−1], the heater H[kb], and the heater H[kb+1] are disposed such that the end portion H-EG1[kb] having a lower temperature than that of the center portion H-Mid[kb] overlap the heater H[kb−1] in the X axis direction in the temperature maintenance period Tij[kb], and the end portion H-EG2[kb] having a lower temperature than that of the center portion H-Mid[kb] overlaps the heater H[kb+1] in the X axis direction in the temperature maintenance period Tij[kb]. Therefore, according to the modification example, it also becomes possible to dry the ink discharged to the part of the recording medium PP that passes on the −Z side of the end portion H-EG[kb] similarly to the ink discharged to the part of the center portion H-Mid[kb] that passes on the −Z side.

3. Third Embodiment

Hereinafter, an ink jet printer 1C according to the embodiment will be described with reference to FIGS. 30 to 34. In the ink jet printer 1C according to the embodiment, the plurality of heaters H dry the ink discharged to any place on the recording medium PP in cooperation with each other.

3.1. Ink Jet Printer According to Third Embodiment

Figure 30:
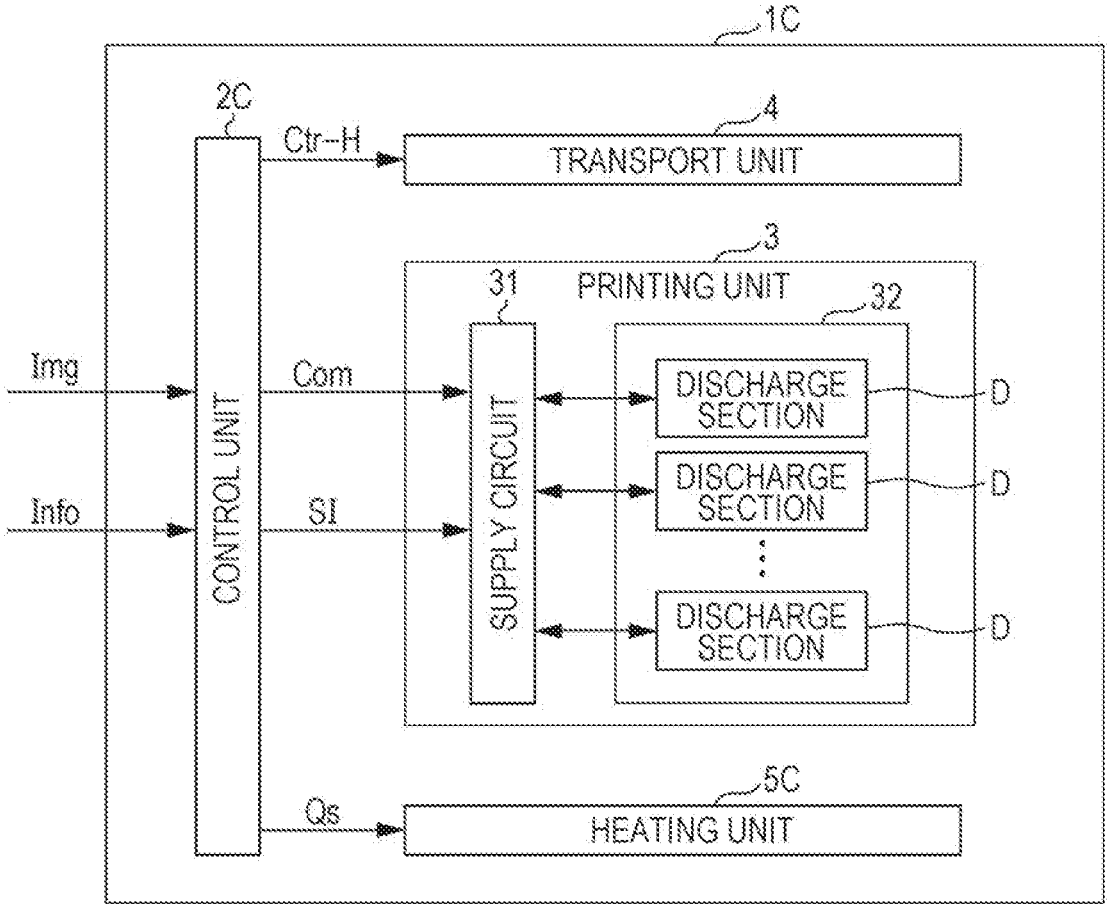
FIG. 30 is a block diagram illustrating an example of a configuration of an ink jet printer according to a third embodiment of the disclosure.

FIG. 30 is a functional block diagram illustrating an example of a configuration of the ink jet printer 1C.

As illustrated in FIG. 30, the ink jet printer 1C has the same configuration as that of the ink jet printer 1A except that a control unit 2C is provided instead of the control unit 2A and a heating unit 5C is provided instead of the heating unit 5A.

Figure 31:
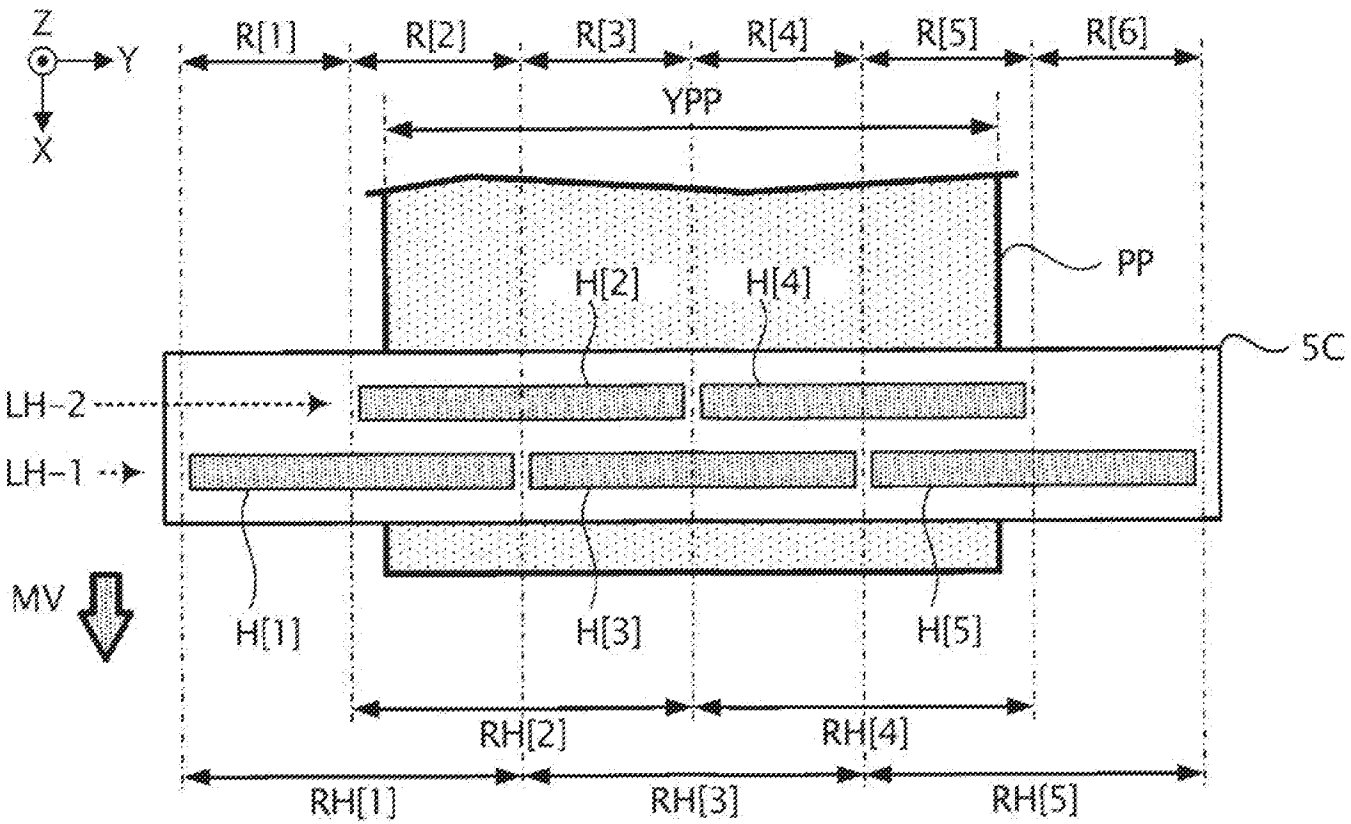
FIG. 31 is a plan view illustrating an example of a configuration of a heating unit.

FIG. 31 is a schematic view illustrating an example of a planar configuration of the ink jet printer 1C when the heating unit 5C is viewed from the +Z direction in the ink jet printer 1C.

As illustrated in FIG. 31, the heating unit 5C is provided with K heaters H[1] to H[K]. In the embodiment, the value K is also a natural number that satisfies "K≥2", but hereinafter, a case where the value K is "5" will be described as an example. Further, in the embodiment, the heaters H[1] to H[K] are also disposed such that the regions RH[1] to RH[K] where the heaters H[1] to H[K] exist in the Y axis direction include the range YPP.

Further, in the embodiment, the range where the M discharge sections D exist in the Y axis direction is also classified into J regions R[1] to R[J]. In the embodiment, the value J is a natural number that satisfies "K+1". In other words, as illustrated in FIG. 31, when the value K is "5", the value J is "6".

In the embodiment, the heater H[k] is provided such that the region RH[k] where the heater H[k] exists in the Y axis direction extends to the region R[k] and the region R[k+1] adjacent to the region R[k] on the +Y side of the region R[k]. In addition, in the embodiment, the variable k is a natural number that satisfies "1≤k≤K".

In other words, in the embodiment, the heater H[k1] and the heater H[k2] are disposed such that the region RH[k1] where the heater H[k1] exists and the region RH[k2] where the heater H[k2] exists overlap each other in the region R[k2] when viewed from the +X direction. In the embodiment, the variable k1 is also a natural number that satisfies "1≤k1<K", and the variable k2 is also a natural number that satisfies "1<k2≤K" and "k2=1+k1".

In the embodiment, a case is assumed in which the heaters H[1] to H[K] are disposed so as to configure a heater row LH-1 that extends in the Y axis direction and a heater row LH-2 that extends in the Y axis direction. Specifically, in the embodiment, as illustrated in FIG. 31, the heater H[1], the heater H[3], and the heater H[5] configure the heater row LH-1, and the heater H[2] and the heater H[4] configure the heater row LH-2. In the embodiment, for example, a case is assumed in which the heater row LH-1 is positioned on the +X side of the heater row LH-2, but the heater row LH-1 may be positioned on the −X side of the heater row LH-2.

Figure 32:
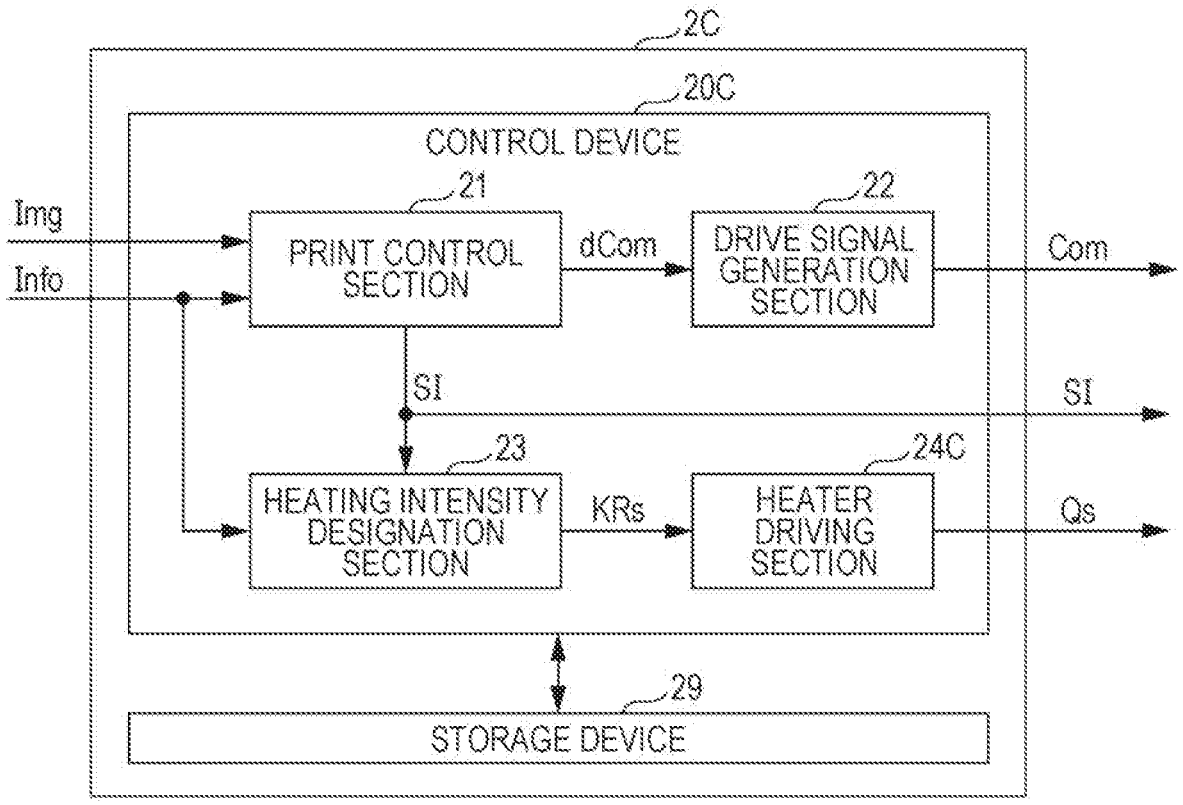
FIG. 32 is a block diagram illustrating an example of a configuration of a control unit.

FIG. 32 is a functional block diagram illustrating an example of a configuration of the control unit 2C.

As illustrated in FIG. 32, the control unit 2C is configured similarly to the control unit 2A except that a control device 20C is provided instead of the control device 20A. The control device 20C is configured similarly to the control device 20A except that a heater driving section 24C is provided instead of the heater driving section 24A. Although not illustrated, the storage device 29 according to the embodiment stores therein a heater heating intensity information table TBL14C instead of the heater heating intensity information table TBL14A.

Figure 33:
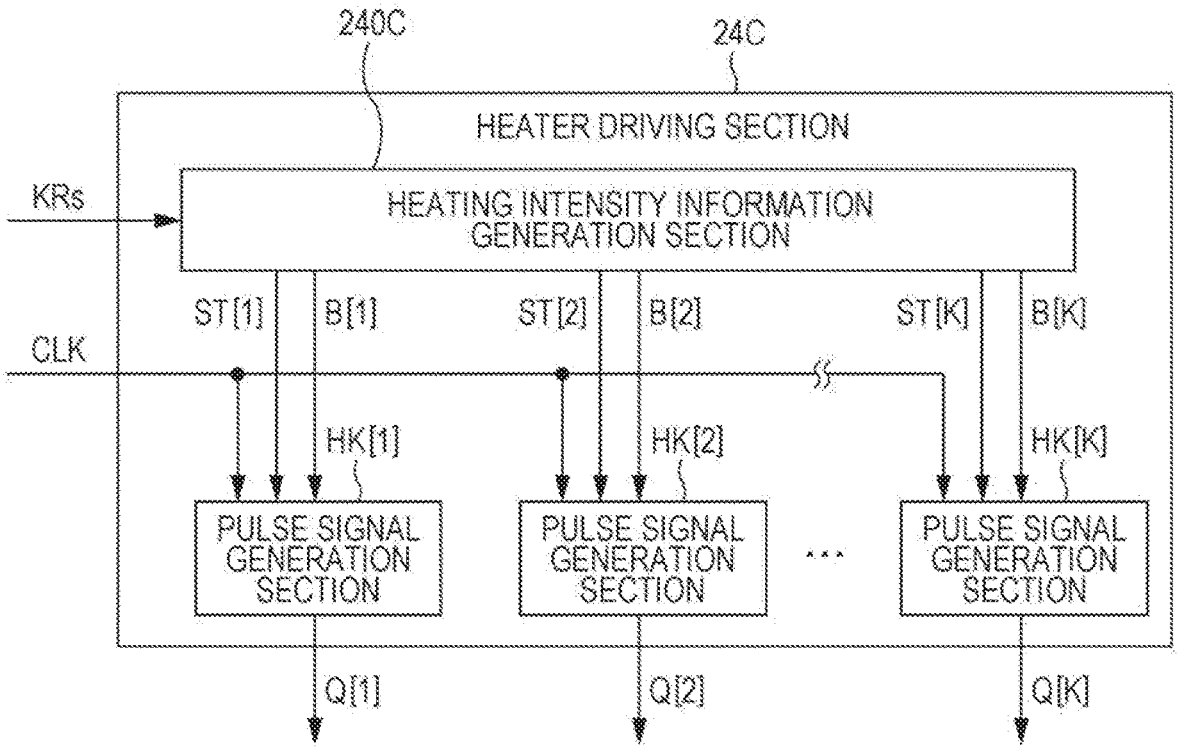
FIG. 33 is a block diagram illustrating an example of a configuration of a heater driving section.

FIG. 33 is a functional block diagram illustrating an example of a configuration of the heater driving section 24C.

As illustrated in FIG. 33, the heater driving section 24C is configured similarly to the heater driving section 24A except that a heating intensity information generation section 240C is provided instead of the heating intensity information generation section 240A.

In the embodiment, the heating intensity information generation section 240C generates the heating intensity information Bs based on the heating intensity information KRs with reference to the heater heating intensity information table TBL14C.

FIG. 34 is an explanatory diagram for describing an example of a data configuration of the heater heating intensity information table TBL14C.

As illustrated in FIG. 34, the heater heating intensity information table TBL14C has K records that have a one-to-one correspondence with the K heaters H[1] to H[K]. Each record of the heater heating intensity information table TBL14C includes information for identifying the heater H[k] and the heater corresponding region heating intensity information that is referred to when generating the heater heating intensity information B[k].

In the embodiment, the heater corresponding region heating intensity information is information including one or both of one or the plurality of pieces of region heating intensity information KR[j] and one or a plurality of pieces of correction region heating intensity information α[j]*KR[j].

Here, the correction region heating intensity information α[j]*KR[j] is information determined based on the region heating intensity information KR[j] and correction information α[j]. In the embodiment, the correction region heating intensity information α[j]*KR[j] indicates "0" when the region heating intensity information KR[j] indicates "0", and the region heating intensity information KR[j] indicates a value which is larger than "0" and smaller than that of the region heating intensity information KR[j] when the region heating intensity information KR[j] indicates a value larger than "0".

The correction information α[j] is information for generating the correction region heating intensity information α[j]*KR[j].

For example, the correction information α[j] may be a constant larger than 0 and smaller than 1. In this case, the correction region heating intensity information α[j]*KR[j] may indicate a value obtained by multiplying the value indicated by the region heating intensity information KR[j] by a constant value indicated by the correction information α[j]. As an example, when the region heating intensity information KR[j] indicates "20" and the correction information α[j] indicates "0.5", the correction region heating intensity information α[j]*KR[j] may indicate "20×0.5=10".

In addition, as the correction information α[j], any operator for generating the correction region heating intensity information α[j]*KR[j] that indicates a value smaller than that of the region heating intensity information KR[j] can be adopted. For example, the correction information α[j] may be a function of the region heating intensity information KR[j] that outputs the correction region heating intensity information α[j]*KR[j] using the value indicated by the region heating intensity information KR[j] as an argument. In short, the correction information α[j] may be information for producing the correction region heating intensity information α[j]*KR[j] that indicates the value smaller than that of the region heating intensity information KR[j] by applying the correction information α[j] to the region heating intensity information KR[j].

As illustrated in FIG. 34, in the embodiment, the heater corresponding region heating intensity information that corresponds to the heater H[1] is the region heating intensity information KR[1] and the correction region heating intensity information α[2]*KR[2].

Further, in the embodiment, the heater corresponding region heating intensity information that corresponds to the heater H[K] is the region heating intensity information KR[J] and the correction region heating intensity information α[J−1]*KR[J−1].

Further, in the embodiment, when the variable k satisfies "2≤k≤K−1", the heater corresponding region heating intensity information that corresponds to the heater H[k] is the correction region heating intensity information α[k]*KR[k] and the correction region heating intensity information α[k+1]*KR[k+1].

The heating intensity information generation section 240C acquires the heater corresponding region heating intensity information that corresponds to the heater H[k] with reference to the heater heating intensity information table TBL14C. Then, the heating intensity information generation section 240C generates the heater heating intensity information B[k] that corresponds to the heater H[k] based on one or the plurality of pieces of region heating intensity information KR[j] and one or the plurality of pieces of correction region heating intensity information α[j]*KR[j] that indicate the acquired heater corresponding region heating intensity information. Specifically, in the embodiment, the heating intensity information generation section 240C specifies the region heating intensity information KR[j] or the correction region heating intensity information α[j]*KR[j] that indicate the maximum value among one or the plurality of pieces of region heating intensity information KR[j] and one or the plurality of pieces of correction region heating intensity information α[j]*KR[j] which indicate the acquired heater corresponding region heating intensity information, and generates the heater heating intensity information B[k] having the same value as that of the specified region heating intensity information KR[j] and the correction region heating intensity information α[j]*KR[j].

Specifically, the heating intensity information generation section 240C sets the value indicated by the heater heating intensity information B[1] that corresponds to the heater H[1] into a larger value from the value indicated by the region heating intensity information KR[1] and the value indicated by the correction region heating intensity information α[2]*KR[2].

Further, the heating intensity information generation section 240C sets the value indicated by the heater heating intensity information B[K] that corresponds to the heater H[K] to a larger value from the value indicated by the region heating intensity information KR[J] and the value indicated by the correction region heating intensity information α[J−1]*KR[J−1].

Further, when the variable k satisfies "2≤k≤K−1", the heating intensity information generation section 240C sets the value indicated by the heater heating intensity information B[k] that corresponds to the heater H[k] to a larger value from the value indicated by the correction region heating intensity information α[k]*KR[k] and the value indicated by the correction region heating intensity information α[k+1]*KR[k+1].

In the embodiment, the correction information α[k] may be determined such that the heating amount by one heater H[k] for heating the recording medium PP at the heating intensity that corresponds to the heater heating intensity information B[k] determined based on the region heating intensity information KR[k] and the total value of the heating amount by two heaters H[k] for heating the recording medium PP at the heating intensity that corresponds to the heater heating intensity information B[k] determined based on the correction region heating intensity information α[k]*KR[k] become substantially the same as each other.

In the specification, "substantially the same" means a case where the values are the same in design, and is a concept including a case where the values are the same when an error is ignored.

Hereinafter, in order to clarify the effect according to the embodiment, "Reference Example 1" which is an aspect in which the value indicated by the heater heating intensity information B[k] that corresponds to the heater H[k] is set to a larger value from the value indicated by the region heating intensity information KR[k] and the value indicated by the region heating intensity information KR[k+1], will be described.

In Reference Example 1, for example, while the ink is discharged to the region R[k] and the region discharge amount information TR[k] indicates a value larger than "0", even when the ink is not discharged to the region R[k+1] and the region discharge amount information TR[k+1] indicates "0", the heater heating intensity information B[k] that corresponds to the heater H[k] is set to a value indicated by the region heating intensity information KR[k]. Therefore, in Reference Example 1, the heater H[k] heats the region R[k+1] of the recording medium PP where the ink is not discharged at an intensity for drying the ink having a discharge amount indicated by the region discharge amount information TR[k]. Therefore, in Reference Example 1, when a large amount of ink is discharged to the region R[k], there is a high possibility that the region R[k+1] of the recording medium PP where the ink is not discharged is damaged by the heat from the heater H[k].

On the other hand, in the embodiment, when the variable k satisfies "2≤k≤K−1", the value indicated by the heater heating intensity information B[k] that corresponds to the heater H[k] is determined based on the correction region heating intensity information α[k]*KR[k] indicating a value smaller than that indicated by the region heating intensity information KR[k] or the correction region heating intensity information α[k+1]*KR[k+1] indicating a value smaller than that indicated by the region heating intensity information KR[k+1]. Therefore, according to the embodiment, for example, when the variable k satisfies "2 k≤K−1", the heater heating intensity information B[k] that corresponds to the heater H[k] can be set to a value smaller than in Reference Example 1. Therefore, according to the embodiment, when the variable k satisfies "2≤k≤K−1", even when a large amount of ink is discharged to the region R[k], compared to Reference Example 1, it becomes possible to reduce the possibility that the region R[k+1] of the recording medium PP where the ink is not discharged is damaged by the heat from the heater H[k].

Further, in the embodiment, as illustrated in FIG. 31, the heaters H[1] to H[K] may also be disposed such that the regions RH[2] to RH[K−1] where the heaters H[2] to H[K−1] exist in the Y axis direction include the range YPP. In other words, in the embodiment, the heaters H[1] to H[K] may be disposed such that the range where the heater row LH-1 exists in the Y axis direction includes the range YPP, and the range where the heater row LH-2 exists in the Y axis direction includes the range YPP. In this case, compared to Reference Example 1, it becomes possible to reduce the possibility that any region R[j] of the recording medium PP is damaged by the heat from the heater H[k].

In the embodiment, when the printing unit 3 makes ink adhere to the region R[k2] and the region R[k2+1] of the recording medium PP, the recording medium PP may be heated by the heater H[k2], and the heating of the recording medium PP by the heater H[k2−1] may be restricted. Further, when the printing unit 3 makes ink adhere to the region R[k2] and the region R[k2+1] of the recording medium PP, the recording medium PP may be heated by the heater H[k2], and the heating of the recording medium PP by the heater H[k2−1] may be restricted.

Furthermore, when the printing unit 3 makes ink adhere to the region R[k2] and the region R[k2+1] of the recording medium PP, the recording medium PP may be heated by the heater H[k2], and the heating of the recording medium PP by the heater H[k2−1] and the heater H[k2+1] may be restricted. In this case, since the region R[k2] and the region R[k2+1] of the recording medium PP are heated only using the heater H[k2] among the three heaters H such as the heater H[k2−1], the heater H[k2], and the heater H[k2+1], compared to an aspect in which the region R[k2] and the region R[k2+1] of the recording medium PP are heated by the three heaters H such as the heater H[k2−1], the heater H[k2], and the heater H[k2+1], it is possible to appropriately heat the region R[k2] and the region R[k2+1] while suppressing the total power consumption of the three heaters H. However, in this case, in order to sufficiently perform heating and fixing, it is preferable that the heating intensity of the heater H[k2] is set to be stronger than the heating intensity of the heater H[k2] when the ink adheres to the region R[k2] and the ink does not adhere to the region R[k2−1].

When the printing unit 3 makes ink adhere to the region R[2*k*] and the region R[2*k*+1] and does not make ink adhere to the region R[2*k*−1] of the recording medium PP, the recording medium PP may be heated by the heater H[k2], and the heating of the recording medium PP by the heater H[k2−1] may be restricted. In addition, when the printing unit 3 makes ink adhere to the region R[2*k*] and the region R[2*k*+1] and does not make ink adhere to the region R[2*k*−1] and the region R[2*k*+2] of the recording medium PP, the recording medium PP may be heated by the heater H[k2], and the heating of the recording medium PP by the heater H[k2−1] and the heater H[2*k*+1] may be restricted.

3.2. Modification Example of Third Embodiment

Specific modifications according to the embodiment will be described below. Two or more aspects selected in any manner from the plurality of aspects described in the specification can be appropriately combined with each other within a range not inconsistent with each other.

Modification Example 3.1

In the above-described third embodiment, the two heaters H dry the ink discharged to any place on the recording medium PP in cooperation with each other, but the disclosure is not limited to such an aspect. Three or more heaters H may dry the ink discharged to any place on the recording medium PP in cooperation with each other.

Figure 35:
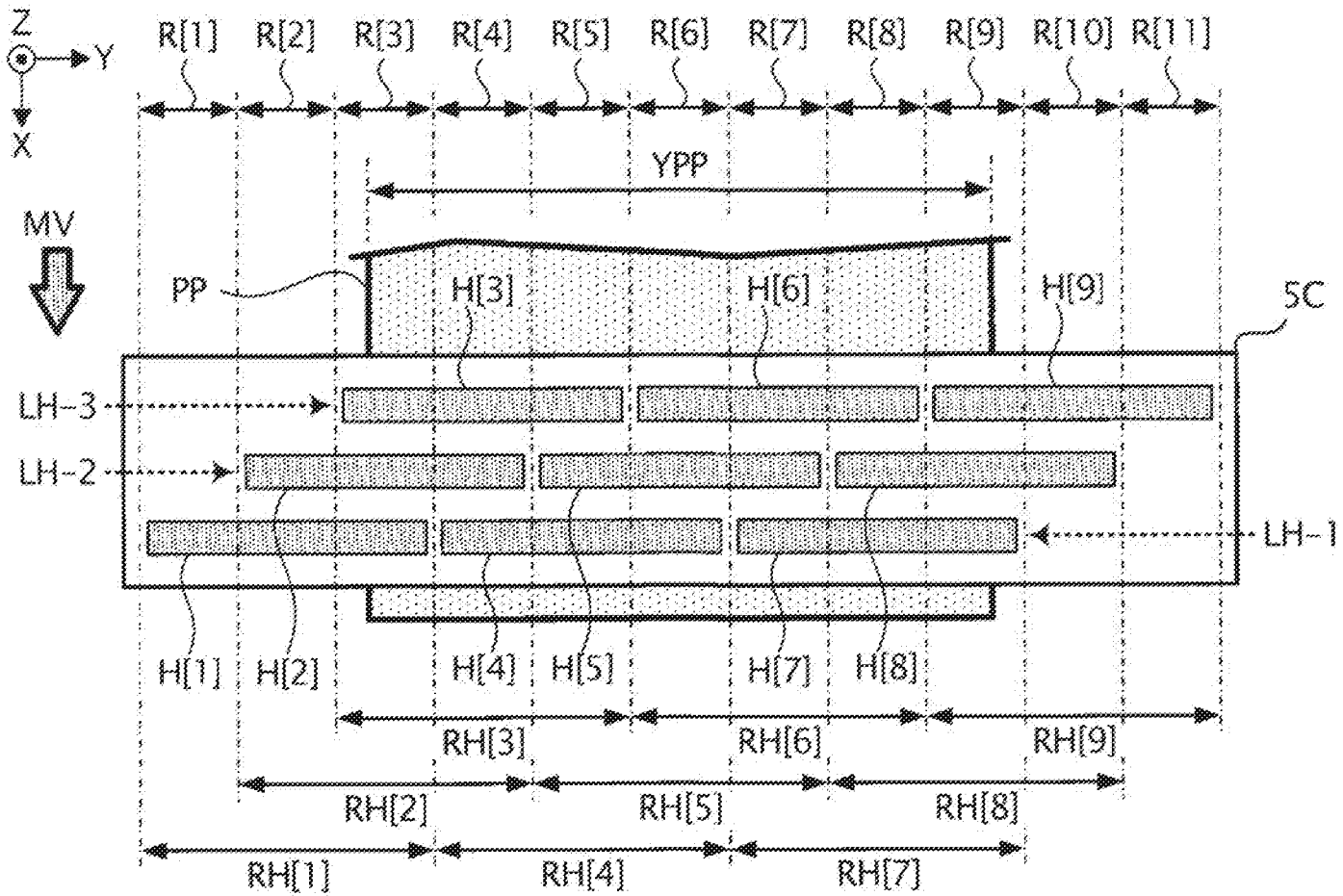
FIG. 35 is a plan view illustrating an example of a configuration of a heating unit according to Modification Example 3.1.

FIG. 35 is a schematic view illustrating an example of a planar configuration of the heating unit 5C when the heating unit 5C according to the modification example is viewed from the +Z direction.

As illustrated in FIG. 35, the heating unit 5C according to the modification example is provided with K heaters H[1] to H[K]. In the modification example, the value K is also a natural number that satisfies "K≥2", but hereinafter, a case where the value K is "9" will be described as an example. Further, in the modification example, the heaters H[1] to H[K] are also disposed such that the regions RH[1] to RH[K] where the heaters H[1] to H[K] exist in the Y axis direction include the range YPP.

In the modification example, a case is assumed in which the heaters H[1] to H[K] are disposed so as to configure the heater row LH-1 that extends in the Y axis direction, the heater row LH-2 that extends in the Y axis direction, and a heater row LH-3 that extends in the Y axis direction. Specifically, in the modification example, as illustrated in FIG. 35, the heater H[1], the heater H[4], and the heater H[7] configure the heater row LH-1, the heater H[2], the heater H[5], and the heater H[8] configure the heater row LH-2, and the heater H[3], the heater H[6], and the heater H[9] configure the heater row LH-3.

In the modification example, the heaters H[1] to H[K] may be disposed such that the range where the heater row LH-1 exists in the Y axis direction includes the range YPP, the range where the heater row LH-2 exists in the Y axis direction includes the range YPP, and the range where the heater row LH-3 exists in the Y axis direction includes the range YPP. In other words, in the modification example, the heaters H[1] to H[K] are also disposed such that the regions RH[3] to RH[K−2] where the heaters H[3] to H[K−2] exist in the Y axis direction include the range YPP.

Further, in the modification example, the range where the M discharge sections D in the Y axis direction is also classified into J regions R[1] to R[J]. In the modification example, the value J is a natural number that satisfies "K+2". In other words, as illustrated in FIG. 35, when the value K is "9", the value J is "11".

In the modification example, the heater H[k] is provided such that the region RH[k] where the heater H[k] exists in the Y axis direction extends to the region R[k], the region R[k+1] adjacent to the region R[k] on the +Y side of the region R[k], and the region R[k+2] adjacent to the region R[k] on the +Y side of the region R[k+1]. In addition, in the modification example, the variable k is a natural number that satisfies "1≤k≤K".

In other words, in the modification example, the heater H[k1], the heater H[k2], and the heater H[k3] are disposed such that the region RH[k1] where the heater H[k1] exists, the region RH[k2] where the heater H[k2] exists, and the region RH[k3] where the heater H[k3] exists overlap each other in the region R[k3] when viewed from the +X direction. In the modification example, the variable k1 is a natural number that satisfies "1≤k1≤K−2", the variable k2 is a natural number that satisfies "2≤k2≤K−1" and "k2=1+k1", and the variable k3 is a natural number that satisfies "3≤k3≤K" and "k3=1+k2".

FIG. 36 is an explanatory diagram for describing an example of a data configuration of the heater heating intensity information table TBL14C according to the modification example.

As illustrated in FIG. 36, the heater heating intensity information table TBL14C according to the modification example has K records that have a one-to-one correspondence with the K heaters H[1] to H[K]. Each record of the heater heating intensity information table TBL14C includes information for identifying the heater H[k] and heater corresponding region heating intensity information.

In the modification example, similarly to the above-described embodiment, the heater corresponding region heating intensity information is information including one or both of one or the plurality of pieces of region heating intensity information KR[j] and one or a plurality of pieces of correction region heating intensity information α[j]*KR[j].

As illustrated in FIG. 36, in the modification example, the heater corresponding region heating intensity information that corresponds to the heater H[1] is the region heating intensity information KR[1], the correction region heating intensity information α[2]*KR[2], and the correction region heating intensity information α[3]*KR[3].

Further, in the modification example, the heater corresponding region heating intensity information that corresponds to the heater H[K] is the region heating intensity information KR[J], the correction region heating intensity information α[J−1]*KR[J−1], and the correction region heating intensity information α[J−2]*KR[J−2].

Further, in the embodiment, when the variable k satisfies "2≤k≤K−1", the heater corresponding region heating intensity information that corresponds to the heater H[k] is the correction region heating intensity information α[k]*KR[k], the correction region heating intensity information α[k+1]*KR[k+1], and the correction region heating intensity information α[k+2]*KR[k+2].

In the modification example, the heating intensity information generation section 240C acquires the heater corresponding region heating intensity information that corresponds to the heater H[k] with reference to the heater heating intensity information table TBL14C. Then, the heating intensity information generation section 240C generates the heater heating intensity information B[k] that corresponds to the heater H[k] based on the acquired heater corresponding region heating intensity information.

Specifically, in the modification example, the heating intensity information generation section 240C sets the value indicated by the heater heating intensity information B[1] that corresponds to the heater H[1] into the largest value among the value indicated by the region heating intensity information KR[1], the value indicated by the correction region heating intensity information α[2]*KR[2], and the value indicated by the correction region heating intensity information α[3]*KR[3].

In addition, in the modification example, the heating intensity information generation section 240C sets the value indicated by the heater heating intensity information B[K] that corresponds to the heater H[K] into the largest value among the value indicated by the region heating intensity information KR[J], the value indicated by the correction region heating intensity information α[J−1]*KR[J−1], and the value indicated by the correction region heating intensity information α[J−2]*KR[J−2].

In addition, in the modification example, when the variable k satisfies "2≤k≤K−1", the heating intensity information generation section 240C sets the value indicated by the heater heating intensity information B[k] that corresponds to the heater H[k] into the largest value among the value indicated by the correction region heating intensity information α[k]*KR[k], the value indicated by the correction region heating intensity information α[k+1]*KR[k+1], and the value indicated by the correction region heating intensity information α[k+2]*KR[k+2].

In the modification example, the correction information α[k] may be determined such that the heating amount by one heater H[k] for heating the recording medium PP at the heating intensity that corresponds to the heater heating intensity information B[k] determined based on the region heating intensity information KR[k] and the total value of the heating amount by the three heaters H[k] for heating the recording medium PP at the heating intensity that corresponds to the heater heating intensity information B[k] determined based on the correction region heating intensity information α[k]*KR[k] become substantially the same as each other.

In this manner, in the modification example, the value indicated by the heater heating intensity information B[k] that corresponds to the heater H[k] is determined based on the correction region heating intensity information α[k]*KR[k] indicating a value smaller than that indicated by the region heating intensity information KR[k], the correction region heating intensity information α[k+1]*KR[k+1] indicating a value smaller than that indicated by the region heating intensity information KR[k+1], or the correction region heating intensity information α[k+2]*KR[k+2] indicating a value smaller than that indicated by the region heating intensity information KR[k+2]. Therefore, according to the modification example, compared to Reference Example 1 described above, it becomes possible to reduce the possibility that any region R[j] of the recording medium PP is damaged by the heat from the heater H[k].

3.3. Summary of Third Embodiment

As described above, the ink jet printer 1C according to the embodiment includes: the transport unit 4 that transports the recording medium PP in the +X direction; the printing unit 3 that makes ink adhere to the recording medium PP transported by the transport unit 4; the heating unit 5C provided on the +X side of the printing unit 3; and the control unit 2C that controls the heating unit 5C, the heating unit 5C includes the heater H[k2] that extends to the region R[k2] and the region R[k2+1] positioned on the +Y side of the region R[k2] and heats the recording medium PP, and the heater H[k2−1] that extends to the region R[k2] and the region R[k2−1] positioned on the +Y side of the region R[k2] and heats the recording medium PP, and the control unit 2C heats the recording medium PP by the heater H[k2−1] and the heater H[k2] when the printing unit 3 makes the ink adhere to the region R[k2] of the recording medium PP.

In other words, in the ink jet printer 1C according to the embodiment, two heaters H[k] such as the heater H[k2−1] and the heater H[k2] dry the ink that has adhered to the region R[k2] of the recording medium PP in cooperation with each other. Therefore, according to the embodiment, for example, compared to an aspect in which the ink that has adhered to the region R[k2] of the recording medium PP is heated using only one heater H[k] from the heater H[k2−1] and the heater H[k2], it is possible to make the intensity of heating by each heater H[k] weaker. Accordingly, according to the embodiment, compared to an aspect in which the ink that has adhered to any place of the recording medium PP is heated using only one heater H[k], it becomes possible to reduce the possibility that a region of the recording medium PP where ink has not adhered is damaged by the heat from the heater H[k].

In the ink jet printer 1C according to the embodiment, when the printing unit 3 does not make ink adhere to the region R[k2] of the recording medium PP and makes ink adhere to the region R[k2+1] of the recording medium PP, the recording medium PP may be heated by the heater H[k2], and the heating of the recording medium PP by the heater H[k2−1] may be restricted.

In this manner, according to the embodiment, since the recording medium PP is heated using only one heater H[k] required for drying the ink that has adhered to the recording medium PP among the heaters H[1] to H[K], it becomes possible to suppress the electric power required for driving the heating unit 5C.

Further, the ink jet printer 1C according to the embodiment includes the heater row LH-1 including the heater H[k2] and the heater row LH-2 including the heater H[k2−1], the heater row LH-1 includes the range YPP where the recording medium PP exists in the +Y direction, and the heater row LH-2 includes the range YPP where the recording medium PP exists in the +Y direction.

In other words, according to the embodiment, for example, the ink that has adhered to the recording medium PP can be heated using the heater row LH-1 and the heater row LH-2. Therefore, according to the embodiment, for example, compared to an aspect in which the ink that has adhered to the recording medium PP is heated using only one heater row LH, it is possible to make the intensity of heating by each heater row LH weaker. Accordingly, according to the embodiment, compared to an aspect in which the ink that has adhered to any place of the recording medium PP is heated using only one heater row LH, it is possible to make the speed of performance deterioration of each heater row LH lower.

Further, in the ink jet printer 1C according to the embodiment, when the printing unit 3 makes the ink adhere to the region R[k2] of the recording medium PP, the control unit 2C controls the heating unit 5C such that the heating amount of the recording medium PP by the heater H[k2−1] and the heating amount of the recording medium PP by the heater H[k2] become the heating amount that corresponds to the value indicated by the correction region heating intensity information α[k2]*KR[k2].

Therefore, according to the embodiment, for example, compared to an aspect in which the heating amount of the recording medium PP by the heater H [k2−1] becomes the heating amount that corresponds to the region heating intensity information KR[k2], it is possible to make the speed of performance deterioration of the heater H[k1] lower.

Further, in the ink jet printer 1C according to the embodiment, the control unit 2C designates a specific discharge section that discharges the ink to the recording medium PP among the discharge sections D[1] to D[M], and controls the heating amount of the recording medium PP by the heater H[k2−1] and the heating amount of the recording medium PP by the heater H[k2] in accordance with the number of the specific discharge sections that discharge the ink to the region R[k2].

Therefore, according to the embodiment, for example, the heating amount of the recording medium PP by the heater H[k] can be controlled in accordance with the image formed in the print processing.

In the ink jet printer 1C according to the third embodiment, when the printing unit 3 makes ink adhere to the region R[k2] and the region R[k2+1] of the recording medium PP, the recording medium PP may be heated by the heater H[k2], and the heating of the recording medium PP by the heater H[k2−1] may be restricted. In this case, the heating of the recording medium PP by the heater H[k2+1] may further be restricted. Accordingly, according to the embodiment, since the recording medium PP is heated only using the heater H[k2] among the three heaters H such as the heater H[k2−1], the heater H[k2], and the heater H[k2+1], compared to an aspect in which the recording medium PP is heated using the three heaters H such as the heater H[k2−1], the heater H[k2], and the heater H[k2+1], it is possible to appropriately heat the region R[k2] and the region R[k2+1] while suppressing the total power consumption of the three heaters H. However, in this case, in order to sufficiently perform heating and fixing, it is preferable that the heating intensity of the heater H[k2] is set to be stronger than the heating intensity of the heater H[k2] when the ink adheres to the region R[k2] and the ink does not adhere to the region R[k2−1].

When the printing unit 3 makes ink adhere to the region R[2*k*] and the region R[2*k*+1] and does not make ink adhere to the region R[2*k*−1] of the recording medium PP, the recording medium PP may be heated by the heater H[k2], and the heating of the recording medium PP by the heater H[k2−1] may be restricted. In addition, when the printing unit 3 makes ink adhere to the region R[2*k*] and the region R[2*k*+1] and does not make ink adhere to the region R[2*k*−1] and the region R[2*k*+2] of the recording medium PP, the recording medium PP may be heated by the heater H[k2], and the heating of the recording medium PP by the heater H[k2−1] and the heater H[2*k*+1] may be restricted.

Further, the ink jet printer 1C according to the embodiment includes: the transport unit 4 that transports the recording medium PP in the +X direction; the printing unit 3 that makes ink adhere to the recording medium PP transported by the transport unit 4; and the heating unit 5C provided on the +X side of the printing unit 3, and the heating unit 5C includes the heater H[k2] that extends to the region R[k3], the region R[1+k3] positioned on the +Y side of the region R[k3], and the region R[k2] positioned on the −Y side of the region R[k3] and heats the recording medium PP, the heater H[k1] that extends to the region R[k3], the region R[k2], and the region R[k1] positioned on the −Y side of the region R[k2], and heats the recording medium PP, and the heater H[k3] that extends to the region R[k3], the region R[1+k3], and the region R[2+k3] positioned on the +Y side of the region R[1+k3] and heats the recording medium PP.

In other words, in the ink jet printer 1C according to the embodiment, the three heaters H[k] such as the heater H[k1], the heater H[k2], and the heater H[k3] can dry the ink that has adhered to the region R[k3] of the recording medium PP in cooperation with each other. Therefore, according to the embodiment, for example, compared to an aspect in which the ink that has adhered to the region R[k3] of the recording medium PP is heated using only one heater H[k], it is possible to make the intensity of heating by each heater H[k] weaker. Accordingly, according to the embodiment, compared to an aspect in which the ink that has adhered to any place of the recording medium PP is heated using only one heater H[k], it becomes possible to reduce the possibility that a region of the recording medium PP where ink has not adhered is damaged by the heat from the heater H[k].

Further, in the ink jet printer 1C according to the embodiment, when the printing unit 3 makes ink adhere to the region R[k3] of the recording medium PP, the control unit 2C heats the recording medium PP by the heater H[k1], the heater H[k2], and the heater H[k3].

Therefore, according to the embodiment, for example, compared to an aspect in which the ink that has adhered to the region R[k3] of the recording medium PP is heated using only one heater H[k], it is possible to make the intensity of heating by each heater H[k] weaker.

4. Fourth Embodiment

Hereinafter, an ink jet printer 1D according to the embodiment will be described with reference to FIGS. 37 to 41. The ink jet printer 1D according to the embodiment can execute the print processing on the plurality of types of recording media PP including a recording medium PP1 and a recording medium PP2 having sizes different from each other.

4.1. Ink Jet Printer According to Fourth Embodiment

Figure 37:
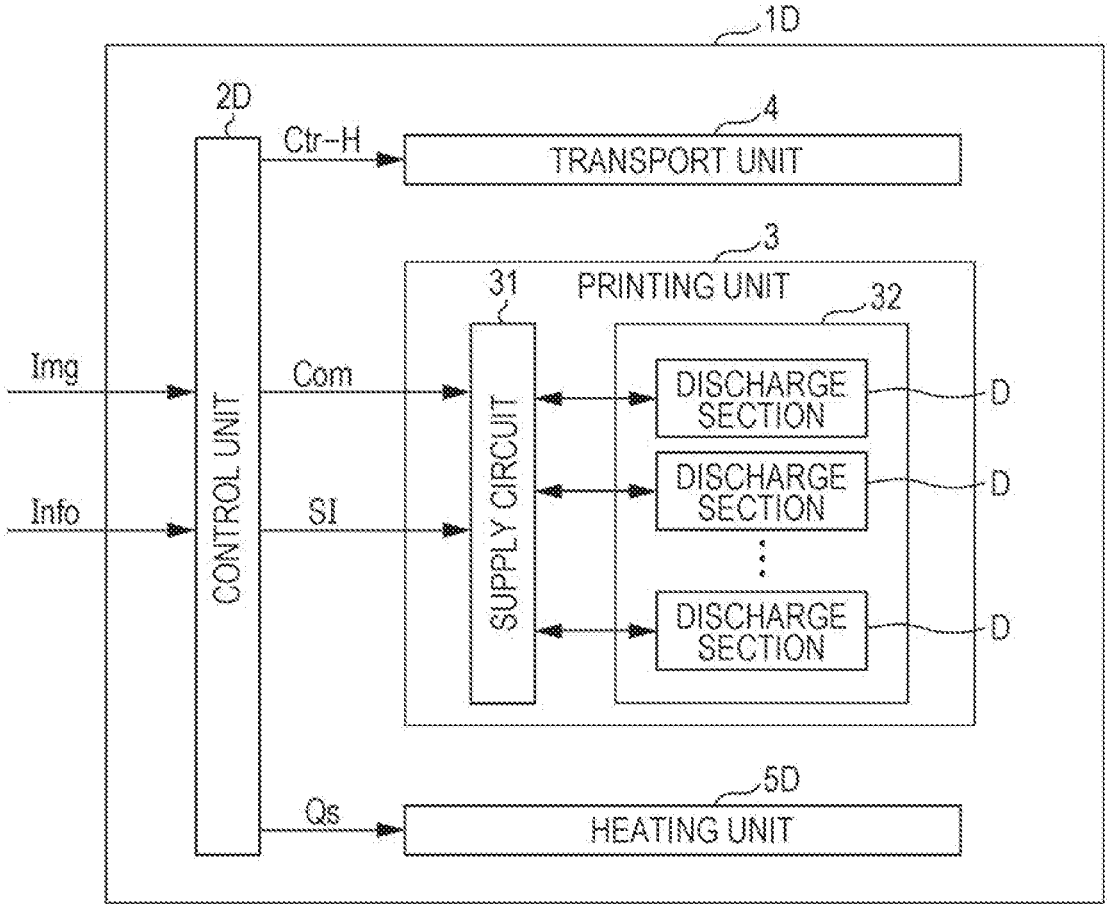
FIG. 37 is a block diagram illustrating an example of a configuration of an ink jet printer according to a fourth embodiment of the disclosure.

FIG. 37 is a functional block diagram illustrating an example of a configuration of the ink jet printer 1D.

As illustrated in FIG. 37, the ink jet printer 1D has the same configuration as that of the ink jet printer 1A except that a control unit 2D is provided instead of the control unit 2A and a heating unit 5D is provided instead of the heating unit 5A.

Figure 38:
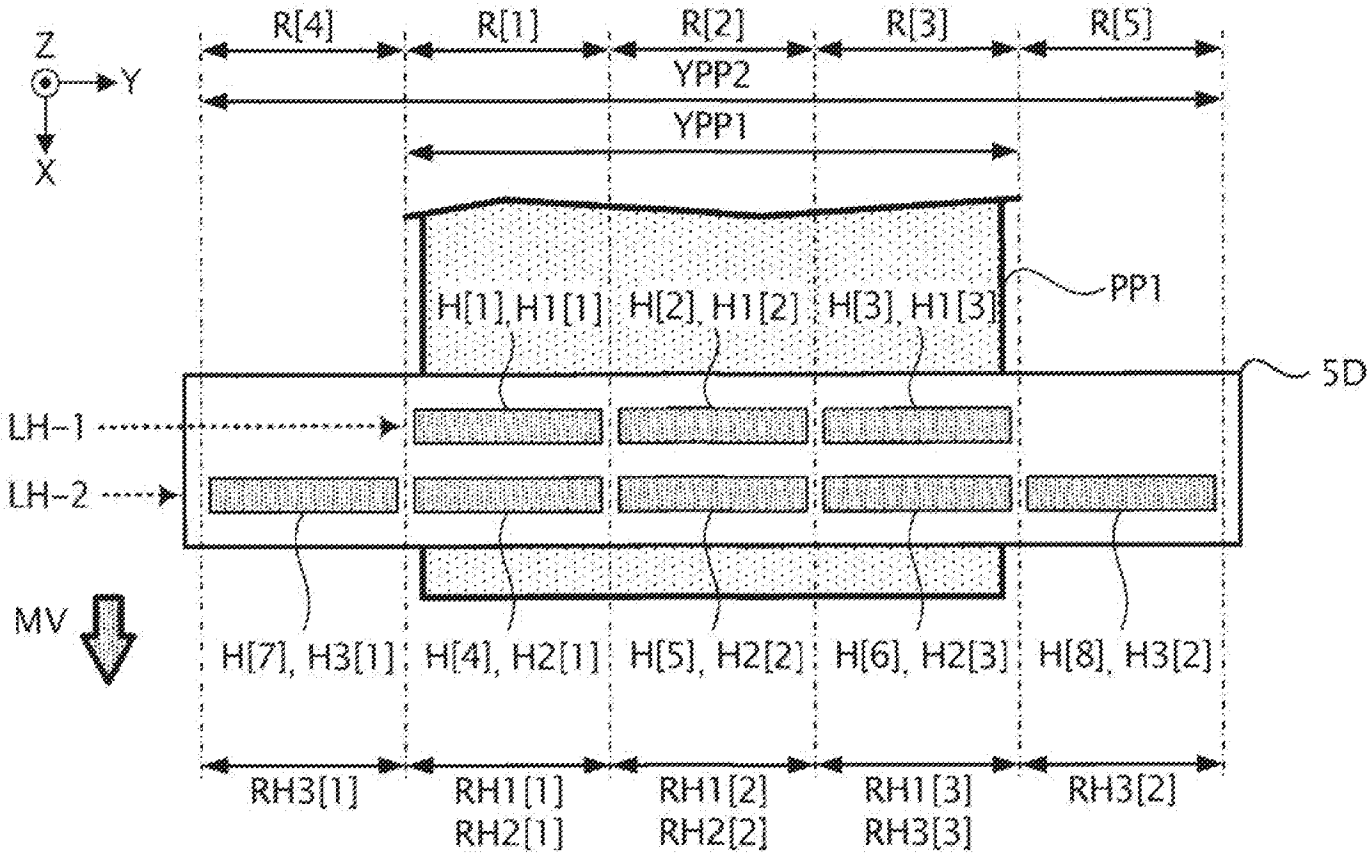
FIG. 38 is a plan view illustrating an example of a configuration of a heating unit.

FIG. 38 is a schematic view illustrating an example of a planar configuration of the ink jet printer 1D when the heating unit 5D is viewed from the +Z direction in the ink jet printer 1D.

The ink jet printer 1D according to the embodiment can execute the print processing on the recording medium PP1 in which the existence range in the Y axis direction becomes a range YPP1 when the recording medium is transported by the transport unit 4, and the recording medium PP2 in which the existence range in the Y axis direction becomes a range YPP2 when the recording medium is transported by the transport unit 4. Here, in the Y axis direction, the range YPP2 is a range including the range YPP1. In other words, the recording medium PP2 is wider in the Y axis direction than the recording medium PP1.

Although not illustrated, the ink jet printer 1D according to the embodiment is provided with M discharge sections D[1] to D[M] that extend to the range YPP2 in the printing unit 3.

As illustrated in FIG. 38, the heating unit 5D is provided with K heaters H[1] to H[K]. In the embodiment, the value K is also a natural number that satisfies "K≥3", but hereinafter, a case where the value K is "8" will be described as an example. Further, in the embodiment, the heaters H[1] to H[K] are also disposed such that the regions RH[1] to RH[K] where the heaters H[1] to H[K] exist in the Y axis direction include the range YPP2.

Further, in the embodiment, a case is assumed in which the heaters H[1] to H[K] are disposed so as to configure the heater row LH-1 that extends to the range YPP1 in the Y axis direction and the heater row LH-2 that extends to the range YPP2 in the Y axis direction.

Specifically, the heaters H[1] to H[K] are classified into N1 heaters H[k] that configure the heater row LH-1; N1 heaters H[k] that exist in the range YPP1 among the plurality of heaters H[k] that configure the heater row LH-2; and N2 heaters H[k] that exist in the range YPP2 other than the range YPP1 among the plurality of heaters H[k] that configure the heater row LH-2. Here, the value N1 and the value N2 are natural numbers that satisfy "N1≥1", "N2≥1" and "2×N1+N2=K". In the embodiment, a case where the value N1 is "3" and the value N2 is "2" will be described as an example. In addition, in the embodiment, the variable k is a natural number that satisfies "1≤k≤K".

More specifically, in the embodiment, as illustrated in FIG. 38, the heaters H[1] to H[3] configure the heater row LH-1, and the heaters H[4] to H[8] configure the heater row LH-2. In the embodiment, for example, a case is assumed in which, among the heaters H[4] to H[8], the heaters H[4] to H[6] exist in the range YPP1, and the heaters H[7] to H[8] exist in the range YPP2 other than range YPP1.

In the embodiment, for example, a case is assumed in which N1 heaters H1[n1] exist over the entire range YPP1 in the +Y direction, N1 heaters H2[n2] exist over the entire range YPP1 in the +Y direction, and N2 heaters H3[n3] exist over the entire range excluding the range YPP1 from the range YPP2 in the +Y direction.

Hereinafter, as illustrated in FIG. 38, the heaters H[k] that configure the heater row LH-1 will be referred to as a heater H1[n1], the heaters H[k] that exist in the range YPP1 among the heaters H[k] that configure the heater row LH-2 will be referred to as a heater H2[n2], and the heaters H[k] that exist in the range YPP2 other than the range YPP1 among the heaters H[k] that configure the heater row LH-2 will be referred to as a heater H3[n3]. Here, the variable n1 is a natural number that satisfies "1≤n1≤N1", the variable n2 is a natural number that satisfies "1≤n2≤N1" and the variable n3 is a natural number that satisfies "1 n3 N2".

Further, in the embodiment, the range where the M discharge sections D exist in the Y axis direction is also classified into J regions R[1] to R[J]. In the embodiment, the value J is a natural number that satisfies "N1+N2". In other words, as illustrated in FIG. 38, when the value N1 is "3" and the value N2 is "2", the value J is "5".

In the embodiment, as illustrated in FIG. 38, the regions R[1] to R[N1] are provided so as to exist in the range YPP1, and the regions R[N1+1] to R[N1+N2] are provided in the range YPP2 other than the range YPP1.

In the embodiment, for example, a case is assumed in which the heaters H[1] to H[K] are disposed such that the region RH1[n1] where the heater H1[n1] exists in the Y axis direction and the region RH2[n1] where the heater H2[n1] exists in the Y axis direction match the region R[n1], and the region RH3[n3] where the heater H3[n3] exists in the Y axis direction matches the region R[N1+n3].

In other words, in the embodiment, when viewed from the +X direction, when the variable n1 and the variable n2 match each other, the heaters H[1] to H[K] are disposed such that the region RH1[n1] where the heater H1[n1] exists and the region RH2[n2] where the heater H2[n2] exists match each other. In the embodiment, when viewed from the +X direction, the heaters H[1] to H[K] are disposed such that the region RH3[n3] where the heater H3[n3] exists does not overlap either the region RH1[n1] or the region RH2[n2].

Figure 39:
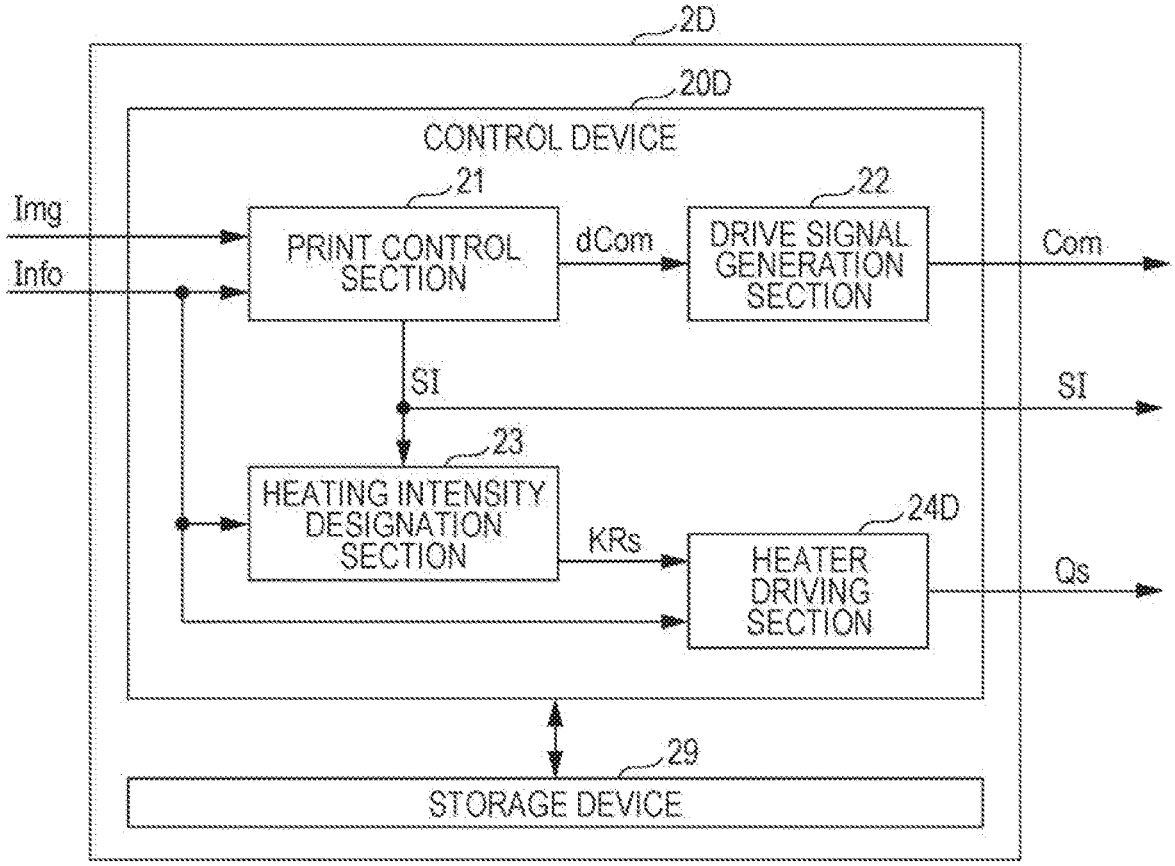
FIG. 39 is a block diagram illustrating an example of a configuration of a control unit.

FIG. 39 is a functional block diagram illustrating an example of a configuration of the control unit 2D.

As illustrated in FIG. 39, the control unit 2D is configured similarly to the control unit 2A except that a control device 20D is provided instead of the control device 20A. The control device 20D is configured similarly to the control device 20A except that a heater driving section 24D is provided instead of the heater driving section 24A.

Further, in the embodiment, the heating intensity information KRs and the print setting information Info are supplied to the heater driving section 24D. In the embodiment, the medium type information BT included in the print setting information Info includes information indicating which of the recording medium PP1 and the recording medium PP2 the recording medium PP to be subjected to the print processing corresponds to.

Although not illustrated, the storage device 29 according to the embodiment stores therein a heater heating intensity information table TBL14D instead of the heater heating intensity information table TBL14A.

Figure 40:
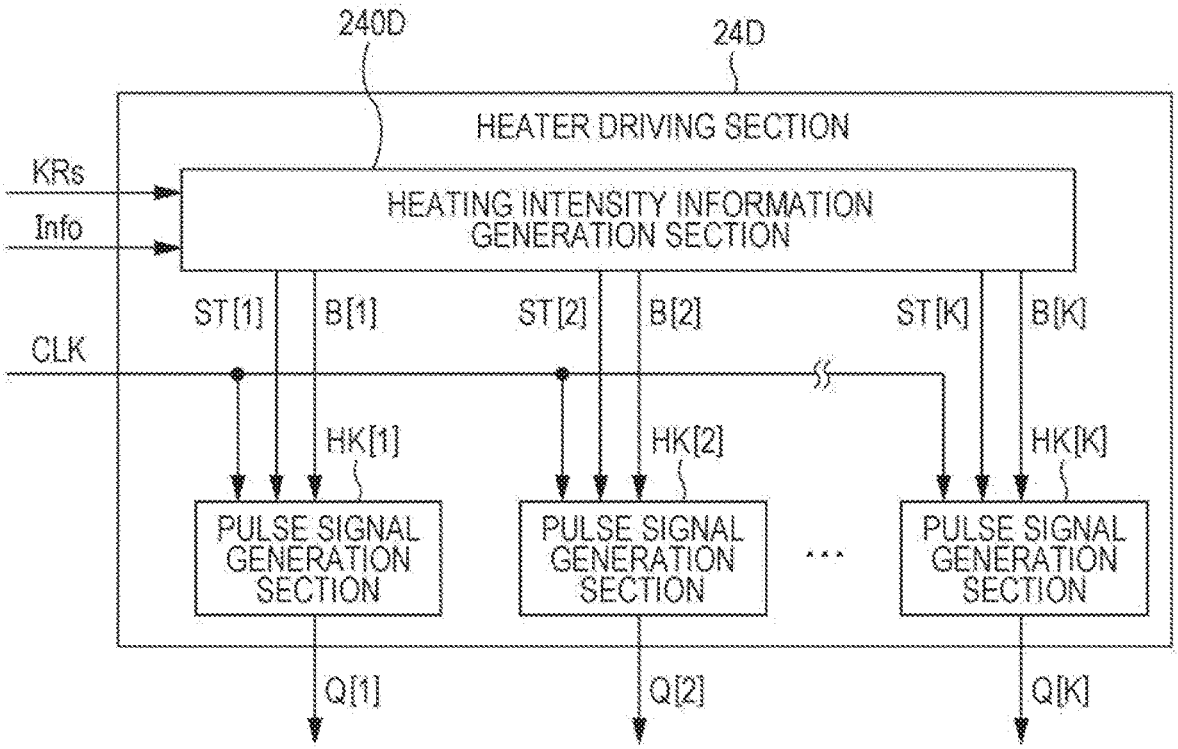
FIG. 40 is a block diagram illustrating an example of a configuration of a heater driving section.

FIG. 40 is a functional block diagram illustrating an example of a configuration of the heater driving section 24D.

As illustrated in FIG. 40, the heater driving section 24D is configured similarly to the heater driving section 24A except that a heating intensity information generation section 240D is provided instead of the heating intensity information generation section 240A.

In the embodiment, the heating intensity information generation section 240D generates the heating intensity information Bs based on the heating intensity information KRs and the medium type information BT included in the print setting information Info with reference to the heater heating intensity information table TBL14D.

FIG. 41 is an explanatory diagram for describing an example of a data configuration of the heater heating intensity information table TBL14D.

As illustrated in FIG. 41, the heater heating intensity information table TBL14D has K records that have a one-to-one correspondence with the K heaters H[1] to H[K]. Each record of the heater heating intensity information table TBL14D includes information for identifying the heater H[k], the heater corresponding region heating intensity information that is referred to when generating the heater heating intensity information B[k] when the print processing is executed on the recording medium PP1, and the heater corresponding region heating intensity information that is referred to when generating the heater heating intensity information B[k] when the print processing is executed on the recording medium PP2.

In the embodiment, the heater corresponding region heating intensity information is any one of the region heating intensity information KR[j] and the correction region heating intensity information α[j]*KR[j].

As illustrated in FIG. 41, in the embodiment, when the print processing is executed on the recording medium PP1, the heater corresponding region heating intensity information that corresponds to the heater H1[n1] is the correction region heating intensity information α[n1]*KR[n1], the heater corresponding region heating intensity information that corresponds to the heater H2[n2] is the correction region heating intensity information α[n2]*KR[n2], and the heater corresponding region heating intensity information that corresponds to the heater H3[n3] indicates "0".

Further, in the embodiment, when the print processing is executed on the recording medium PP2, the heater corresponding region heating intensity information that corresponds to the heater H1[n1] indicates "0", the heater corresponding region heating intensity information that corresponds to the heater H2[n2] is the region heating intensity information KR[n2], and the heater corresponding region heating intensity information that corresponds to the heater H3[n3] is the region heating intensity information KR[n3+N1].

The heating intensity information generation section 240D acquires the heater corresponding region heating intensity information that corresponds to the heater H[k] with reference to the heater heating intensity information table TBL14D. Then, the heating intensity information generation section 240D sets the value indicated by the region heating intensity information KR[j], or the value indicated by the correction region heating intensity information α[j]*KR[j] that indicate the acquired heater corresponding region heating intensity information, to the value indicated by the heater heating intensity information B[k] that corresponds to the heater H[k].

Specifically, when the print processing is executed on the recording medium PP1, the heating intensity information generation section 240D sets the value indicated by the heater heating intensity information B[k] that corresponds to the heater H1[n1] to a value indicated by the correction region heating intensity information α[n1]*KR[n1], sets the value indicated by the heater heating intensity information B[k] that corresponds to the heater H2[n2] to the value indicated by the correction region heating intensity information α[n2]*KR[n2], and the value indicated by the heater heating intensity information B[k] that corresponds to the heater H3[n3] is set to "0".

In addition, when the print processing is executed on the recording medium PP2, the heating intensity information generation section 240D sets the value indicated by the heater heating intensity information B[k] that corresponds to the heater H1[n1] to "0", sets the value indicated by the heater heating intensity information B[k] that corresponds to the heater H2[n2] to the value indicated by the region heating intensity information KR[n2], and the value indicated by the heater heating intensity information B[k] that corresponds to the heater H3[n3] is set to the value indicated by the region heating intensity information KR[n3+N1].

In addition, in the embodiment, the correction information α[k] is determined such that the heating amount by one heater H[k] for heating the recording medium PP at the heating intensity that corresponds to the heater heating intensity information B[k] determined based on the region heating intensity information KR[k] and the total value of the heating amount by the two heaters H[k] for heating the recording medium PP at the heating intensity that corresponds to the heater heating intensity information B[k] determined based on the correction region heating intensity information α[k]*KR[k] become substantially the same as each other.

In the embodiment, when the variable n1 is equal to the variable n2, the correction region heating intensity information α[n1]*KR[n1] that corresponds to the heater H1[n1] and the correction region heating intensity information α[n2]*KR[n2] that corresponds to the heater H2[n2] are equal to each other. In other words, when the variable n1 is equal to the variable n2, the heating amount of the recording medium PP by the heater H1[n1] is substantially the same as the heating amount of the recording medium PP by the heater H2[n2].

However, in the embodiment, when the variable n1 is equal to the variable n2, the heating amount of the recording medium PP by the heater H1[n1] is different from the heating amount of the recording medium PP by the heater H2[n2]. For example, when the correction region heating intensity information that corresponds to the heater H1[n1] is α1[n1]*KR[n1] and the correction region heating intensity information that corresponds to the heater H2[n2] is α2[n2]*KR[n2], when the variable n1 is equal to the variable n2, the correction region heating intensity information α1[n1]*KR[n1] and the correction region heating intensity information α2[n2]*KR[n2] may be different from each other. In this case, the correction information α1[k] and the correction information α2[k] may be determined such that the heating amount by one heater H[k] for heating the recording medium PP at the heating intensity that corresponds to the heater heating intensity information B[k] determined based on the region heating intensity information KR[n1], the heating amount by the heater H[k] for heating the recording medium PP at the heating intensity that corresponds to the heater heating intensity information B[k] determined based on the correction region heating intensity information α1[n1]*KR[n1], and the total value of the heating amount by the heaters H[k] for heating the recording medium PP at the heating intensity that corresponds to the heater heating intensity information B[k] determined based on the correction region heating intensity information α2[n2]*KR[n2] become substantially the same as each other.

Further, in the embodiment, when executing the print processing on the recording medium PP2, the value indicated by the heater heating intensity information B[k] that corresponds to the heater H1[n1] is set to "0", and the value indicated by the heater heating intensity information B[k] that corresponds to the heater H2[n2] is set to the value indicated by the region heating intensity information KR[n2]. In other words, in the embodiment, when performing printing on the recording medium PP2, the heater H2[n2] is used without using the heater H1[n1]. However, for example, when performing printing on the recording medium PP2, an aspect in which the heater H1[n1] is used without using the heater H2[n2] may be employed. In this case, the value indicated by the heater heating intensity information B[k] that corresponds to the heater H1[n1] is set to KR[n1], and the value indicated by the heater heating intensity information B[k] that corresponds to the heater H2[n2] is set to the value indicated by the region heating intensity information "0". Further, an aspect in which the heater H2[n2] is used without using the heater H1[n1] and an aspect in which the heater H1[n1] is used without using the heater H2[n2] may be switched for each page or for each job.

In the embodiment, the positions of the plurality of heaters H1[n1] in the X axis direction are the same as each other, and the positions of the plurality of heaters H2[n2] and the plurality of heaters H3[n3] in the X axis direction are the same as each other, but the disclosure is not limited to such an aspect.

For example, among the plurality of heaters H1[n1], the plurality of heaters H1[n1] may be arranged such that the position of one heater H1[n1] in the X axis direction is different from the position of another heater H1[n1] in the X axis direction. Further, for example, among the plurality of heaters H2[n2] and the plurality of heaters H3[n3], the plurality of heaters H2[n2] and the plurality of heaters H3[n3] may be arranged such that the position of one heater H[k] in the X axis direction is different from the position of another heater H[k] in the X axis direction.

Hereinafter, in order to clarify the effect according to the embodiment, "Reference Example 2" in which the heating unit 5D includes only the heater row LH-2 without the heater row LH-1, will be described.

In Reference Example 2, when the print processing is executed on the recording medium PP1, the ink discharged to the recording medium PP1 is heated by the heater H2[n2], and when the print processing is executed on the recording medium PP2, the ink discharged to the recording medium PP2 is heated by the heater H2[n2] and the heater H3[n3]. In other words, in Reference Example 2, the heater H2[n2] is used more frequently than the heater H3[n3]. Therefore, in Reference Example 2, the heater H2[n2] has a higher deterioration speed than that of the heater H3[n3], and as a result, the possibility that the heating unit 5D deteriorates earlier increases.

On the other hand, in the embodiment, when the print processing is executed on the recording medium PP1, the heater H1[n1] and the heater H2[n2] heat the ink discharged to the recording medium PP1 in cooperation with each other, and when the print processing is executed on the recording medium PP2, the heater H2[n2] and the heater H3[n3] heat the ink discharged to the recording medium PP2. In other words, according to the embodiment, it becomes possible to reduce the frequency of use of the heater H2[n2] compared to Reference Example 2. Therefore, according to the embodiment, it becomes possible to reduce the deterioration speed of the heater H2[n2] compared to Reference Example 2, and as a result, to realize long service life of the heating unit 5D.

4.2. Summary of Fourth Embodiment

As described above, the ink jet printer 1D according to the embodiment that can form an image on the plurality of types of recording media PP including the recording medium PP1 and the recording medium PP2 wider in the +Y direction than the recording medium PP1, includes: the transport unit 4 that transports the recording medium PP in the +X direction; the printing unit 3 that makes ink adhere to the recording medium PP transported by the transport unit 4; and the heating unit 5D provided on the +X side of the printing unit 3, the heating unit 5D includes the plurality of heaters H[1] to H[K] such as the plurality of heaters H1[n1] that extend to the range YPP1 where the recording medium PP1 exists in the +Y direction when the transport unit 4 transports the recording medium PP1 and heat the recording medium PP, and the plurality of heaters H2[n2] and the plurality of heaters H3[n3] that extend to the range YPP2 where the recording medium PP2 exists in the +Y direction when the transport unit 4 transports the recording medium PP2 and heat the recording medium PP, and the range YPP2 includes the range YPP1.

In other words, according to the embodiment, when the print processing is executed on the recording medium PP1, the heater H1[n1] and the heater H2[n2] can heat the ink discharged to the recording medium PP1 in cooperation with each other, and when the print processing is executed on the recording medium PP2, the heater H2[n2] and the heater H3[n3] can heat the ink discharged to the recording medium PP2. In other words, according to the embodiment, when the print processing is executed on the recording medium PP1, it becomes possible to heat the ink discharged to the recording medium PP1 only by the heater H2[n2], and when the print processing is executed on the recording medium PP2, it becomes possible to suppress the heating amount by the heater H2[n2] to be lower compared to Reference Example 2 in which the ink discharged to the recording medium PP2 is heated by the heater H2[n2] and the heater H3[n3]. Therefore, according to the embodiment, it becomes possible to reduce the deterioration speed of the heater H2[n2] compared to Reference Example 2, and as a result, to realize long service life of the heating unit 5D.

Further, in the ink jet printer 1D according to the embodiment, the control unit 2D individually controls heating of the recording medium PP by each of the plurality of heaters H[1] to H[K].

Therefore, in the embodiment, it becomes possible to heat the recording medium PP at the individual heating intensity for each of the regions RH[1] to RH[K]. Accordingly, according to the embodiment, it becomes possible both to reliably dry the ink discharged to the recording medium PP and to reduce the damage to the recording medium PP due to the heat when drying the ink discharged to the recording medium PP.

In addition, in the ink jet printer 1D according to the embodiment, when the print processing is executed on the recording medium PP2, the control unit 2D heats the recording medium PP2 by the plurality of heaters H2[n2], and the heating of the recording medium PP2 by the plurality of heaters H1[n1] is restricted.

In other words, in the embodiment, when the print processing is executed on the recording medium PP2, the recording medium PP2 can be heated by the plurality of heaters H2[n2] and the plurality of heaters H3[n3]. Therefore, in the embodiment, compared to an aspect in which the recording medium PP2 is heated by the plurality of heaters H1[n1] and the plurality of heaters H3[n3], it is possible to reduce variations in the distances from the printing unit 3 to the heater H[k] that heats to the recording medium PP2. Accordingly, in the embodiment, when the print processing is executed on the recording medium PP2, it becomes possible to suppress deterioration in print quality due to heating unevenness.

However, when performing the print processing on the recording medium PP2, it is not always necessary to consider heating unevenness caused by the distance from the printing unit 3 to the heater H[k] that heats the recording medium PP2. In this case, for example, when performing printing on the recording medium PP2, heating may be shared using both the heaters H1[n1] and H2[n2].

In addition, in the ink jet printer 1D according to the embodiment, when the print processing is executed on the recording medium PP2, the control unit 2D heats the recording medium PP2 by one heater H[k] from the heater H1[n1] and the heater H2[n2] having the same position in the Y axis direction, and restricts the heating of the recording medium PP2 by the other heater H[k].

For example, when the recording medium PP2 is shared and heated using both the heater H1[n1] and the heater H2[n2] having the same position in the Y axis direction, the end portion of the recording medium PP2 positioned in the range YPP2 other than the range YPP1 in the recording medium PP2 is heated by one heater H[k], and the center portion of the recording medium PP2 positioned in the range YPP1 in the recording medium PP2 is heated by the plurality of heaters H[k]. In this case, a difference occurs in the fixing time and the like between the end portion and the center portion of the recording medium PP2, and there is a concern that the heating unevenness occurs between the end portion and the center portion of the recording medium PP2.

On the other hand, from the heater H1[n1] and the heater H2[n2] having the same position in the Y axis direction, when the recording medium PP2 is heated by one heater H[k] and the heating of the recording medium PP2 by the other heater H[k] is restricted, any of the end portion and the center portion of the recording medium PP2 is heated by one heater H[k], and thus, compared to an aspect in which the recording medium PP2 is shared and heated using both the heater H1[n1] and the heater H2[n2] having the same position in the Y axis direction, it is possible to reduce the heating unevenness between the end portion and the center portion of the recording medium PP.

Further, in the ink jet printer 1D according to the embodiment, when the print processing is executed on the recording medium PP1, among the plurality of heaters H[k] positioned in the range YPP1, the number of heaters H[k] that heat the recording medium PP1 is larger than the number of heaters H[k] that heat the recording medium PP2 among the plurality of heaters H[k] positioned in the range YPP1 when the print processing is executed on the recording medium PP2.

Therefore, in the embodiment, when the print processing is executed on the recording medium PP2, the heating by some heaters H[k] among the plurality of heaters H[k] positioned in the range YPP1 can be restricted. Accordingly, in the embodiment, compared to an aspect in which some of the heaters H[k] are used for heating the recording medium PP both when the print processing is executed on the recording medium PP1 and when the print processing is executed on the recording medium PP2, it becomes possible to suppress the operating rate of some of the heaters H[k] to be lower. Therefore, according to the embodiment, it becomes possible to reduce the deterioration speed of some of the heaters H[k], and as a result, to realize long service life of the heating unit 5D.

In addition, in the ink jet printer 1D according to the embodiment, when the print processing is executed on the recording medium PP1, the control unit 2D heats the recording medium PP1 by the plurality of heaters H1[n1] and by the plurality of heaters H2[n2].

Therefore, in the embodiment, when the print processing is executed on the recording medium PP1, compared to an aspect in which only one of the plurality of heaters H1[n1] or the plurality of heaters H2[n2] is used, it becomes possible to dry the ink discharged to the recording medium PP1 more quickly.

In addition, the ink jet printer 1D according to the embodiment that can form an image by making the ink adhere to the plurality of types of recording media PP including the recording medium PP1 and the recording medium PP2 wider in the +Y direction than the recording medium PP1, includes: the transport unit 4 that transports the recording medium PP in the +X direction; the printing unit 3 that makes ink adhere to the recording medium PP transported by the transport unit 4; and the heating unit 5D provided on the +X side of the printing unit 3, the heating unit 5D includes the plurality of heaters H[1] to H[K] such as the plurality of heaters H1[n1] and the plurality of heaters H2[n2] that correspond to the range YPP1 where the recording medium PP1 exists in the +Y direction when the transport unit 4 transports the recording medium PP1 and the recording medium PP2 exists in the +Y direction when the transport unit 4 transports the recording medium PP2 and heat the recording medium PP, and the plurality of heaters H3[n3] that correspond to the range excluding the range YPP1 from the range YPP2 where the recording medium PP1 does not exist in the +Y direction when the transport unit 4 transports the recording medium PP1 and the recording medium PP2 exists in the +Y direction when the transport unit 4 transports the recording medium PP2, and heat the recording medium PP, and the number of heaters H[k] that exist at the same position in the +Y direction among the plurality of heaters H1[n1] and the plurality of heaters H2[n2] is larger than the number of heaters H[k] that exist at the same position in the +Y direction among the plurality of heaters H3[n3].

In other words, according to the embodiment, when the print processing is executed on the recording medium PP1, the heater H1[n1] and the heater H2[n2] can heat the ink discharged to the recording medium PP1 in cooperation with each other, and when the print processing is executed on the recording medium PP2, the heater H1[n1] or the heater H2[n2] and the heater H3[n3] can heat the ink discharged to the recording medium PP2. In other words, according to the embodiment, when the print processing is executed on the recording medium PP1, it becomes possible to heat the ink discharged to the recording medium PP1 only by the heater H2[n2], and when the print processing is executed on the recording medium PP2, it becomes possible to suppress the heating amount by the heater H2[n2] to be lower compared to Reference Example 2 in which the ink discharged to the recording medium PP2 is heated by the heater H2[n2] and the heater H3[n3]. Therefore, according to the embodiment, it becomes possible to reduce the deterioration speed of the heater H2[n2] compared to Reference Example 2, and as a result, to realize long service life of the heating unit 5D.

5. Fifth Embodiment

Hereinafter, an ink jet printer 1E according to the embodiment will be described with reference to FIGS. 42 to 47. In the ink jet printer 1E according to the embodiment, the heater H[k] is movable. Further, similar to the ink jet printer 1D according to the fourth embodiment, the ink jet printer 1E according to the embodiment can execute the print processing on the plurality of types of recording media PP including the recording medium PP1 and the recording medium PP2 having sizes different from each other.

5.1. Ink Jet Printer According to Fifth Embodiment

Figure 42:
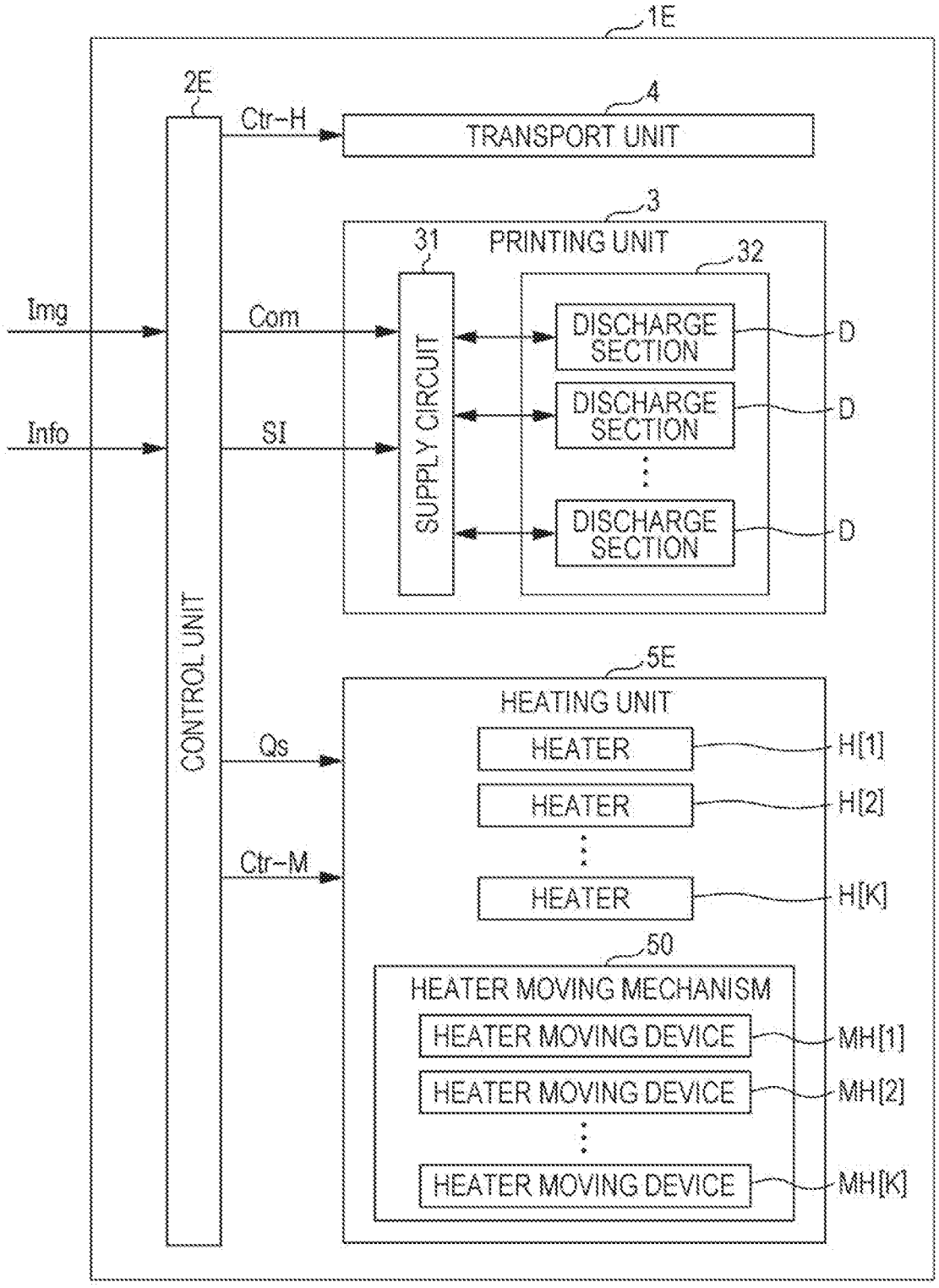
FIG. 42 is a block diagram illustrating an example of a configuration of an ink jet printer according to a fifth embodiment of the disclosure.

FIG. 42 is a functional block diagram illustrating an example of a configuration of the ink jet printer 1E.

As illustrated in FIG. 42, the ink jet printer 1E has the same configuration as that of the ink jet printer 1A except that a control unit 2E is provided instead of the control unit 2A and a heating unit 5E is provided instead of the heating unit 5A.

As illustrated in FIG. 42, the heating unit 5E includes the K heaters H[1] to H[K] and a heater moving mechanism 50 for changing the positions of the K heaters H[1] to H[K]. In addition, in the embodiment, the value K is also a natural number that satisfies "K≥2", but hereinafter, a case where the value K is "2" will be described as an example.

As illustrated in FIG. 42, the heater moving mechanism 50 includes K heater moving devices MH[1] to MH[K] that have a one-to-one correspondence with the K heaters H[1] to H[K]. Among the devices, the heater moving device MH[k] moves the position of the heater H[k] based on a position designation signal Ctr-M supplied from the control unit 2E. Here, the variable k is a natural number that satisfies "1≤k≤K".

Figure 43:
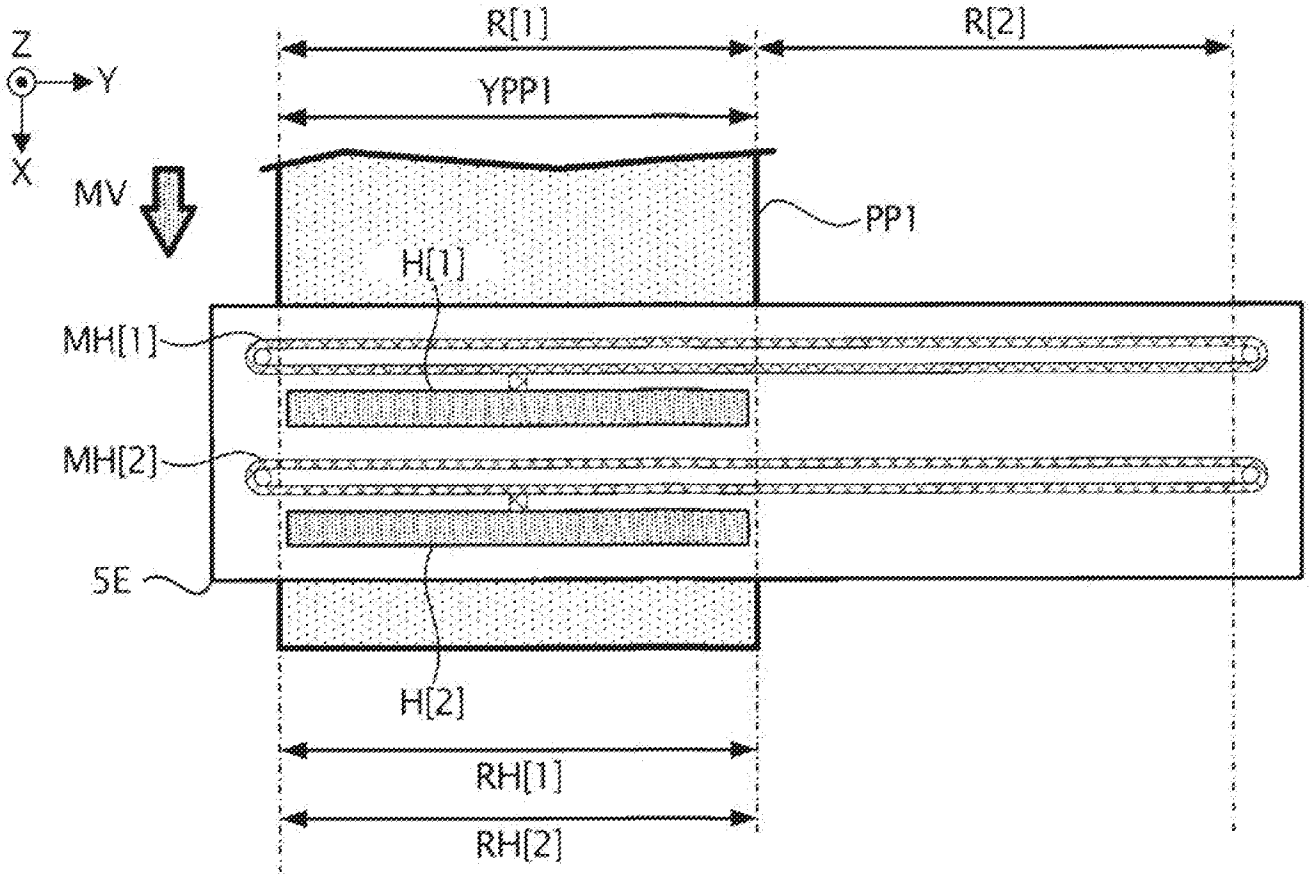
FIG. 43 is a plan view illustrating an example of a configuration of a heating unit.
Figure 44:
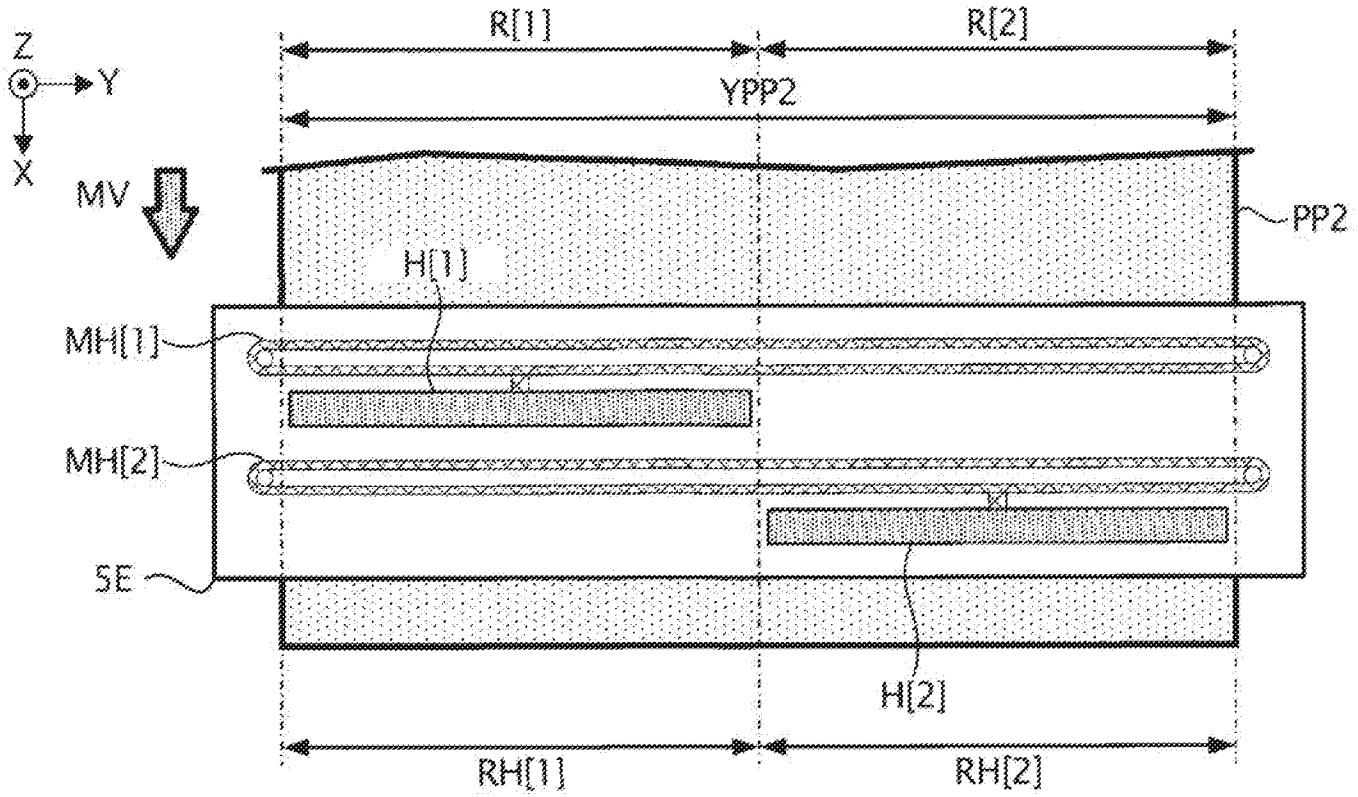
FIG. 44 is a plan view illustrating an example of a configuration of the heating unit.

FIGS. 43 and 44 are schematic views illustrating an example of a planar configuration of the ink jet printer 1E when the heating unit 5E is viewed from the +Z direction in the ink jet printer 1E.

The ink jet printer 1E according to the embodiment can execute the print processing on the recording medium PP1 in which the existence range in the Y axis direction becomes the range YPP1 when the recording medium is transported by the transport unit 4, and the recording medium PP2 in which the existence range in the Y axis direction becomes the range YPP2 when the recording medium is transported by the transport unit 4. Here, in the Y axis direction, the range YPP2 is a range including the range YPP1. In other words, the recording medium PP2 is wider in the Y axis direction than the recording medium PP.

Although not illustrated, the ink jet printer 1E according to the embodiment is provided with the M discharge sections D[1] to D[M] that extend to the range YPP2 in the printing unit 3.

Further, in the embodiment, the range where the M discharge sections D exist in the Y axis direction is also classified into J regions R[1] to R[J]. In the embodiment, the value K is a natural number that satisfies "J≥2". Hereinafter, a case where the value J is "2" will be described as an example.

More specifically, in the embodiment, as illustrated in FIGS. 43 and 44, for example, a case is assumed in which the region R[1] is provided so as to match the range YPP1 and the region R[2] is provided so as to match a range other than the range YPP1 in the range YPP2.

As illustrated in FIG. 43, when the ink jet printer 1E executes the print processing on the recording medium PP1, the heater moving device MH[1] disposes the heater H[1] such that the region RH[1] where the heater H[1] exists matches the region R[1], and the heater moving device MH[2] disposes the heater H[2] such that the region RH[2] where the heater H[2] exists matches the region R[1]. In other words, when the ink jet printer 1E executes the print processing on the recording medium PP1, both the region RH[1] where the heater H[1] exists and the region RH[2] where the heater H[2] exists become the region R[1].

As illustrated in FIG. 44, when the ink jet printer 1E executes the print processing on the recording medium PP2, the heater moving device MH[1] disposes the heater H[1] such that the region RH[1] where the heater H[1] exists matches the region R[1], and the heater moving device MH[2] disposes the heater H[2] such that the region RH[2] where the heater H[2] exists matches the region R[2]. In other words, when the ink jet printer 1E executes the print processing on the recording medium PP2, the heater H[1] and the heater H[2] are disposed such that both the region RH[1] where the heater H[1] exists and the region RH[2] where the heater H[2] exists include the range YPP2.

In addition, in the embodiment, the heater H[k] has a rectangular shape having a long side that extends in the Y axis direction and a short side that extends in the X axis direction when viewed from the Z axis direction. In other words, in the embodiment, the heater H[k] is provided so as to extend in the Y axis direction.

Figure 45:
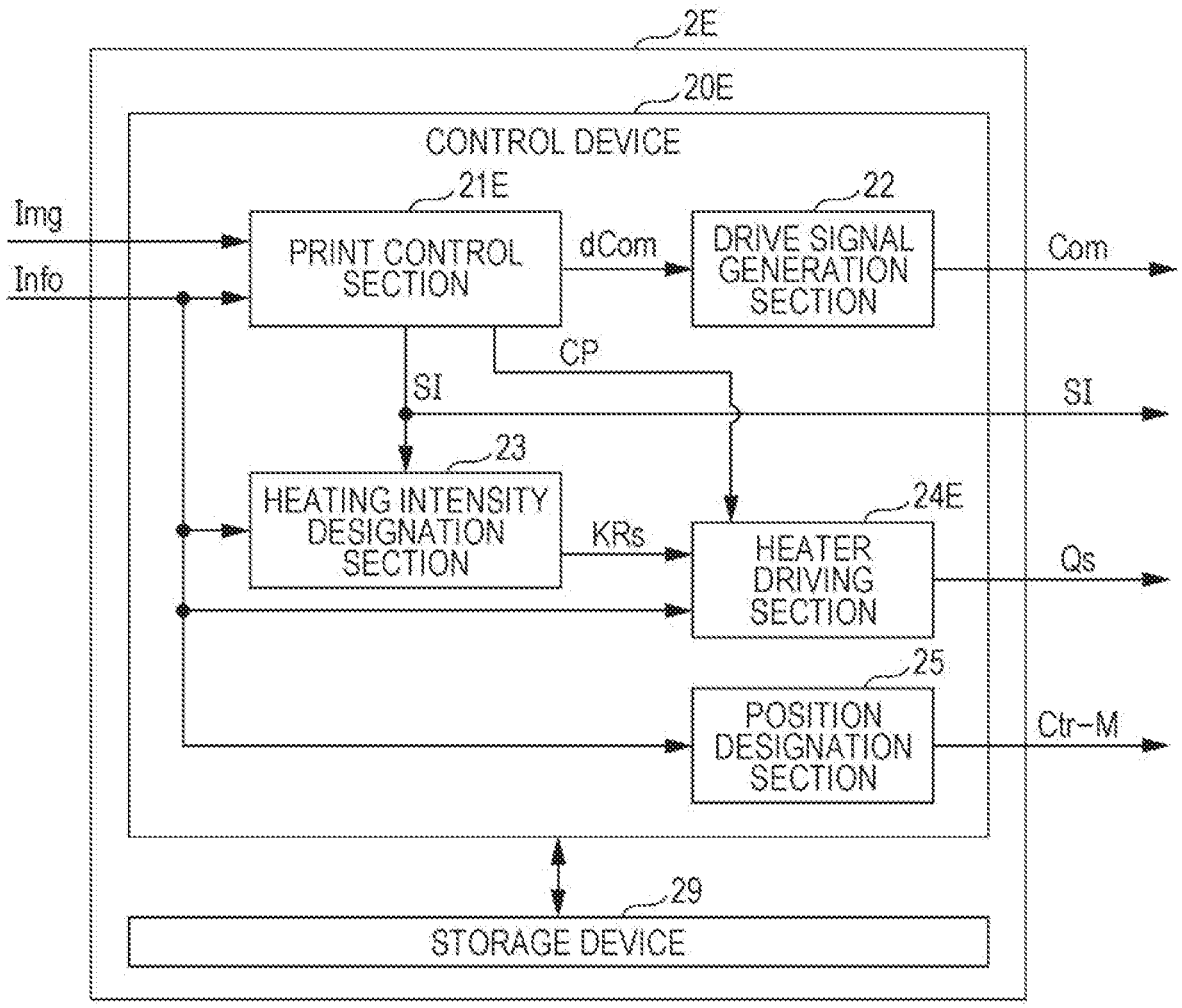
FIG. 45 is a block diagram illustrating an example of a configuration of a control unit.

FIG. 45 is a functional block diagram illustrating an example of a configuration of the control unit 2E.

As illustrated in FIG. 45, the control unit 2E is configured similarly to the control unit 2A except that a control device 20E is provided instead of the control device 20A. In addition, the control device 20E has the same configuration as that of the control device 20A except that a position designation section 25 is provided, that a print control section 21E is provided instead of the print control section 21, and that a heater driving section 24E is provided instead of the heater driving section 24A.

Although not illustrated, the storage device 29 according to the embodiment stores therein a heater heating intensity information table TBL14E instead of the heater heating intensity information table TBL14A.

The print control section 21E has the same function as the print control section 21 except that print page information CP is generated. Here, the print page information CP is information that indicates the number of the images formed by the ink jet printer 1E among the images of which the number is indicated by the copy number information BJ when the ink jet printer 1E executes the print job.

The position designation section 25 is supplied with the print setting information Info. In the embodiment, the medium type information BT included in the print setting information Info includes information indicating which of the recording medium PP1 and the recording medium PP2 the recording medium PP to be subjected to the print processing corresponds to.

When the medium type information BT indicates that the recording medium PP to be subjected to the print processing is the recording medium PP1, the position designation section 25 designates that the region RH[1] where the heater H[1] exists matches the region R[1] to the heater moving device MH[1], and supplies the position designation signal Ctr-M for designating that the region RH[2] where the heater H[2] exists matches the region R[1] to the heater moving device MH[2] with respect to the heater moving mechanism 50. In addition, when the medium type information BT indicates that the recording medium PP to be subjected to the print processing is the recording medium PP2, the position designation section 25 designates that the region RH[1] where the heater H[1] exists matches the region R[1] to the heater moving device MH[1], and supplies the position designation signal Ctr-M for designating that the region RH[2] where the heater H[2] exists matches the region R[2] to the heater moving device MH[2] with respect to the heater moving mechanism 50.

Further, in the embodiment, the heating intensity information KRs, the print setting information Info, and the print page information CP are supplied to the heater driving section 24E.

Figure 46:
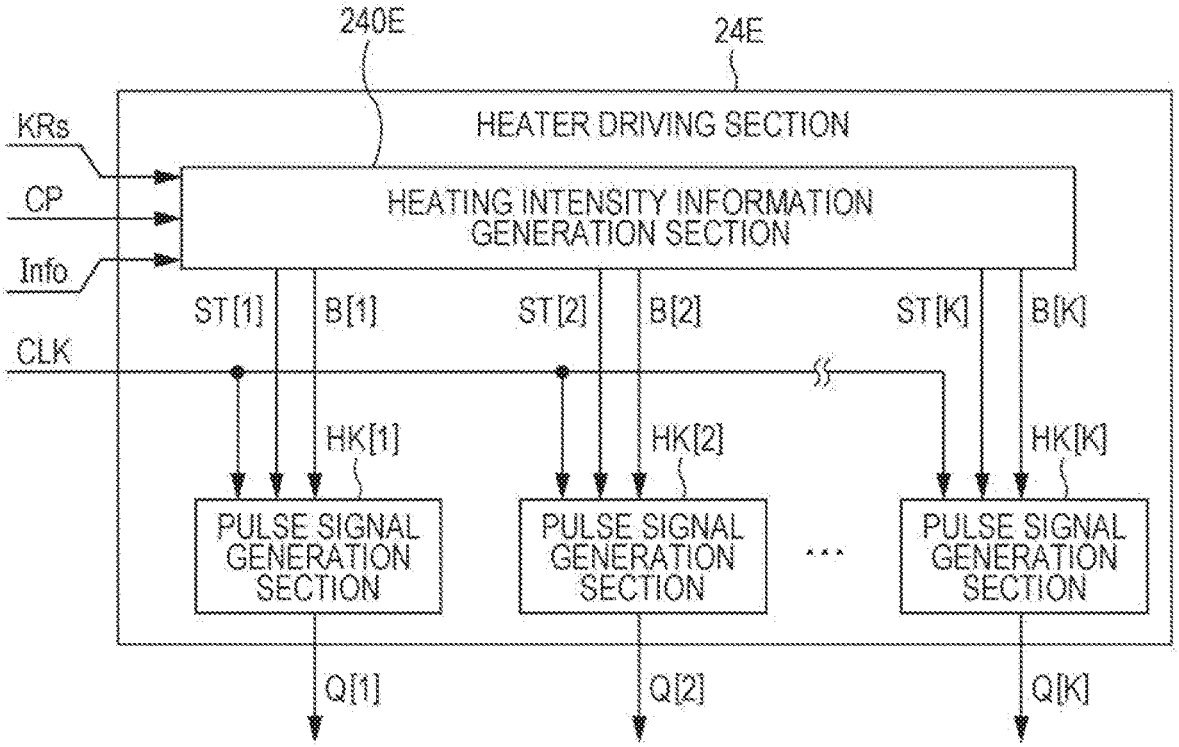
FIG. 46 is a block diagram illustrating an example of a configuration of a heater driving section.

FIG. 46 is a functional block diagram illustrating an example of a configuration of the heater driving section 24E.

As illustrated in FIG. 46, the heater driving section 24E is configured similarly to the heater driving section 24A except that a heating intensity information generation section 240E is provided instead of the heating intensity information generation section 240A.

In the embodiment, the heating intensity information generation section 240E generates the heating intensity information Bs based on the heating intensity information KRs, the medium type information BT included in the print setting information Info, and the print page information CP with reference to the heater heating intensity information table TBL14E.

FIG. 47 is an explanatory diagram for describing an example of a data configuration of the heater heating intensity information table TBL14E.

As illustrated in FIG. 47, the heater heating intensity information table TBL14E has K records that have a one-to-one correspondence with the K heaters H[1] to H[K]. Each record of the heater heating intensity information table TBL14E includes information for identifying the heater H[k] and the heater corresponding region heating intensity information that is referred to when generating the heater heating intensity information B[k].

As illustrated in FIG. 47, in the embodiment, when the medium type information BT indicates that the print processing for the recording medium PP1 is executed, and when the print page information CP indicates that an odd number of images are formed in the print processing, the heater corresponding region heating intensity information that corresponds to the heater H[1] is the region heating intensity information KR[1], and the heater corresponding region heating intensity information that corresponds to the heater H[2] indicates "0".

In addition, in the embodiment, when the medium type information BT indicates that the print processing for the recording medium PP1 is executed, and when the print page information CP indicates that an even number of images are formed in the print processing, the heater corresponding region heating intensity information that corresponds to the heater H[1] indicates "0", and the heater corresponding region heating intensity information that corresponds to the heater H[2] is the region heating intensity information KR[1].

Further, in the embodiment, when the medium type information BT indicates that the print processing for the recording medium PP2 is executed, the heater corresponding region heating intensity information that corresponds to the heater H[1] is the region heating intensity information KR[1], and the heater corresponding region heating intensity information that corresponds to the heater H[2] is the region heating intensity information KR[2].

The heating intensity information generation section 240E acquires the heater corresponding region heating intensity information that corresponds to the heater H[k] with reference to the heater heating intensity information table TBL14E. Then, the heating intensity information generation section 240E sets the value indicated by the acquired heater corresponding region heating intensity information to the value indicated by the heater heating intensity information B[k] that corresponds to the heater H[k].

In addition, when the print processing is executed on the recording medium PP1, and when an odd number of images are formed in the print processing, the heating intensity information generation section 240E sets the value indicated by the heater heating intensity information B[k] that corresponds to the heater H[1] to the value indicated by the region heating intensity information KR[1], and sets the value indicated by the heater heating intensity information B[k] that corresponds to the heater H[2] to "0".

In addition, when the print processing is executed on the recording medium PP1, and when an even number of images are formed in the print processing, the heating intensity information generation section 240E sets the value indicated by the heater heating intensity information B[k] that corresponds to the heater H[1] to "0", and sets the value indicated by the heater heating intensity information B[k] that corresponds to the heater H[2] to the value indicated by the region heating intensity information KR[1].

In addition, when the print processing is executed on the recording medium PP2, the heating intensity information generation section 240E sets the value indicated by the heater heating intensity information B[k] that corresponds to the heater H[1] to the value indicated by the region heating intensity information KR[1], and sets the value indicated by the heater heating intensity information B[k] that corresponds to the heater H[2] to the value indicated by the region heating intensity information KR[2].

As described above, in the embodiment, when the print processing is executed on the recording medium PP1, the heater H[1] and the heater H[2] are alternately used for each image formed by the ink jet printer 1E, and the ink discharged to the recording medium PP1 is heated. Therefore, in the embodiment, for example, when the print processing is executed on the recording medium PP1, compared to an aspect in which the ink discharged to the recording medium PP1 is heated using only the heater H[1], it is possible to reduce the frequency of use of the heater H[1]. Accordingly, in the embodiment, it becomes possible to reduce the deterioration speed of the heater H[1], and as a result, to realize long service life of the heating unit 5E.

5.2. Summary of Fifth Embodiment

As described above, the ink jet printer 1E according to the embodiment includes: the transport unit 4 that transports the recording medium PP in the +X direction; the printing unit 3 that discharges ink to the recording medium PP transported by the transport unit 4; the heating unit 5E that is provided on the +X side of the printing unit 3 and heats the recording medium PP transported by the transport unit 4; and the control unit 2E that controls the heating unit 5E, the heating unit 5E includes the heater H[1] that extends in the +Y direction and generates heat in accordance with the control by the control unit 2E, and the heater H[2] that extends in the +Y direction and generates heat in accordance with the control by the control unit 2E, and the control unit 2E heats the recording medium PP1 by the heater H[1] and limits the generation of heat of the heater H[2] when the transport unit 4 transports the recording medium PP1 that extends in the range YPP1 in the +Y direction during the period when the print page information CP indicates an odd number, and heats the recording medium PP1 by the heater H[2] and restricts the generation of heat by the heater H[1] when the recording medium PP transported by the transport unit 4 is the recording medium PP1 during the period when the print page information CP indicates an even number.

As described above, in the embodiment, when the print processing is executed on the recording medium PP1, the heater H[1] and the heater H[2] are alternately used, and the ink discharged to the recording medium PP1 is heated. Therefore, in the embodiment, for example, when the print processing is executed on the recording medium PP1, compared to an aspect in which the ink discharged to the recording medium PP1 is heated using only the heater H[1], it is possible to reduce the frequency of use of the heater H[1]. Accordingly, in the embodiment, it becomes possible to reduce the deterioration speed of the heater H[1], and as a result, to realize long service life of the heating unit 5E.

Further, the ink jet printer 1E according to the embodiment includes the heater moving mechanism 50 that moves the heater H[1] and the heater H[2].

Therefore, in the embodiment, it becomes possible to dispose the heater H[1] and the heater H[2] in accordance with the size of the recording medium PP to be subjected to print processing by the ink jet printer 1E.

5.3. Modification Example of Fifth Embodiment

Specific modifications according to the embodiment will be described below. Two or more aspects selected in any manner from the plurality of aspects described in the specification can be appropriately combined with each other within a range not inconsistent with each other.

Modification Example 5.1

In the above-described fifth embodiment, when the ink jet printer 1E executes the print processing on the recording medium PP1, both the heater H[1] and the heater H[2] are positioned in the range YPP1 where the recording medium PP1 exists, but the disclosure is not limited to such an aspect.

For example, when the ink jet printer 1E executes the print processing on the recording medium PP1, the heater H[k] which is not used for heating the recording medium PP1 from the heater H[1] and the heater H[2] may be moved to be separated from the recording medium PP1.

In the modification example, the print setting information Info including the medium type information BT and the print page information CP are supplied to the position designation section 25.

Figure 48:
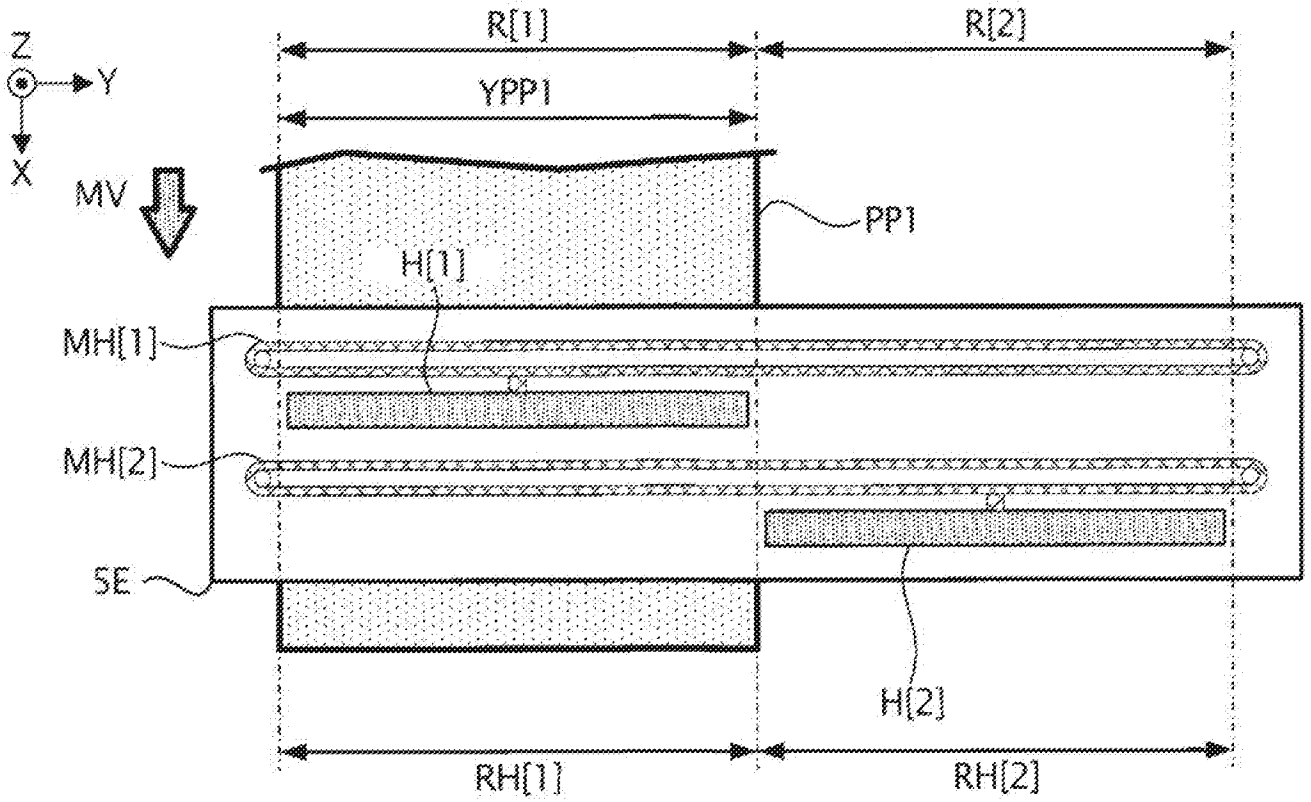
FIG. 48 is a plan view illustrating an example of a configuration of a heating unit according to Modification Example 5.1.

In addition, when the medium type information BT indicates that the print processing for the recording medium PP1 is executed, and when the print page information CP forms an odd number of images in the print processing, as illustrated in FIG. 48, the position designation section 25 designates that the region RH[1] where the heater H[1] exists matches the region R[1] to the heater moving device MH[1], and supplies the position designation signal Ctr-M for designating that the region RH[2] where the heater H[2] exists matches the region R[2] to the heater moving device MH[2] with respect to the heater moving mechanism 50. In addition, in a case illustrated in FIG. 48, the heating intensity information generation section 240E heats the recording medium PP1 by the heater H[1] by setting the value indicated by the heater heating intensity information B[k] that corresponds to the heater H[1] to the value indicated by the region heating intensity information KR[1], and stops the generation of heat by the heater H[2] by setting the value indicated by the heater heating intensity information B[k] that corresponds to the heater H[2] to "0".

Figure 49:
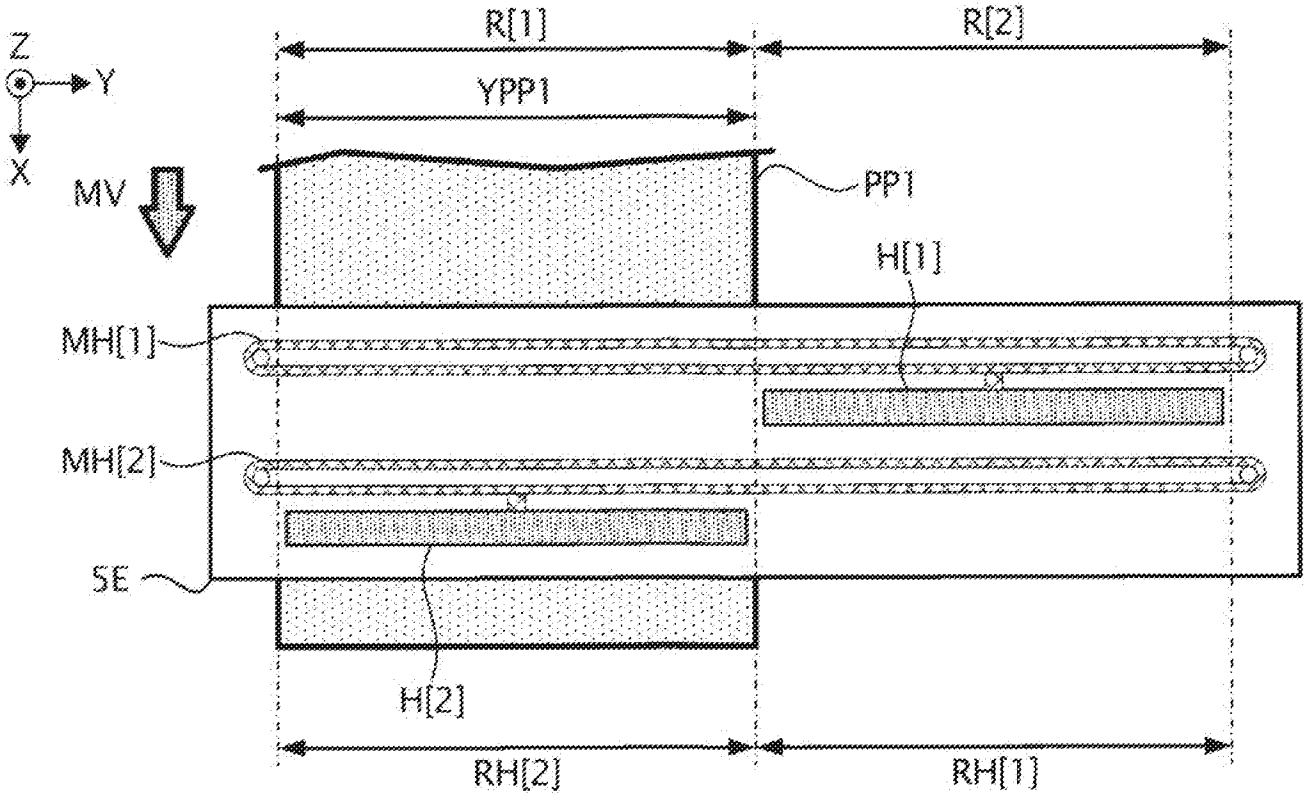
FIG. 49 is a plan view illustrating an example of a configuration of the heating unit according to Modification Example 5.1.

In addition, when the medium type information BT indicates that the print processing for the recording medium PP1 is executed, and when the print page information CP forms an even number of images in the print processing, as illustrated in FIG. 49, the position designation section 25 designates that the region RH[1] where the heater H[1] exists matches the region R[2] to the heater moving device MH[1], and supplies the position designation signal Ctr-M for designating that the region RH[2] where the heater H[2] exists matches the region R[1] to the heater moving device MH[2] with respect to the heater moving mechanism 50. In addition, in a case illustrated in FIG. 49, the heating intensity information generation section 240E heats the recording medium PP1 by the heater H[2] by setting the value indicated by the heater heating intensity information B[k] that corresponds to the heater H[2] to the value indicated by the region heating intensity information KR[1], and stops the generation of heat by the heater H[1] by setting the value indicated by the heater heating intensity information B[k] that corresponds to the heater H[1] to "0".

As described above, according to the modification example, since the heater H[k] which is not used for heating the recording medium PP1 is moved to be separated from the recording medium PP1, it becomes possible to prevent the recording medium PP1 from being damaged by the heat that remains in the heater H[k] which is not used for heating the recording medium PP1.

In the modification example, the heater H[k] which is not used for heating the recording medium PP1 is moved to be separated from the recording medium PP1 in the Y axis direction, but such an embodiment is merely an example. For example, the heater H[k] that is not used for heating the recording medium PP1 may be moved to be separated from the recording medium PP1 in a direction different from the Y axis direction. For example, the heater H[k] that is not used for heating the recording medium PP1 may be moved to be separated from the recording medium PP1 in the +Z direction.

As described above, in the ink jet printer 1E according to the modification example, the heater moving mechanism 50 moves the heater H[1] such that the distance between the recording medium PP1 and the heater H[1] during the period in which the print page information CP indicates an even number becomes farther than the distance between the recording medium PP1 and the heater H[1] during the period in which the print page information CP indicates an odd number, and moves the heater H[2] such that the distance between the recording medium PP1 and the heater H[2] during the period in which the print page information CP indicates an odd number becomes farther than the distance between the recording medium PP1 and the heater H[2] during the period in which the print page information CP indicates an even number.

Therefore, in the embodiment, it becomes possible to prevent the recording medium PP1 from being damaged by the heat from the heater H[1] during the period in which the print page information CP indicates an even number, and it becomes possible to prevent the recording medium PP1 from being damaged by the heat from the heater H[2] during the period in which the print page information CP indicates an odd number.

Further, in the ink jet printer 1E according to the modification example, the heater moving mechanism 50 moves the heater H[1] to the region R[2] that does not include the range YPP1 where the recording medium PP1 extends during the period in which the print page information CP indicates an even number, and moves the heater H[2] to the region R[2] that does not include the range YPP1 where the recording medium PP1 extends during the period in which the print page information CP indicates an odd number.

Therefore, in the embodiment, it becomes possible to prevent the recording medium PP1 from being damaged by the heat from the heater H[1] during the period in which the print page information CP indicates an even number, and it becomes possible to prevent the recording medium PP1 from being damaged by the heat from the heater H[2] during the period in which the print page information CP indicates an odd number.

Further, in the ink jet printer 1E according to the modification example, the heater moving mechanism 50 moves the heater H[1] and the heater H[2] such that the region RH[1] where the heater H[1] exists and the region RH[2] where the heater H[2] exists include the range YPP2 when the transport unit 4 transports the recording medium PP2 that extends to the range YPP2 in the +Y direction, and the heating unit 5E heats the recording medium PP2 by the heater H[1] and the heater H[2] when the transport unit 4 transports the recording medium PP2 that extends to the range YPP2 in the +Y direction.

Therefore, in the embodiment, it becomes possible to heat not only the recording medium PP1 but also the recording medium PP2 by using the heater H[1] and the heater H[2].

6. Other Modification Examples

The embodiments and modification examples described above can be modified in various manners. Specific modifications will be described below. Two or more aspects selected in any manner from the following examples can be appropriately combined with each other within a range not inconsistent with each other. In addition, in the modification examples illustrated below, elements having the same effects and functions as those of the embodiment will be given the reference numerals used in the description above, and the detailed description thereof will be appropriately omitted.

Modification Example 6.1

In the embodiments and modification examples described above, the nozzle row Ln extends in the Y axis direction, but the disclosure is not limited to such an aspect. The nozzle row Ln may extend in a direction intersecting the Y axis direction.

Figure 50:
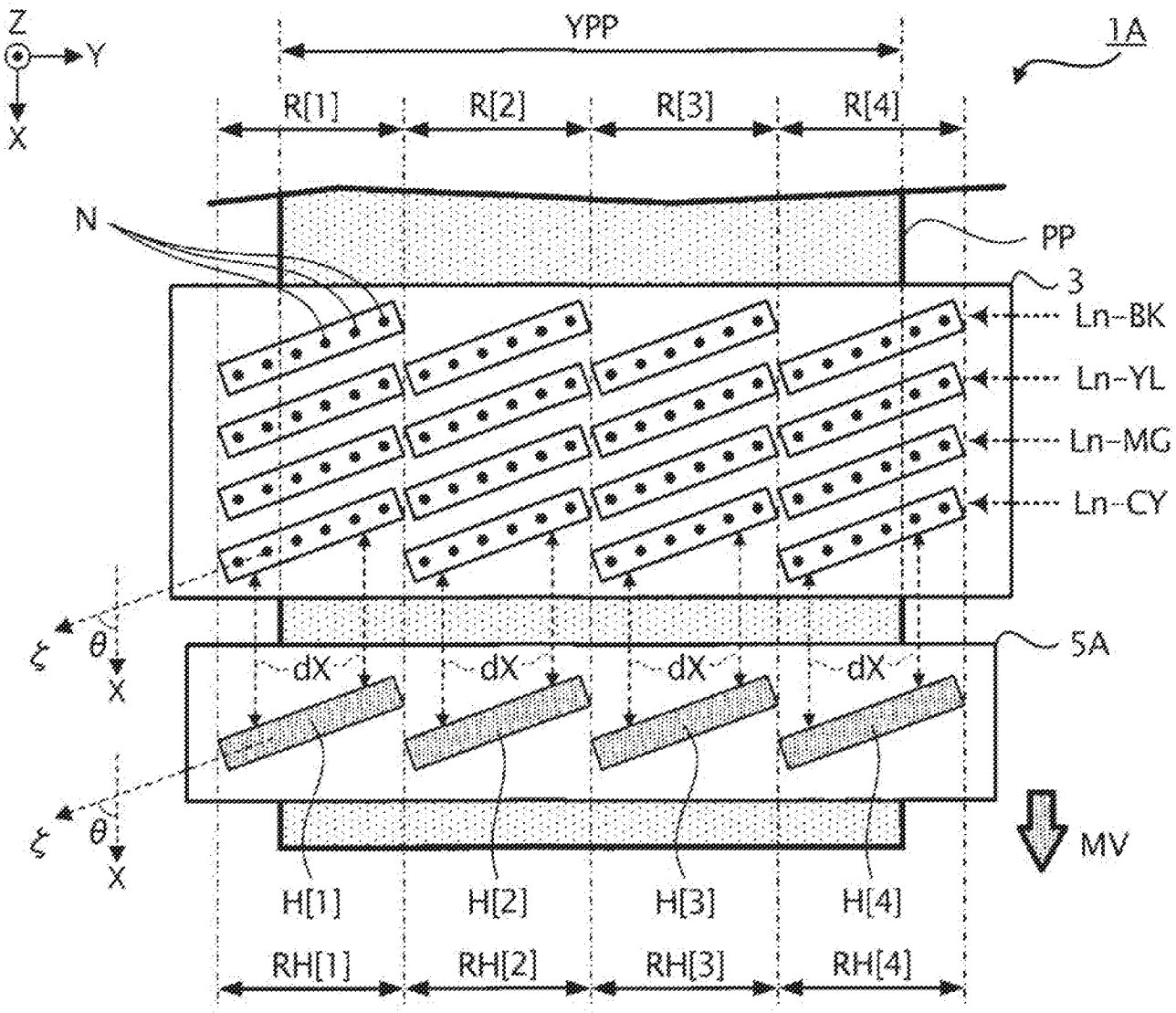
FIG. 50 is a plan view illustrating an example of a configuration of a printing unit and a heating unit according to Modification Example 6.1.

For example, as illustrated in FIG. 50, in the printing unit 3 provided in the ink jet printer 1A or the like, when the printing unit 3 is viewed from the +Z direction, the nozzle row Ln may be disposed to extend in the ζ direction intersecting the +X direction at the angle θ.

Further, as illustrated in FIG. 50, the heater H[k] may be disposed such that the ζ direction is the longitudinal direction. In this case, in the region RH[k] where the heater H[k] is provided, it is preferable that the nozzle row Ln is provided such that the nozzle row Ln extends in the ζ direction and the interval between the nozzle row Ln and the heater H[k] in the X axis direction is maintained at a fixed distance dX.

In the example illustrated in FIG. 50, since the distance between each of the plurality of discharge sections D that configure the nozzle row Ln and the heater H[k] is maintained at the fixed distance dX, compared to a case where the nozzle row Ln and the extending direction of the heater H[k] are parallel to each other, it becomes possible to reduce the heating unevenness by the heater H[k].

Modification Example 6.2

In the embodiments and the modification examples described above, the ink jet printer may be a line printer, but may be a serial printer. Specifically, an ink jet printer that includes the printing unit 3 narrower in the Y axis direction than the recording medium PP, and executes the print processing while reciprocating the printing unit 3 in the Y axis direction may be employed.

Modification Example 6.3

In the embodiments and modification examples described above, the ink jet printer discharges ink from the nozzles N by vibrating the piezoelectric element PZ, but the disclosure is not limited to such an aspect, and for example, a so-called thermal method may be used in which a heating element provided in the cavity 322 generates heat to generate air bubbles in the cavity 322 to increase the pressure inside the cavity 322 and thereby discharge ink.

What is claimed is:

1. A printing apparatus comprising:

a transport section that transports a medium in a first direction;

a discharge section that discharges a liquid to the medium transported by the transport section;

a signal generation section that outputs a first pulse signal; and a heating section that is provided downstream of the discharge section in the first direction, includes a first heater that generates heat in accordance with a first pulse included in the first pulse signal, and heats the medium, wherein the signal generation section adjusts the first pulse in accordance with a heating amount for heating the medium by the heating section.

2. The printing apparatus according to claim 1, wherein the signal generation section adjusts a width of the first pulse in accordance with the heating amount for heating the medium by the heating section.

3. The printing apparatus according to claim 1, wherein the signal generation section adjusts a density of the first pulse in accordance with the heating amount for heating the medium by the heating section.

4. The printing apparatus according to claim 1, wherein the signal generation section outputs a second pulse signal different from the first pulse signal, and the heating section includes a second heater that generates heat in accordance with a second pulse included in the second pulse signal.

5. The printing apparatus according to claim 4, wherein the signal generation section generates the first pulse signal based on a first clock signal, and generates the second pulse signal based on a second clock signal different from the first clock signal.

6. The printing apparatus according to claim 5, wherein the signal generation section includes a delay section that delays a phase of the first clock signal and generates the second clock signal.

7. The printing apparatus according to claim 5, wherein a rising timing of a clock waveform of the first clock signal and a rising timing of the clock waveform of the second clock signal are different from each other.

8. The printing apparatus according to claim 1, wherein the first heater includes a ceramic substrate, a heat generating resistor provided on the ceramic substrate, and a protection section that protects the heat generating resistor.

* * * * *